United States Patent [19]

Macheel

[11] 4,339,134

[45] Jul. 13, 1982

[54] ELECTRONIC CARD GAME

[75] Inventor: Gary W. Macheel, Anaheim, Calif.

[73] Assignee: Rockwell International Corporation, El Segundo, Calif.

[21] Appl. No.: 813,199

[22] Filed: Jul. 5, 1977

[51] Int. Cl.[3] ..... A63F 1/00

[52] U.S. Cl. ..... 273/138 A; 273/1 ES; 364/900

[58] Field of Search ..... 273/1 E, 138 A, 143 R, 273/143 C, DIG. 28; 235/92 GA; 340/323 R; 364/200, 200 MS File, 900, 900 MS File, 410–412

[56] References Cited

U.S. PATENT DOCUMENTS

| | | | |
|---|---|---|---|
| 3,269,503 | 8/1966 | Foster | 273/138 A X |
| 3,735,982 | 5/1973 | Gerfin | 273/138 A |
| 3,770,269 | 11/1973 | Elder | 273/1 E |
| 3,796,433 | 3/1974 | Fraley | 273/138 A |
| 3,810,627 | 5/1974 | Levy | 273/138 A |
| 3,876,208 | 4/1975 | Wachtler et al. | 273/1 E X |
| 3,889,956 | 6/1975 | Castle | 273/1 E |
| 3,962,800 | 6/1976 | Feldheim | 273/138 A |
| 4,026,555 | 5/1977 | Kirschner et al. | 273/DIG. 28 |
| 4,052,057 | 10/1977 | Castle | 273/1 E |
| 4,095,795 | 6/1978 | Saxton et al. | 273/138 A |
| 4,156,928 | 5/1979 | Inose et al. | 273/DIG. 28 |
| 4,162,792 | 7/1979 | Chang et al. | 273/86 B |

FOREIGN PATENT DOCUMENTS

| | | | |
|---|---|---|---|
| 2449631 | 4/1976 | Fed. Rep. of Germany | 235/92 GA |

*Primary Examiner*—Vance Y. Hum

*Attorney, Agent, or Firm*—H. Fredrick Hamann; Wilfred G. Caldwell

[57] ABSTRACT

An electronic card game simulation apparatus adapted primarily for portable hand-held use by a player. A microprogrammed MOS/LSI device receives selection signals generated by means of a keyboard to which a player has access, and controls the progress of the card game in response thereto and in accordance with established game rules as programmed in a storage device such as a read only memory unit. A display device, such as a plurality of seven-segment fluorescent displays, indicates the identity of simulated playing cards dealt randomly from a full 52-card deck of simulated cards as the game progresses. In a preferred embodiment, the microprogrammed device includes memory capacity, arithmetic capability, and appropriate programming to permit a player to play the well known game of Blackjack against a phantom dealer and to place bets which are automatically added or subtracted from a previously established stake in accordance with the outcome of each hand.

9 Claims, 36 Drawing Figures

| | 0 | 1 | 2 | 3 |
|---|---|---|---|---|
| 0 | | | | |
| 1 | | | | |
| 2 | | | | |
| 3 | | | | |
| 4 | | | | |
| 5 | | | | |
| 6 | | | | |
| 7 | | | | |
| 8 | K(S) | Z(S) | W(S) | T(S) |
| 9 | K(E) | Z(E) | W(E) | T(E) |
| 10 | VDELAY | DI CF U V | LS | RN CR M |
| 11 | VDELAY | VDELAY | N D R OF | Q MD K PM |
| | $K_{REG}$ | $Z_{REG}$ | $W_{REG}$ | $T_{REG}$ |

| | 0 | 1 | 2 | 3 | |
|---|---|---|---|---|---|
| 00 | 10 20 30 | DEALER TOT | DEALER'S 1 | R0 | 0 |
| 01 | 11 21 31 | DB 16 DA | 2 | R1 | 1 |
| 02 | 12 22 32 | PLAYER TOT | 3 | R2 | 2 |
| 03 | 13 23 33 | HIB 16 PA | 4 | R3 | 3 |
| 04 | 14 24 34 | SPLIT TOT | 5 | R4 | 4 |
| 05 | 15 25 35 | H2C H2B 16S SA | 6 | R5 | 5 |
| 06 | 16 26 36 | | 6 | UNITS DIGIT R6 | 6 |
| 07 | 17 27 37 | PBJ INS DBJ A1 | 5 | TENS DIGIT R7 | 7 |
| 08 | 18 28 38 | DBL SP SPA SPLIT | 4 | PAD | 8 |
| 09 | 19 29 39 | NUMBER OF CARDS | 3 | NEW | 9 |
| 40 | 50 60 70 | 80 90 DEALT | 2 | HS DS3 DS2 DS | 10 |
| 41 | 51 61 71 | 81 91 TBJ | PLAYER'S 1 | PR HO G | 11 |
| | $C_{REG}$ | $S_{REG}$ | $H_{REG}$ | $R_{REG}$ | |

FIG. 4

ELECTRONIC CARD GAME

BACKGROUND OF THE INVENTION

1. Field of the Invention

This invention relates generally to games of chance and more particularly to an electronically controlled card game apparatus of the type in which a player is dealt and selects a series of simulated playing cards generated in a random fashion from a simulated deck of 52 such cards and displayed whereby the cards dealt and selected may be identified.

2. Description of the Prior Art

Known prior art electrical card game simulation devices permit a player to play such games as blackjack or poker against a simulated dealer represented by the apparatus. It is also known that there are numerous mechanical devices for playing card games such as poker and blackjack, but which permit something less than a realistic simulation of a truly random situation achieved in the actual play of such card games with printed playing cards. Unfortunately, in order to achieve a modicum of realism and an accurate representation of the true probabilities of actual card games the electronic card game simulation devices of the prior art are unduly complex and large and require substantial amounts of electric power which render them impractical for convenient portable hand-held use. Although the mechanical card game simulation devices of the prior art have been manufactured in more convenient sizes for portable hand-held use, they leave much to be desired and fall far short of any realistic simulation of an actual card game.

SUMMARY OF THE INVENTION

The subject invention overcomes the disadvantages of the known prior art by providing an accurate and realistic simulation of at least one known card game by employing large scale integrated (LSI) circuit devices. Such devices are amenable to low power operation and to extremely small package sizes, thereby providing apparatus that may be powered by small conventional dry cell or rechargeable batteries and housed in electronic calculator type packaging conducive to portability and hand-held operation.

The invention comprises a programmed microprocessor, an electronic keyboard, and a multiple digit display device. The microprocessor in a MOS/LSI device on a single chip that includes fixed and alterable memory devices. Arithmetic and logic devices, also located on said chip, operate to receive selection signals from the keyboard to control the card game in accordance with the selections made thereby and in accordance with the rules of the game as programmed into the fixed memory device of the microprocessor. In addition, signals are generated for displaying on said display device, indications of the simulated cards that comprise the respective card hands of the player and of a simulated dealer.

Large scale integration of the microprocessor circuits permits the inclusion of circuits to provide accurate and realistic simulation of the various nuances of a card game as it might be played using actual playing cards. For example, in a preferred embodiment in which the well known game of blackjack is simulated, the player may choose a stake amount from which he may make bets upon each hand in an effort to increase the value of his stake but at the risk of decreasing the value of the stake. In the preferred embodiment, after the initial playing cards are dealt the player may choose to stand with the cards already dealt or, in the alternative, he may choose to accept additional cards in an effort to improve his hand but at the risk of going "bust". Furthermore, the player has a number of betting options such as doubling his bet upon the dealing of one additional card, insuring his bet against dealer blackjack when the dealer shows an Ace, and splitting his bet when he receives a pair of equal value cards in the original deal. In addition, the simulated dealer is required to follow the accepted rules of blackjack by dealing additional cards to "his" hand if "he" displays a combination of 16 or less in "his" originally dealt cards. Similarly the dealer must stand with the hand originally dealt if the combined value of those cards is 17 or greater.

The invention also simulates the random selection of cards from a true deck of 52 cards and automatically re-shuffles the entire 52 card deck prior to the beginning of the new hand if, in previous hands of the same game, the total number of cards distributed to the respective players has exceeded 38. Although the particular preferred embodiment disclosed herein is especially adapted for play of the game of blackjack, it will be apparent that with modified circuitry and programming similar to the disclosed circuitry and programming referred to below, the present invention can be utilized to provide electronic simulations of other card games such as, draw poker and gin rummy. The preferred embodiment also provides a standard four-function calculator, the operation of which may be selected as an alternative to the game of blackjack. It will be readily apparent from the discussion below that this is only one combination for which the present invention may be configured and that other combinations such as a plurality of games, may be provided in other embodiments.

BRIEF DESCRIPTION OF THE DRAWINGS

FIG. 4 is a map of the random access memory device contained within the microprocessor block diagram of FIG. 3.

DESCRIPTION OF A PREFERRED EMBODIMENT

Figure 1:
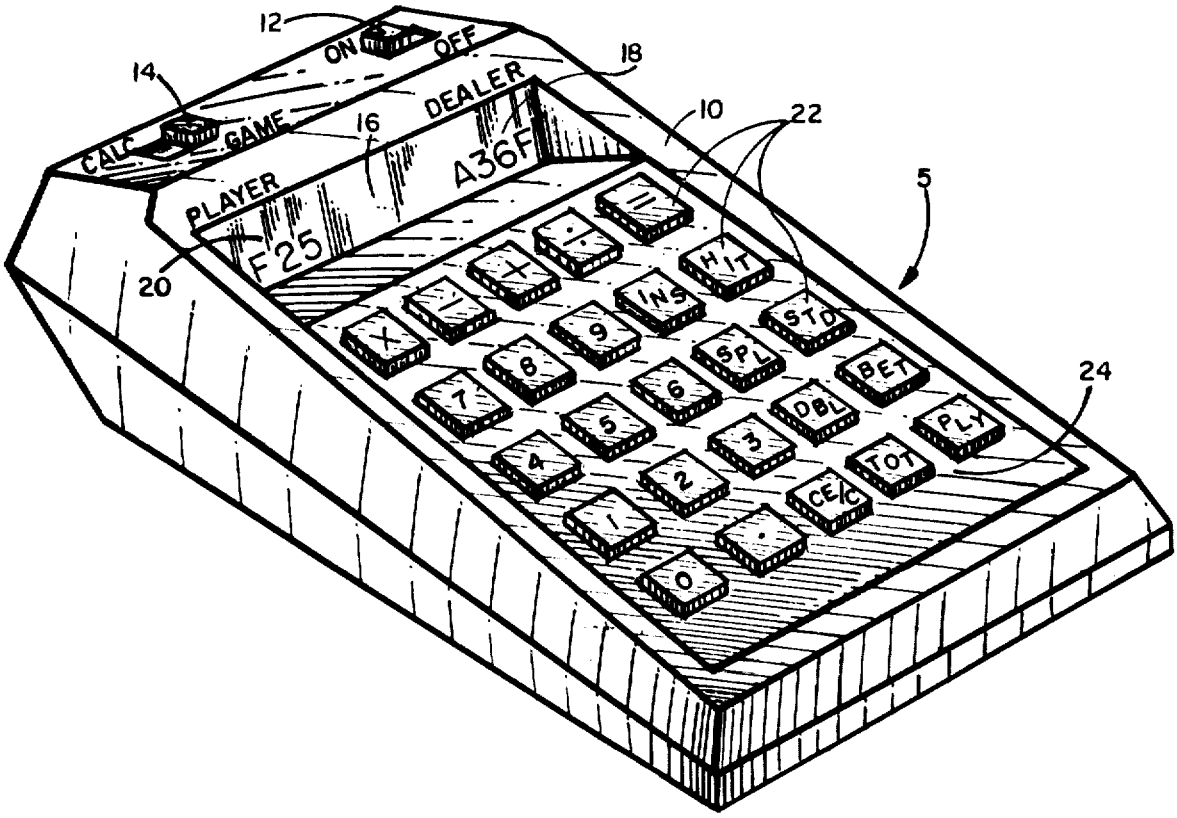
FIG. 1 is an isometric view of a typical hand-held portable blackjack card game apparatus of the invention.

Referring now to FIG. 1, there is shown therein, an assembled electronic portable hand-held blackjack playing card game 5 having a housing 10, an on/off switch 12, a calculator/game selection switch 14, a display 16 having dealer display portion 18 and player display portion 20, and a keyboard 24 having a plurality of depression actuated keys 22.

It will be observed that the electronic blackjack game 5 is similar in appearance to well-known hand-held calculators. In fact, a preferred embodiment includes a calculator/game selection switch 14 which permits the user to choose between the game playing functions to be described in detail herein below and calculator functions such as, addition, subtraction, multiplication and division which are well-known and need not be described in great detail. The size and shape of the game 5 may be similar to such calculators with differences residing in the specific functions assigned to keys 22 of keyboard 24 which in the described embodiment of the invention, are uniquely associated with the game of blackjack. Another principal difference between the game assembly of the invention and ordinary calculator assemblies, is that the display 20 and the associated driving logic are capable of displaying symbols to identify the various different card values associated with the game of blackjack and are capable of separately displaying the cards attributable to the dealer's hand and the cards attributable to the player's hand so that the two hands can be distinguished by the player.

In order to more fully understand the function of the various keys of the invention that are associated with the game of blackjack, it will be necessary to understand the rules of the game of blackjack, a description of which now follows.

RULES OF THE GAME

The invention has been designed to permit a player to play Las Vegas Blackjack, that is, a dealer against one player. The player begins each series of hands with a specified amount of money called a stake. Before each hand is dealt, the player may specify the amount he desires to bet on that particular hand. The blackjack game records the player's bet and at the completion of the hand, the player's stake is properly adjusted, either up, down, or unchanged depending on whether respectively, the player won, lost, or tied (pushed). Credit is automatically advanced should the amount lost exceed the player's current stake balance.

Once the bet has been placed, the blackjack game automatically begins to deal, and two cards are displayed on the left for the player while one card is displayed on the right for the dealer. A second card dealt to the dealer is not displayed. The cards are displayed as follows: if the card value is two through nine, the display reveal the corresponding two through nine respectively. All face cards and cards having value 10 are displayed by the symbol F and all Aces are displayed by the symbol A. Aces may be counted as either a 1 or an 11 in card value. Each hand is dealt randomly from a 52 card deck. Shuffling occurs when the blackjack game mode is first turned on and also occurs automatically prior to the beginning of a new hand if the 38th card in the deck was dealt in the preceding hand. The shuffling continues until the CE/C (Clear Entry/Clear) key is depressed to terminate shuffling.

While playing a hand, the player may, depending on the circumstances, accept or decline insurance, split a pair, double down, take a hit or stand. The meanings of these terms of the standard blackjack game are indicated below. If only the player is dealt a card total of 21 (blackjack), a win is recorded which pays one and one-half times the value of the bet to his stake. Once the hand has been completed, the player may review his current stake balance by depressing the Total key. The object of the game is to beat the dealer by achieving a card total less than or equal to 21 and greater than the dealer's card total. Once the player goes buts (exceeds 21) the dealer automatically shows his second card and wins. When the player stands, with 21 or less, the dealer automatically shows the second card and then continually takes additional cards until the dealer's hand exceeds 16. If the dealer's hand exceeds 21 the dealer busts and the player wins.

To begin the next hand, the player depresses the play key and the display blinks a zero and decimal point until the next bet is entered, unless automatic shuffle is required as previously described. If either the dealer or the player is dealt blackjack, the blackjack game automatically terminates the hand and debits or credits the player's stake in accordance with the outcome, unless the dealer shows an Ace. When both player and dealer are dealt blackjack, the hand is automatically terminated, but the stake remains unchanged.

BLACKJACK KEYS

The Bet key is a dual function key for entering the player's stake (initial bankroll) and for entering the bet for each hand. The stake is entered as follows:

Step 1—Set the mode switch to: GAME
Step 2—Set the power switch to: ON
Step 3—Depress CE/C to terminate card shuffling.
Step 4—Enter the amount of the stake. If an error is made depress CE/C and re-enter the correct value.
Step 5—Depress bet. At this point a single zero is displayed prompting a bet for the first hand. If a different stake was desired begin again with Step 1.

The bet for each hand is entered by indexing the amount and then depressing the Bet key. Card dealing then begins.

The Hit key is depressed when a hit is desired, that is, when a player desires an additional card after the original four cards are dealt, two each to the player and dealer. The player may take a hit as desired until he chooses to stand or until a bust occurs.

The Stand key is a dual function key. Its primary function is to indicate that the player's hand is satisfactory which then initiates dealer action. If the player wins the hand, an amount equal to the bet is automatically added to the value of the stake. On the other hand, if the player loses the hand, the bet is deducted from the stake. A tie results in no change to the stake.

The player also uses the Stand key to decline insurance when the dealer shows an Ace. Normal play then resumes if the dealer did not have blackjack, otherwise the hand is over and the player has lost.

The Insurance key is operable only when the dealer shows an Ace. The player may do one of the following: he may accept insurance equal to one-half of the bet for the hand by depressing the Insurance key. If the dealer has blackjack the insurance bet is paid 2-to-1, which is equal to the total bet of that hand. Consequently, since the original bet is lost as a result of the dealer winning by means of a blackjack hand (unless the player also has a blackjack), the total result is a push, that is, no gain or loss of money from the player's stake. If the player also has a blackjack the resultant gain is the value of the original bet. If the dealer does not have blackjack, then the insurance bet, that is one-half of the hand bet, is automatically deducted from the stake and normal play resumes. The player may also decline insurance by depressing the Stand key. If the dealer has blackjack, the player loses the bet. If the dealer does not have blackjack, then normal play resumes.

The Split key is operable only if the first two cards dealt to the player constitute a pair, that is, two face cards, two Aces or two other cards of equal value. Once depressed, the Split key initiates the following action: an amount equal to the bet for this hand is secured for the second hand. The card value of the second card dealt is retained in memory but cleared from the first hand, and a third card is automatically dealt, thus displaying two cards for the player's first hand. The player may take additional cards using the HIT key as usual until he depresses the stand key to terminate the first hand. At this point the total count of the first hand is stored in memory. Then the original second card value is displayed and a second card for the second hand is dealt. Like the first hand, the player takes additional cards using the HIT key until he depresses the Stand key or a bust occurs. In either case, dealer action then proceeds. The outcome of each hand is then promptly accounted for and the stake is adjusted as usual. If two Aces are dealt the player in the original deal and the Split key is depressed, the split occurs automatically and one additional card is dealt to each hand of the two split hands. Dealer action then follows.

The player may use the Double key to double his bet in exchange for a one card hit. When the Double key is depressed, the following action takes place: An amount equal to twice the placed bet, is secured as the new bet, the player is automatically dealt one card, and dealer action proceeds as usual.

If the player wins, the new bet is added to the stake. Similarly, the bet is subtracted from the stake if the dealer wins. A tie, that is equal card totals for both the player and the dealer, results in a push, that is, no change to the stake.

After a hand (both hands in the case of a split deal) has been completed, the player may depress the Total key to review the financial progress of the game that is, the new value of the stake. The player may then depress the Play key to begin the next hand.

When the Play key is depressed, one of the following actions takes place: If a zero and decimal blinking action are displayed, that indicates it is time to place the bet for the upcoming hand. If eight zeros and decimals appear blinking on the display, that indicates that shuffling is taking place because in the previous hand the thirty-eighth card of the deck was dealt. The player terminates shuffling by depressing the CE/C key. After this key is depressed, a zero and decimal will be displayed in blinking form to indicate that it is time to place the bet for the next hand.

Table I is an illustrative example of a portion of a game sequence utilizing the preferred embodiment of the present invention. As indicated, Table I includes a column of explanatory comments on the left, a key sequence column which indicates the possible sequence of key depressions for this particular example, and on the right, a column of displayed information indicating the player and dealer cards drawn at random in a plurality of illustrative blackjack hands.

Figure 2:
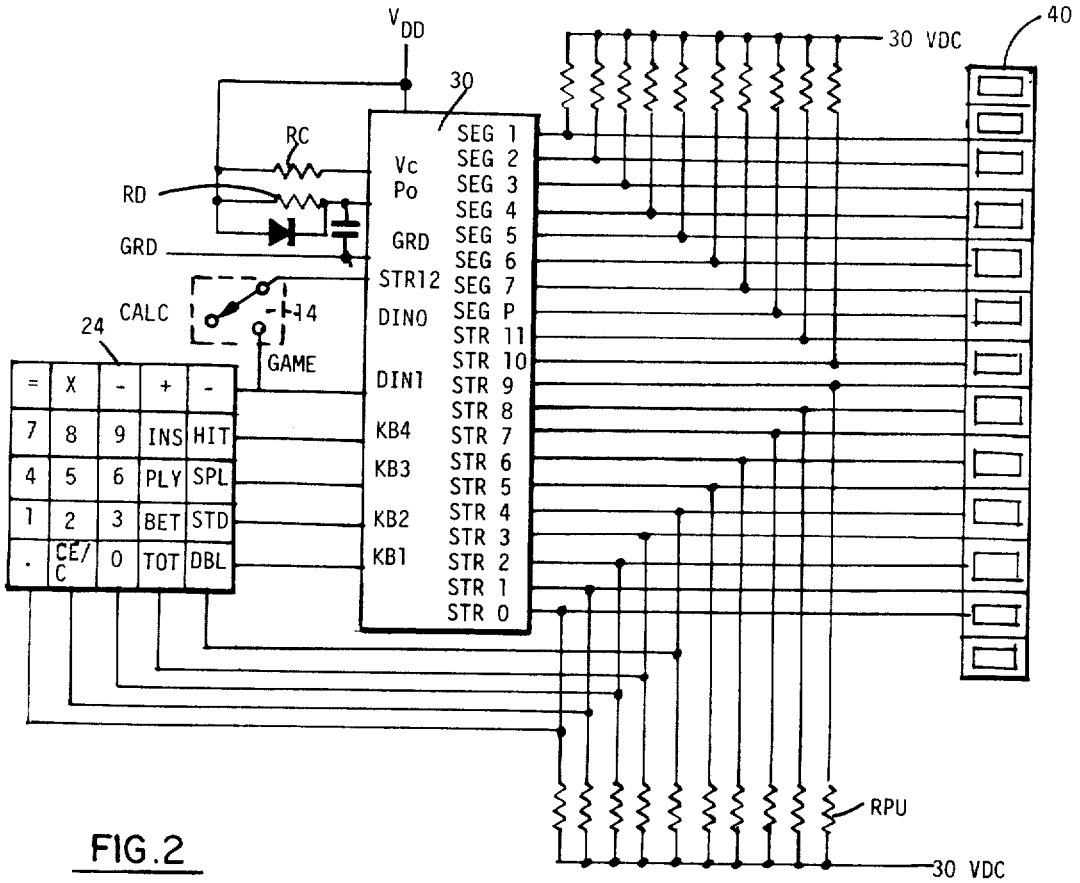
FIG. 2 is a schematic block diagram of the invention indicating the interconnections between three principal elements of the invention.

Referring now to FIG. 2 there are shown therein the three major components of a preferred embodiment of the invention, namely, keyboard 24, programmable microprocessor chip 30, and 12-digit display 40. Also shown are various peripheral components employed in the fully assembled blackjack card game version of the invention.

As shown in FIG. 2, the programmable microprocessor chip 30 is connected to the 12-digit display 40 at its segment and strobe terminals SEG 1 through SEG 7, SEGP and STR0 through STR11. Each terminal is also connected to −30 volts DC through a pull-up resistor RPU which may, for example, have a value of 100,000 OHMS. In addition, microprocessor chip 30 is connected to keyboard 24 by means of four keyboard lines KB1 through KB4 and a discrete input line DIN1. An additional strobe line STR12 is connected to a calculator-game switch 14. Resistor RD, resistor RC and capacitor CF are used to apply the appropriate DC voltages to the programmable microprocessor chip terminals VC and PO respectively.

In one embodiment RC has a value of 56 KOHMS, RD has a value of 180 KOHMS and CF has a value of 0.47 microFarads. Because the manner in which a programmable microprocessor chip, a keyboard and a multi-digit display are interconnected is well known in the art, particularly with respect to calculator type devices, a more detailed description of the interrelationship therebetween is not required. However, a more detailed description of microprocessor chip 30 is desirable and follows in conjunction with the microprocessor chip block diagram of FIG. 3.

Figure 3:
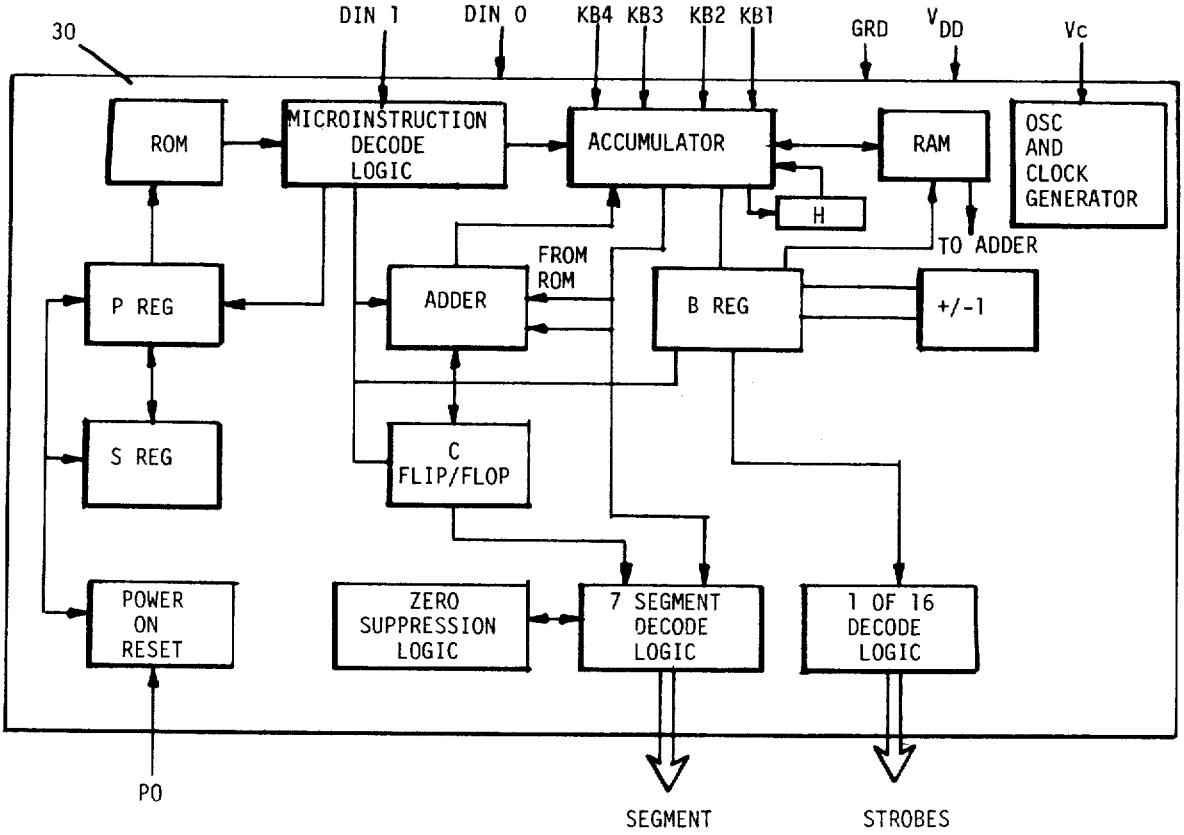
FIG. 3 is a block diagram representation of the microprocessor portion of the invention.

Referring now to FIG. 3, there is shown a preferred embodiment of the invention. In this embodiment, the device includes the elements listed herewith. However, this embodiment is not limitative of the invention. Chip 30 is a single MOS/LSI device parallel processing system. In a preferred embodiment, the device contains the following components:

1. A read only memory ROM containing microinstructions arranged as 24 pages of 64 8-bit words.
2. A random access memory RAM for storing information used during the processing of the program contained in the ROM. The RAM is arranged as a group of 8 12-word registers, each word containing 4 bits.
3. A 4-bit parallel binary adder.
4. A 4-bit accumulator.
5. A 4-bit temporary storage register H.
6. A discrete flip-flop C.
7. A 7-bit RAM address register B.
8. An 11-bit ROM address register P with an upper 5-bits designated PU and a lower 6-bits designated PL. p0 9. Two 10-bit save registers S designated respectively, SA and SB with an upper 4-bits and a lower 6-bits.
10. Up to 16 strobe signals STR0 through STR15 for sampling keyboard entries aand for driving display 40.
11. Four keyboard return lines designated KB1-KB4 and lines designated DIN1 and DIN0 for additional inputs.
12. Up to 10 data outputs with options for discrete or seven-segment decoding logic, designated SEG0 through SEG9
13. An oscillator and clock generator.

READ ONLY MEMORY UNIT (ROM)

The ROM is organized into 24 pages of 64 words each. Each word contains 8 bits. Chip 30 is programmed by means of microinstructions coded into the ROM. The ROM is organized in pages which are addressed by the upper 5 bits of the P register. The lower 6 bits, PL, address the specific 8-bit word on each page. The P register can be loaded from the S register. The register is normally incremented each bit time in order to address the next word in the ROM. Return locations, which are used when subroutines are employed, are stored in the save register S.

TABLE I

| COMMENT | KEY SEQUENCE ENTER | KEY SEQUENCE DEPRESS | DISPLAY (PLAYER) | DISPLAY (DEALER) |
|---|---|---|---|---|
| STEP 1 | SWITCH TO: "GAME" | | | |
| STEP 2 | TURN POWER "ON" | | (BLINKS) .0.0.0.0.0.0.0. | |
| STEP 3 | | [CE/C] | | (BLINKS) 0. |
| ENTER STAKE | 500 | [BET] | | 0 |
| ENTER BET | 50 | [BET] | 6 7 | F |
| TAKE HIT | | [HIT] | 6 7 A | F |
| | | [HIT] | 6 7 A 6 | F |
| STAY | | [STAND] | 6 7 A 6 | 5 F |
| WON: | | | 6 7 A 6 | 4 5 F |
| REVIEW STAKE BALANCE | (OPTIONAL | [TOTAL] | | 5 5 0. |
| ⋮ | ⋮ | | | ⋮ |
| PLAY NEXT HAND | | [PLAY] | | (BLINKS) 0. |
| ENTER BET | 100 | [BET] | 9 9 | 3 |
| SPLIT | | [SPLIT] | 9 2 | 3 |
| PLAY FIRST HAND | | [HIT] | 9 2 7 | 3 |
| | | [STAND] | 9 3 | 3 |
| PLAY SECOND HAND | | | 9 3 | 3 |
| PLAYER BUST | | [HIT] | 9 3 F | 3 |
| WON FIRST - LOST SECOND | | | 9 3 F | 4 F 3 |
| | (OPTIONAL | [TOTAL] | | 5 5 0. |
| PLAY NEXT HAND | | [PLAY] | (BLINKS) .0.0.0.0.0.0.0.0 | |
| SHUFFLE RESET | | [CE/C] | | (BLINKS) 0. |
| | 100 | [BET] | 5 6 | 5 |
| DOUBLE BET ON ONE CARD | | [DOUBLE] | 5 6 9 | F 5 |
| WON-DEALER BUST | | | 5 6 9 | 8 F 5 |
| | (OPTIONAL | [TOTAL] | | 7 5 0. |
| | | [PLAY] | | (BLINKS) 0. |
| | 200 | [BET] | F 9 | A |
| INSURANCE | | [INS] | F 9 | A |
| | | [STAND] | F 9 | 9 A |
| LOST - INSURANCE AND BET | (OPTIONAL | [TOTAL] | | 4 5 0. |

RANDOM ACCESS MEMORY ADDRESS REGISTER B

RAM address register B is divided into three parts. The four least significant bits from a digit address register BL. The next two significant bits form a register address register BU. The most significant bit, B7, is used to select between two groups of four registers in the random access memory RAM. (See FIG. 4)

RANDOM ACCESS MEMORY (RAM)

The RAM is used for the temporary storage of information in chip 30. The RAM has 4 bit words organized into registers. The most significant bit, B7, of the B register address can be set or reset. The upper two bits of the B register address can be loaded directly or toggled to change RAM registers. The lower 4 bits address the specific 4-bit word in each RAM register and can be loaded directly, with select values, loaded from the accumulator, incremented or decremented.

THE ADDER

The adder is a 4-bit parallel binary adder. The contents of the RAM can be added to the accumulator by means of the adder. The adder can also be employed to add the binary code represented by the 4 keyboard input lines KB1 through KB4 to the contents of the accumulator. There are 16 different instructions which can add different specified numbers directly to the contents of the accumulator.

THE ACCUMULATOR

The accumulator is a 4-bit register that can be loaded from the RAM, have its contents exchanged with selected contents of the RAM, be loaded directly by 16 different instructions, be loaded from the B register or complemented.

THE STORAGE REGISTER H

The storage register H is a 4-bit independent register which can be loaded from the accumulator, copied into the accumulator or loaded with the accumulator contents right-shifted 1 bit.

THE C FLIP-FLOP

The C flip-flop is a discrete flip-flop which can be set, reset, tested, or loaded from the carry output of the adder.

STROBE OUTPUT SIGNALS (STR0-STR15)

The 16 output strobe signals are generated at the output of a holding flip-flop, in the decode logic shown in the lower right-hand portion of FIG. 3. Each of these holding flip-flops can be loaded from the B register. Only one strobe signal can be enabled at any one time.

DATA OUTPUTS

The 10 data or segment output signals are generated at the output of a holding flip-flop in the segment decode logic shown in the lower right-hand portion of FIG. 3. The holding flip-flop for segment signals can be loaded through 7 segment display logic driven by the accumulator, or by dedicated bits when special symbols are required. The holding flip-flop for segment signal SEGP is loaded from the C flip-flop.

POWER ON RESET

The power on reset circuit is connected between the input P0 and ground. The power on reset circuit is used to reset the P and S registers to begin the program at a fixed location after the DC power is applied to the chip.

OSCILLATOR AND CLOCK GENERATOR

The oscillator and clock generator supply all the required clock signals to programmable chip 30.

INSTRUCTION SET OF CHIP 30

Table II below provides a complete listing of the instruction set for programmable microprocessor chip 30. The Table includes a brief description of notation used and the flags referred to in the instructions. The Table comprises three columns; a mnemonic column which is used to identify each instruction, an action column that the instruction initiates, and a description column which more fully explains the operation initiated by the instructions.

DESCRIPTION OF RAM MEMORY ALLOCATION

The RAM map of FIG. 4, including the various flags utilized in the flow charts of FIG'S. 5*a* through 30, will now be described.

The RAM for the computer of this invention is organized as eight registers containing twelve 4-bit words each. They are denoted, from left to right K, Z, W, T, C, S, H and R, respectively. The addressing distinguishes between the first four registers, (i.e. K, Z, W, T) and the latter four through the use of pointer bit B7 of the addressing scheme. When B7 is set or ONE, the last four registers, registers C, S, H, and R are being addressed and when B7 is ZERO, the first four registers are addressed.

TABLE II

NOTATION

| | |
|---|---|
| ( ) | DENOTES THE CONTENTS OF A REGISTER, FLIP-FLOP, OR A DEFINED GROUP OF TERMS |
| < > | DENOTES A GROUP OF ADDRESS TERMS |
| --> | DENOTES THE TRANSFER OF INFORMATION FROM ONE LOCATION TO ANOTHER |
| : | IF THE EXPRESSION TO THE LEFT OF THIS SYMBOL IS TRUE THEN THE OPERATION TO THE RIGHT OF IT WILL BE PERFORMED |
| ¬ | DENOTES THE LOGICAL COMPLEMENT OF A TERM OR REGISTER |
| & | DENOTES THE LOGICAL AND OPERATION |
| \| | DENOTES THE LOGICAL OR OPERATION |
| * | DENOTES THE LOGICAL EXCLUSIVE-OR OPERATION |

FLAG DEFINITIONS

| | |
|---|---|
| SR | SHORT SUBROUTINE FLAG |
| IGN | IGNORE INSTRUCTION FLAG |
| IGN2 | IGNORE TWO INSTRUCTIONS FLAG |
| TLF | LONG TRANSFER FLAG |
| ATPF | ATP INSTRUCTION FLAG |
| RLAX | LAX INSTRUCTION FLAG |
| RLB | LB INSTRUCTION FLAG |

TABLE II

| MNEMONIC | ACTION | DESCRIPTION |
|---|---|---|
| SATP | ¬IGN: 1 --> ATPF<br>0 --> IGN2, RLB, RLAX, TLF<br>IGN: (IGN2) --> IGN<br>0 --> IGN2, RLB, RLAX, TLF | THIS INSTRUCTION PERFORMS NO OPERATION IN ITSELF, IT SETS A FLAG (ATPF) WHICH MODIFIES SEVERAL OTHER INSTRUCTIONS. USEFUL MODIFICATIONS ARE PERFORMED ON SOME INSTRUCTIONS, ON OTHERS THE MODIFICATIONS MERELY ALLOW THESE INSTRUCTIONS TO PERFORM OPERATIONS ALREADY AVAILABLE WITH OTHER INSTRUCTIONS. IN ALL CASES OF INSTRUCTION MODIFICATION REFER TO THE SPECIFIC INSTRUCTION DESCRIPTION FOR AN EXACT EXPLANATION OF THE MODIFICATION. NOTE - - - - - - - - - CAUTION MUST BE EXERCISED WHEN USING THIS INSTRUCTION BECAUSE THE FLAG IS ONLY ZEROED WHEN AN EXECUTED TRA INSTRUCTION IS ENCOUNTERED. |
| NOP | (IGN2) --> IGN<br>0 --> IGN2, RLB, RLAX, TLF | NO OPERATION |
| RSC | ¬IGN: 0--> C<br>0 --> IGN2, RLB, RLAX, TLF<br>IGN: (IGN2) --> IGN<br>0 --> IGN2, RLB, RLAX, TLF | RESET C FF |
| SC | ¬IGN: 1 --> C<br>0 --> IGN2, RLB, RLAX, TLF<br>IGN: (IGN2) --> IGN<br>0 --> IGN2, RLB, RLAX, TLF | SET C FF |
| TC | ¬IGN: ¬(C) --> IGN<br>0 --> IGN2, RLB, RLAX, TLF<br>IGN: (IGN2) --> IGN<br>0 --> IGN2, RLB, RLAX, TLF | NEXT INSTRUCTION IS IGNORED IF C IS ZERO |
| COMP | ¬IGN: ¬ATPF: ¬(A) --> A<br>0 --> IGN2, RLB, RLAX, TLF<br>ATPF: 15 --> A<br>0 --> IGN2, RLB, RLAX, TLF | THE ONE'S COMPLEMENT OF THE ACCUMULATOR IS INSERTED INTO THE ACCUMULATOR. IF THE ATP FLAG HAS BEEN SET (ATPF = 1) THEN 15 WILL UNCONDITIONALLY BE LOADED INTO THE ACCUMULATOR. |

TABLE II

| MNEMONIC | ACTION | DESCRIPTION |
|---|---|---|
| | ¬IGN: (IGN2) --> IGN<br>0 --> IGN2, RLB, RLAX, TLF | THE STATE OF THE ATP FLAG WILL NOT BE AFFECTED BY THIS INSTRUCTION. |
| EXC X,0 | ¬IGN: ¬ATPF: (M<BU,BL>) <--> (A)<br>BU * X --> BU WHERE X=0,1,2,3<br>0 --> IGN2, RLB, RLAX, TLF<br>ATPF: (A) --> (M<BU,BL>)<br>¬(A) & (M<BU,BL>) --> (A)<br>BL + ¬(A)NEW --> BL<br>IGN: (IGN2) --> IGN<br>0 --> IGN2, RLB, RLAX, TLF | THE CONTENTS OF THE ACCUMULATOR ARE EXCHANGED WITH THE CONTENTS OF THE SELECTED MEMORY. BU IS REPLACED WITH THE RESULT OF A LOGIC EXCLUSIVE-OR OF BU AND X. IF THE ATPF FLAG HAS BEEN SET (ATPF=1) THEN THE ACCUMULATOR WILL BE REPLACED WITH THE RESULT OF A LOGICAL AND OPERATION BETWEEN THE SELECTED MEMORY AND THE COMPLEMENTED ACCUMULATOR CONTENTS. BL WILL BE MODIFIED AS SHOWN. THE STATE OF THE ATP FLAG WILL NOT BE AFFECTED BY THIS INSTRUCTION. |
| EXC X,+1 | ¬IGN: ¬ATPF: (M<BU,BL>) <--> (A)<br>BU * X --> BU WHERE X=0,1,2,3<br>BL = 9,11,13,15<br>OR 7,11,15<br>OR 11,15<br>OR 13,15<br>OR 15 : 1 --> IGN<br>BL + 1 --> BL<br>0 --> IGN2, RLB, RLAX, TLF<br>ATPF: (A) --> (M<BU,BL>)<br>¬(A) & (M<BU,BL>) --> (A)<br>BL + ¬(A)NEW + 1 --> BL<br>IGN: (IGN2) --> IGN<br>0 --> IGN2, RLB, RLAX, TLF | THE CONTENTS OF THE ACCUMULATOR ARE EXCHANGED WITH THE CONTENTS OF THE SELECTED MEMORY. BU IS MODIFIED AS IN EXC X,0. BL IS INCREMENTED BY 1 , HOWEVER THERE IS A ONE BIT TIME DELAY BETWEEN BL MODIFICATION AND THE AVAILABILITY OF THE DATA REFERENCED BY THE NEW VALUE OF BL. THE VALUES FOR BL WHICH CAUSE THE NEXT INSTRUCTION TO BE IGNORED ARE SELECTABLE AS A HARDWARE OPTION IF THE ATPF FLAG HAS BEEN SET (ATPF=1) THEN THE ACCUMULATOR WILL BE REPLACED WITH THE RESULT OF A LOGICAL AND OPERATION BETWEEN THE SELECTED MEMORY AND THE COMPLEMENTED ACCUMULATOR CONTENTS. BL WILL BE MODIFIED AS SHOWN. THE STATE OF THE ATP FLAG WILL NOT BE AFFECTED BY THIS INSTRUCTION. |
| EXC X,-1 | ¬IGN: ¬ATPF: (M<BU,BL>) <--> (A)<br>BU * X --> BU WHERE X=0,1,2,3<br>BL + 15 --> BL<br>¬OVERFLOW: 1 --> IGN<br>0 --> IGN2, RLB, RLAX, TLF<br>ATPF: 0 --> (M<BU,BL>)<br>0 --> (A) | SAME AS EXC X,+1 EXCEPT BL IS DECREMENTED BY 1, AND IF THE NEW CONTENT OF BL IS 15 THE NEXT ROM WORD WILL BE IGNORED. IF THE ATP FLAG HAS BEEN SET (ATPF=1) THEN BOTH THE SELECTED MEMORY AND THE ACCUMULATOR WILL BE LOADED WITH ZERO. THE STATE OF THE ATP FLAG WILL NOT BE AFFECTED BY THIS INSTRUCTION. |

TABLE II

| MNEMONIC | ACTION | DESCRIPTION |
|---|---|---|
| | TGN: (IGN2) --> IGN<br>0 --> TGN2, RLB, RLAX, TLF | |
| LB X,Y | ¬TGN: ¬ATPF: ¬RLB: (X) --> BU WHERE X = 0,1,2,3<br>(Y) --> BL WHERE<br>Y = 0,7,8,9,10,11<br>OR Y = 0,11,12,13,14,15<br>OR Y = 0,9,10,11,14,15<br>1 --> RLB<br>0 --> IGN, RLAX, TLF<br>RLB: NO ACTION<br>ATPF: ¬RLB: (X) --> BU<br>¬(A) & (Y) --> BL<br>RLB: NO ACTION<br>TGN: (IGN2) --> IGN<br>0 --> TGN2, RLB, RLAX, TLF | LOADS THE B REGISTER. THE UPPER TWO BITS (BU) WITH X AND THE LOWER FOUR BITS(BL) WITH Y. ONLY THE REFERENCED LB IN A STRING OF CONSECUTIVE LB INSTRUCTIONS WILL BE EXECUTED. THE DESIRED GROUP OF VALID Y VALUES IS SELECTABLE AS A HARDWARE OPTION. IF 6-16 DIGIT REGISTERS ARE USED THEN THE VALID X VALUES ARE: B7=0, X=0,1,2,3; B7=1, X=1,3. IF THE ATP FLAG HAS BEEN SET (ATPF = 1) THEN BL WILL BE LOADED WITH THE RESULT OF A LOGICAL AND OPERATION BETWEEN THE COMPLEMENTED CONTENTS OF THE ACCUMULATOR AND Y. THE STATE OF THE ATP FLAG WILL NOT BE AFFECTED BY THIS INSTRUCTION. |
| RSM X | ¬TGN: 0 --> (M<BU,BL,X>)<br>0 --> TGN2, RLB, RLAX, TLF<br>TGN: (IGN2) --> IGN<br>0 --> TGN2, RLB, RLAX, TLF | RESETS ONE BIT OF THE CONTENTS OF THE SELECTED MEMORY (M). X=8,4,2,1 CORRESPONDS TO BIT POSITIONS 4,3,2,1. |
| SM X | ¬TGN: 1 --> (M<BU,BL,X>)<br>0 --> TGN2, RLB, RLAX, TLF<br>TGN: (IGN2) --> IGN<br>0 --> TGN2, RLB, RLAX, TLF | SETS ONE BIT OF THE CONTENTS OF THE SELECTED MEMORY. X=8,4,2,1 CORRESPONDS TO BIT POSITIONS 4,3,2,1. |
| TM X | ¬TGN: ((M<BU,BL,X>) = 0 ) : 1 --> IGN<br>0 --> TGN2, RLB, RLAX, TLF<br>TGN: (IGN2) --> IGN<br>0 --> TGN2, RLB, RLAX, TLF | TESTS ONE BIT OF THE CONTENTS OF THE SELECTED MEMORY. THE NEXT ROM WORD WILL BE IGNORED IF THE SELECTED BIT=0. X=8,4,2,1 CORRESPONDS TO BIT POSITIONS 4,3,2,1. |
| TAM | ¬TGN: (A=M) : 1 --> IGN<br>0 --> TGN2, RLB, RLAX, TLF<br>TGN: (IGN2) --> IGN<br>0 --> TGN2, RLB, RLAX, TLF | THE CONTENTS OF THE ACCUMULATOR ARE COMPARED WITH THE CONTENTS OF THE SELECTED MEMORY. THE NEXT ROM WORD WILL BE IGNORED IF THEY ARE EQUAL. |
| PSB7 | ¬TGN: 0 --> B7 | THE MSB OF THE RAM ADDRESS REGISTER (B7) |

TABLE II

| MNEMONIC | ACTION | DESCRIPTION |
|---|---|---|
| | 0 --> IGN2, RLB, RLAX, TLF<br>IGN: (IGN2) --> IGN<br>0 --> IGN2, RLB, RLAX, TLF | IS RESET TO 0. |
| SB7 | ¬IGN: 1 --> B7<br>0 --> IGN2, RLB, RLAX, TLF<br>IGN: (IGN2) --> IGN<br>0 --> IGN2, RLB, RLAX, TLF | THE MSB OF THE RAM ADDRESS REGISTER (B7) IS SET TO 1. |
| ADD | ¬IGN: (A) + (M<BU,BL>) --> A<br>0 --> IGN2, RLB, RLAX, TLF<br>IGN: (IGN2) --> IGN<br>0 --> IGN2, RLB, RLAX, TLF | ADDS THE CONTENTS OF THE SELECTED MEMORY TO THE ACCUMULATOR PUTTING THE RESULT INTO (A). |
| ADD 1 | ¬IGN: (A) + (M<BU,BL>) + (C) --> C,A<br>0 --> IGN2, RLB, RLAX, TLF<br>IGN: (IGN2) --> IGN<br>0 --> IGN2, RLB, RLAX, TLF | SAME AS ADD EXCEPT THE C FLIP-FLOP SERVES AS A CARRY-IN AND A CARRY-OUT FOR THE ADD |
| ADD 1,1 | ¬IGN: (A) + (M<BU,BL>) + (C) --> C,A<br>(C) --> IGN<br>0 --> IGN2, RLB, RLAX, TLF<br>IGN: (IGN2) --> IGN<br>0 --> IGN2, RLB, RLAX, TLF | SAME AS ADD 1 EXCEPT THE NEXT ROM WORD WI BE IGNORED IF A CARRY-OUT IS GENERATED. |
| ADX X | ¬IGN: ¬ATPF: (A) + X --> A WHERE 0 =< X <= 15<br>0 --> IGN2, RLB, RLAX, TLF<br>¬OVERFLOW: 1 --> IGN<br>ATPF: 15 --> A<br>0 --> IGN2, RLB, RLAX, TLF<br>IGN: (IGN2) --> IGN<br>0 --> IGN2, RLB, RLAX, TLF | THE 4 BIT OPERAND (X) IS ADDED TO THE ACC MULATOR. THE NEXT INSTRUCTION IS EXECUTE IF AN OVERFLOW OCCURS AND IS IGNORED IF A OVERFLOW DOES NOT OCCUR. ADX 6 WILL ALWA PRODUCE AN OVERFLOW. IF THE ATP FLAG HAS BEEN SET (ATPF = 1) THEN THE ADX INSTRUCT ION WILL UNCONDITIONALLY LOAD 15 INTO THE ACCUMULATOR. THE STATE OF THE ATP FLAG I NOT AFFECTED BY THIS OPERATION. |
| LAX X | ¬IGN: ¬ATPF: X --> A WHERE 0 =< X <= 15<br>1 --> RLAX<br>0 --> IGN2, RLB, TLF<br>ATPF: ¬A & X --> A | THE FOUR BIT OPERAND (X) IS LOADED INTO THE ACCUMULATOR. ONLY THE REFERENCED LAX IN A STRING OF CONSECUTIVE LAX INSTRUCTIO WILL BE EXECUTED. IF THE ATP FLAG HAS BE |

TABLE II

| MNEMONIC | ACTION | DESCRIPTION |
|---|---|---|
| | 1 --> RLAX<br>0 --> IGN2, RLB, TLF<br>TGN: (IGN2) --> IGN<br>0 --> IGN2, RLB, RLAX, TLF | SET (ATPF = 1) THEN THE LAX INSTRUCTION CAUSES THE CONTENTS OF THE ACCUMULATOR TO BE REPLACED WITH THE RESULT OF A LOGICAL AND OPERATION BETWEEN X AND THE COMPLEMENT VALUE OF THE ACCUMULATOR. THE STATE OF THE ATP FLAG IS NOT AFFECTED BY THIS OPERATION. |
| LDA X | ¬TGN: ¬ATPF: (M<BU,BL>) --> (A)<br>BU * X --> BU WHERE X=0,1,2,3<br>0 --> IGN2, RLB, RLAX, TLF<br>ATPF: (M<BU,BL>) & ¬(A) --> A<br>0 --> IGN2, RLB, RLAX, TLF<br>TGN: (IGN2) --> IGN<br>0 --> IGN2, RLB, RLAX, TLF | COPIES THE CONTENTS OF THE SELECTED MEMORY INTO THE ACCUMULATOR. THE RESULT OF A LOGI EXCLUSIVE-OR OF BU AND X REPLACES BU. IF THE ATP FLAG HAS BEEN SET (ATPF = 1) TH THE CONTENTS OF THE ACCUMULATOR WILL BE RE PLACED WITH THE RESULT OF A LOGICAL AND OP TION BETWEEN THE CONTENTS OF THE SELECTED MEMORY AND THE COMPLEMENTED CONTENTS OF TH ACCUMULATOR. THE STATE OF THE ATP FLAG WI NOT BE AFFECTED BY THIS INSTRUCTION. |
| ATH | ¬TGN: ¬ATPF: (A) --> H<br>0 --> IGN2, RLB, RLAX, TLF<br>ATPF: 0 --> H<br>0 --> IGN2, RLB, RLAX, TLF<br>TGN: (IGN2) --> IGN<br>0 --> IGN2, RLB, RLAX, TLF | THE CONTENTS OF THE ACCUMULATOR ARE COPIED INTO THE STORAGE REGISTER. IF THE ATP FLAG HAS BEEN SET (ATPF = 1) THEN THE ATH INSTRUCTION WILL UNCONDITIONALLY LOAD 0 INTO THE STORAGE REGISTER. THE STATE OF THE ATP FLAG WILL NOT BE AFFECTED BY THIS INSTRUCTION. |
| ATHR | ¬TGN: ¬ATPF: 0 --> H4<br>(A4) --> H3<br>(A3) --> H2<br>(A2) --> H1<br>(A1): 1 --> C<br>0 --> IGN2, RLB, RLAX, TLF<br>ATPF: 0 --> H<br>0 --> C<br>0 --> IGN2, RLB, RLAX, TLF<br>TGN: (IGN2) --> IGN<br>0 --> IGN2, RLB, RLAX, TLF | COPIES THE ACCUMULATOR RIGHT SHIFTED RIGHT 1 BIT INTO THE STORAGE REGISTER. THE MSB OF H IS ZEROED. IF THE LSB OF A IS "0", T C FF IS SET, BUT IF IT IS "1", THE C FF IS NOT CHANGED. IF THE ATP FLAG HAS BEEN SET (ATPF = 1) THEN THE H REGISTER AND C WILL UNCONDITIONALLY BE SET TO ZERO. THE STATE OF THE ATP FLAG IS NOT AFFECTED BY THIS INSTRUCTION. |

TABLE II

| MNEMONIC | ACTION | DESCRIPTION |
|---|---|---|
| HTA | ¬IGN: ¬ATPF: (H) --> A<br>0 --> IGN2, RLB, RLAX, TLF<br>ATPF: 15 --> A<br>0 --> IGN2, RLB, RLAX, TLF<br>IGN: (IGN2) --> IGN<br>0 --> IGN2, RLB, RLAX, TLF | THE CONTENTS OF THE STORAGE REGISTER ARE COPIED INTO THE ACCUMLATOR. IF THE ATP FLAG HAS BEEN SET (ATPF =1) THEN 15 WILL UNCONDITIONALLY BE LOADED INTO THE ACCUMULATOR. THE STATE OF THE ATP FLAG IS NOT AFFECTED BY THE INSTRUCTION. |
| TL 7 | ¬IGN: 1 --> TLF<br>Z --> PUD<br>0 --> IGN2, RLB, RLAX<br>IGN: 1 --> IGN<br>0 --> IGN2, RLB, RLAX, TLF | TL IMMEDIATELY FOLLOWED BY TRA WILL RESULT IN A TRANSFER TO THE ROM WORD AT PU=7 AND PL=X, Z CAN BE 0 THRU 15. X IS THE ARGUMENT OF THE TRA INSTRUCTION. TL FOLLOWED BY ANY OTHER INSTRUCTION WILL PERFORM NO OPERATION. IF TL IS TO BE IGNORED THE FOLLOWING INSTRUCTION WILL BE IGNORED ALSO. |
| TRA 0,X | ¬IGN: ¬ATPF: X --> PL 1 BIT DELAY<br>PL + 1 --> SL<br>PU --> SU<br>1 --> SR<br>1 --> IGN<br>0 --> IGN2,RLB, RLAX, TLF<br>¬SR: ¬TLF: SR0 --> PU<br>TLF: PUD --> PU<br>SR: ¬TLF: SR0 --> PU<br>TLF: PUD --> PU<br>ATPF: 0 --> ATPF<br>X6, X5 --> P6, P5<br>(X4 - X1) \| (A4 - A1) --> P4 - P1<br>PL + 1 --> SL<br>PU --> SU<br>1 --> SR<br>1 --> IGN2<br>0 --> IGN, RLB, RLAX, TLF<br>¬SR: ¬TLF: SR0 --> PU<br>TLF: PUD --> PU<br>SR: ¬TLF: SR0 --> PU<br>TLF: PUD --> PU<br>IGN: (IGN2) --> IGN<br>0 --> IGN2, RLB, RLAX, TLF | THE RETURN ADDRESS IS SAVED BY PUSHING P DOWN INTO THE SA REGISTER WHICH IS PUSHED DOWN INTO THE SR REGISTER. THE SUBROUTINE FLAG IS SET. A TRA 0 NOT PRECEDED BY A TL WILL LOAD PU WITH THE SR0 BLOCK ADDRESS, AND PL WITH THE ADDRESS SPECIFIED BY X. TL PRECEDING TRA 0 CAUSES PU TO BE LOADED WITH THE ADDRESS SPECIFIED BY THE TL INSTRUCTION. IF THE ATP FLAG HAS BEEN SET (ATPF = THEN THE ADDRESS TO WHICH THE PROGRAM WILL TRANSFER TO IS MODIFIED BY PERFORMING A LOGICAL OR OF THE LAST 4 BITS OF X WITH THE 4 BITS OF THE ACCUMULATOR. THIS RESULT TOGETHER WITH THE FIRST 2 BITS OF X FORMS THE ADDRESS TO WHICH CONTROL WILL BE TRANSFERRED. THE OCCURENCE OF AN EXECUTED TRA WILL RESET THE ATP FLAG. |

TABLE II

| MNEMONIC | ACTION | DESCRIPTION |
|---|---|---|
| TRA 1,X | ¬TGN: ¬ATPF: X --> PL 1 BIT DELAY<br>1 --> IGN<br>0 --> IGN2,RLB, RLAX, TLF<br>¬SR: ¬TLF: PU --> PU<br>TLF: PUD --> PU<br>0 --> SR<br>SR: ¬TLF: SR1 --> PU<br>TLF: PUD --> PU<br>0 --> SR<br>ATPF: 0 --> ATPF<br>X6, X5 --> P6, P5<br>(X4 - X1) \| (A4 - A1) --> P4 - P1<br>1 --> IGN2<br>0 --> IGN, RLB, RLAX, TLF<br>¬SR: ¬TLF: PU --> PU<br>TLF: PUD --> PU<br>SR: ¬TLF: SR1 --> PU<br>TLF: PUD --> PU<br>0 --> SR<br>TGN: (IGN2) --> IGN<br>0 --> IGN2, RLB, RLAX, TLF | THE ADDRESS SPECIFIED IN X IS LOADED INTO PL. IF IN SR0 PU WILL BE LOADED WITH THE SR1 BLOCK ADDRESS. TRA 1 NOT PRECEDED BY TL WILL LOAD X INTO PL AND PU WILL REMAIN UNCHANGED. IF THE ATP FLAG HAS BEEN SET (ATPF = 1) THEN THE ADDRESS TO WHICH THE PROGRAM WILL TRANSFER TO IS MODIFIED BY PERFORMING A LOGICAL OR OF THE LAST 4 BITS OF X WITH THE 4 BITS OF THE ACCUMULATOR. THIS RESULT TOGETHER WITH THE FIRST 2 BITS OF X FORMS THE ADDRESS TO WHICH CONTROL WILL BE TRANSFERRED. THE OCCURENCE OF AN EXECUTED TRA WILL RESET THE ATP FLAG. |
| RET X | ¬TGN: SBL --> SBL --> SAL --> PL<br>SBU --> SBU --> SAU --> PU<br>1 --> TGN<br>0 --> TGN2, RLB, RLAX, TLF,SR<br>X: 1 --> IGN2<br>TGN: (IGN2) --> IGN<br>0 --> TGN2, RLB, RLAX, TLF | THE SUBROUTINE FLAG IS RESET TO 0 AND THE "SB" REGISTER IS PUSHED UP TO THE "SA" REGISTER, WHICH IS PUSHED UP TO THE P REGISTER. IF X=1 THE ROM WORD AT THE RETURN ADDRESS WILL BE IGNORED. |
| READ 0 | ¬TGN: (KB) --> A<br>0 --> TGN2, RLB, RLAX, TLF<br>TGN: (IGN2) --> IGN<br>0 --> TGN2, RLB, RLAX, TLF | THE INFORMATION ON THE FOUR KEYBOARD RETURN LINES IS COPIED INTO THE ACCUMULATOR. |
| TKB | ¬TGN: (¬(KB1 & KB2 & KB3 & KB4)): 1 --> IGN<br>0 --> TGN2, RLB, RLAX, TLF<br>TGN: (IGN2) --> IGN | THE NEXT INSTRUCTION IS IGNORED IF AT LEAST ONE KEY IS DOWN (AT GROUND), BY OPTION THE STATE OF DIN1 CAN BE INCLUDED IN THE KEY |

TABLE II

| MNEMONIC | ACTION | DESCRIPTION |
|---|---|---|
| | 0 --> TGN2, RLB, RLAX, TLF | TEST. |
| BTA | ¬TGN: ¬ATPF: (BL) --> A<br>0 --> IGN2, RLB, RLAX, TLF<br>ATPF: 15 --> A<br>15 --> BL<br>0 --> IGN2, RLB, RLAX, TLF<br>TGN: (IGN2) --> IGN<br>0 --> TGN2, RLB, RLAX, TLF | COPIES THE 4 LSB OF THE RAM ADDRESS REGISTER INTO THE ACCUMULATOR. IF THE ATP FLAG HAS BEEN SET (ATPF = 1) THEN 15 WILL UNCONDITIONALLY BE LOADED INTO BOTH THE ACCUMULATOR AND BL. THE STATE OF THE ATP FLAG WILL NOT BE AFFECTED BY THIS INSTRUCTION. |
| TDIN 0 | ¬TGN: (DIN0=VDD): 1 --> IGN<br>0 --> TGN2, RLB, RLAX, TLF<br>TGN: (IGN2) --> IGN<br>0 --> TGN2, RLB, RLAX, TLF | THE NEXT ROM WORD WILL BE IGNORED IF DISCRETE INPUT 0 IS AT VDD . |
| TDIN 1 | ¬TGN: (DIN0=VDD): 1 --> IGN<br>0 --> TGN2, RLB, RLAX, TLF<br>TGN: (IGN2) --> IGN<br>0 --> TGN2, RLB, RLAX, TLF | THE NEXT ROM WORD WILL BE IGNORED IF DISCRETE INPUT 1 IS AT VDD . |
| ATB | ¬TGN: ¬ATPF: (A) --> BL<br>0 --> IGN2, RLB, RLAX, TLF<br>ATPF: 0 --> BL<br>0 --> IGN2, RLB, RLAX, TLF<br>TGN: (IGN2) --> IGN<br>0 --> TGN2, RLB, RLAX, TLF | COPIES THE ACCUMULATOR INTO THE 4 LSB OF THE RAM ADDRESS REGISTER. IF THE ATP FLAG HAS BEEN SET (ATPF = 1) THEN ZERO WILL UNCONDITIONALLY BE LOADED INTO BL. THE STATE OF THE ATP FLAG WILL NOT BE AFFECTED BY THIS INSTRUCTION. |
| BTS | ¬TGN (BL) --> STROBES<br>0 --> TGN2, RLB, RLAX, TLF<br>TGN: (IGN2) --> IGN<br>0 --> TGN2, RLB, RLAX, TLF | THE LOWER FOUR BITS OF THE B REGISTER SELECT THE STROBE TO BE ACTIVATED. BTS IS A THREE BIT TIME OPERATION:<br>1) THE SEGMENT DRIVERS ARE "ZEROED".<br>2) THE STROBE DRIVERS ARE "ZEROED".<br>3) THE STROBE SELECTED BY BL IS LOADED.<br>THE ROM WORD FOLLOWING BTS MUST NOT MODIFY BL. B7 MUST BE 0 DURING THE ENTIRE THREE BIT TIME OPERATION OF BTS. |
| ATC X | ¬TGN: (A) --> DISPLAY<br>0 --> IGN2, RLB, RLAX, TLF | THE ACCUMULATOR AND THE C FLIP-FLOP ARE OUTPUT TO THE DISPLAY DRIVERS. |

TABLE II

| MNEMONIC | ACTION | DESCRIPTION |
|---|---|---|
| | IGN: (IGN2) --> IGN | X=0 OUTPUT SEGMENT DATA SERIAL. |
| | 0 --> IGN2, RLB, RLAX, TLF | X=1 OUTPUT BINARY DATA SERIAL. |
| | | X=2 OUTPUT SEGMENT DATA PARALLEL. |
| | | X=3 OUTPUT BINARY DATA PARALLEL. |

The program is able to directly address only certain locations in any register. The easily addressable standard locations are, 0, 7, 8, 9, 10 and 11. Any other locations, for example 1 through 6, are addressed by special instructions within the program.

Each individual register and the use or meaning of the contents of that register are now described beginning with register R. Words R0 through R7 represent the results of the random number generation. After each random number multiply process, a new value appears in this register with R7 representing the tens digit and R6 representing the units digit of a possible new card, that is, new random number to be considered as a possible new card. R8, referred to as PAD, represents a scratchpad location used during the determination of the random number. R9, called NEW, is a location of the new or recently generated random number representing a potential card which can be dealt to one of the hands. R10 contains several flags. Bit location 8, (the bits are numbered in binary sequence from the right to left—1, 2, 4 and 8), contains flag HS standing for hand start. The next three bits are the DS counter, DS3, DS2 and DS1. They are used in counting the first four cards dealt, two to a player and two to dealer, and they are set in certain modes after the first four cards are dealt.

DS1 is also used in directing cards during the play of the game, either to dealer's hand or to player's hand. R11 contains additional flags. Flag PR represents pool ready. A ONE here indicates that a stake has been established and entered into the memory. H0 stands for hand over and G when set, represents that the game mode is in operation as opposed to the calculator mode.

Register H contains the cards of both the dealer's hand and the player's hand. The loading of this register is accomplished from opposite ends, depending upon whether the player's hand is being dealt, in which case dealing starts at H11 and goes up, or the dealer's hand is being dealt where dealing starts at H0 and goes down. There is no firm boundary between player's hand and dealer's hand. The only requirement is that the total of he cards in the two hands not exceed the twelve allowable positions. If this should happen, the routine exits to RESET and the hand is canceled.

Register S contains, in location zero through five, the totals and flags for the three possible hands, the dealer's hand, the player's hand and the split hand. Since the format is the same for all three hands, only one will be discussed.

The first four bits of the total are located in word S0. At S1, bit 1 represents a dealer Ace and if this bit is a ONE, the hand contains an Ace. Bit 2 represents a total value of 16 accumulated in the hand. Bit 4, implies the hand has busted. In the case of the split hand in S5, bit 3 represents the completion of this split hand, and is designated H2C, hand 2 complete. S7 contains flags relating to a blackjack condition. Bit 1 of S7 contains accept insurance. This bit is on when insurance could validly be accepted, or in other words, when the dealer is showing an Ace and no other operation has taken place. Bit 2 is dealer blackjack, implying that after a test was made of the dealer's hand it did indeed produce a blackjack. Bit 4 is INS, for insurance, implying that the player did, in fact, select the insurance option by depressing the insurance key in the proper sequence. Bit 8, PBJ is player blackjack, indicating that examination of the player's hand resulted in the determination of a blackjack condition. S8 contains several more flags. Bit 1 is split, implying that the player has chosen the option of splitting his hand. Bit 2, SPA, is a flag indicating the available option to split Aces, i.e., that there were two cards of the same value dealt to the player and that the cards are both Aces. Bit 4 is SP, standing for split pair, implying that the two first cards dealt to the player were a pair. Bit 8 is double, implying that the player has chosen the option of doubling his hand, that is, doubling his bet and receiving one additional card. The other flag involving the blackjack routine is S11 bit 1. This is TBJ, standing for test blackjack. This bit is involved in the TBLJK routine during the processing of the first four cards dealt, to determine whether any blackjacks exist. Once this flag is set, the test blackjack routine will not be entered again during any subsequent dealing of cards in the same hand. The four bits of word S9 and the two least significant bits of word S10 are used to keep track of the total number of cards that have been dealt. The two most significant bits of register S words 10 and 11, are the locations that are used to represent four of the cards of a deck of 52 cards. All of the remaining card locations are in register C.

Register T is used to keep track of the total of the player's stake. This involves location T0 through T9 where T8 contains the sign of the number, and location T9 contains the exponent or the decimal point setting of the number. T10 contains the following flags: bit 1 contains a flag M indicating multiply or divide, a ONE being used in the multiply routine to signify multiply and a ZERO signifying divide. Bit 4, CR, stands for card required and is used during the random number generation to determine whether cards should be generated or just an updating of the random number. Bit 8 contains flag RN, random number, implying that a processing of the random number is under way. RN is used in the multiply routine to truncate the multiply operation in the proper manner to generate the random number. Word T 11, bit 1 contains the key PM code, plus or minus. PM is used in the calculator mode to determine whether the operation to be performed is add or subtract. Bit 2 is the K flag. If K equals ZERO, the display routine uses this flag and displays the contents of the K register. K equal to ONE displays the cards involved in the play of the hand. Bit 4 MD, multiply or divide, is used during the multiply routine in the calculator. Bit 8, Q, is a flag used in the calculator routine to set a new constant for use in the four-function mode.

Register W is used in the multiply and the divide routines of the calculator, but in the operation of the game it contains the value of the bet. Words 0 through 7 represent the numerical value. Word 8 is the sign and word 9 is the exponent or the decimal point location. Word 10 contains the last strobe LS and is used during the display and keyboard read routine. Word 11 contains the following flags: bit 1 is overflow, OF, implying that too many numbers have been entered or an overflow condition exists as a result of an operation. Bit 2 is a flag called R, which is used during the random number generation. As long as R is set, after each strobe cycle the random number generation is carried out and a new strobe cycle is started. This results in a flashing of the display representing a shuffle condition. Bit 4, D, stands for decimal which implies that the decimal key has been depressed during this entry and there is a decimal involved in the number. Bit 8 contains N, which implies that the last key entered was a number key and no function keys have been entered in the interim.

In register Z, words 0 through 9, are processing and working registers only. Z10 contains flags used in decoding the keys. Flag V, indicates that this is a first key depression of a strobe cycle. Flag U, in location 2, indicates that a key has been detected down during the present strobe cycle. Flag OF is a key decode flag and is used to separate the various key groupings for later decode. Flag DI indicates that the key was entered through the discrete input DIN1 line used as a keyboard line and is used for decoding the key. Z11 is a scratchpad used to store a delay number in the dealing of the cards to add to the realism of the dealing operation. Register K, words 0 through 9, comprise a keyboard register and are also the registers whose contents are displayed when the K flag equals ZERO. Locations 10 and 11 are used during the multiply and divide operations as scratchpad locations only and are also used during the card dealing time to delay that process.

GAME OPERATION

Figure 5A:
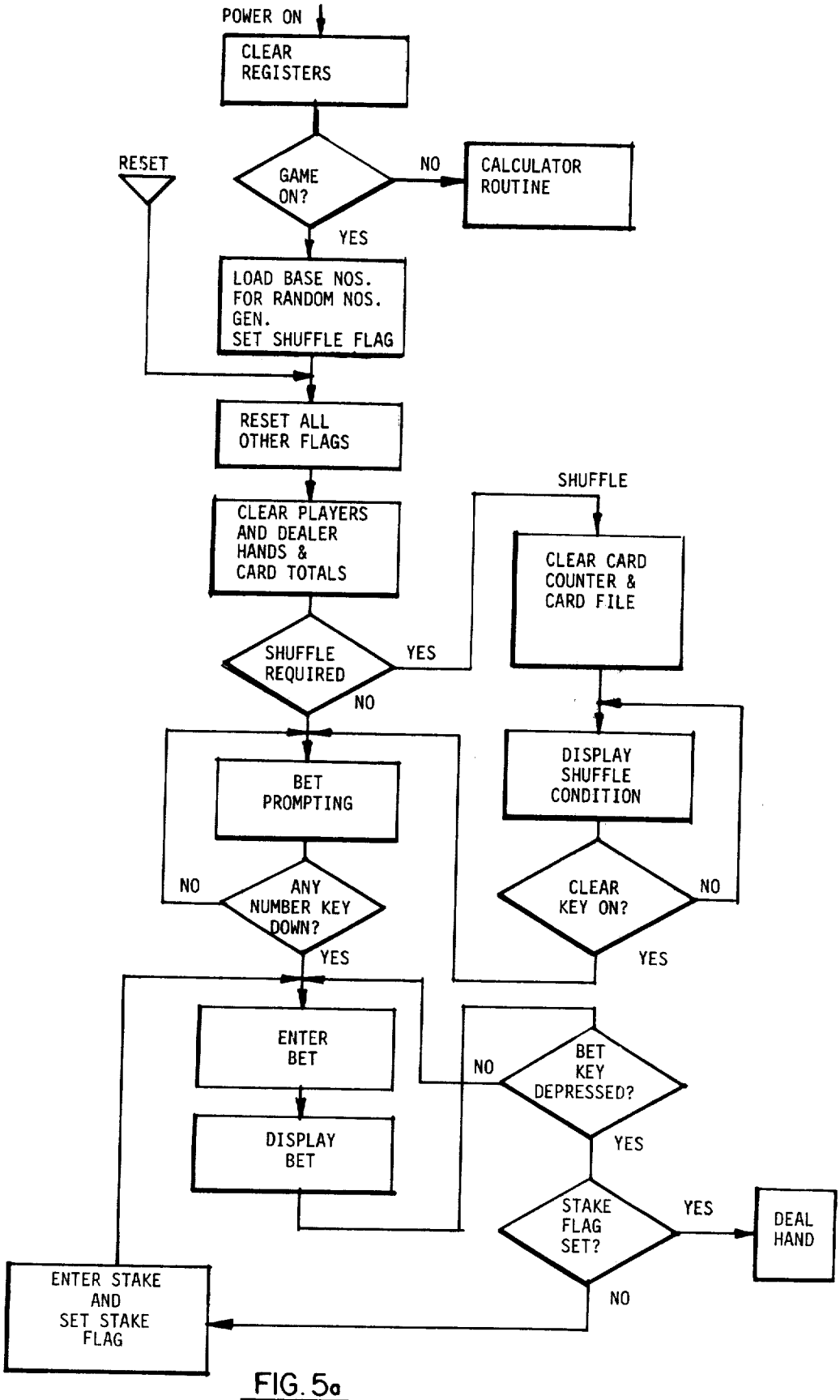
FIGS. 5*a* through 30 are flow chart drawings which illustrate program routines carried out to perform the card playing operations of the invention.
Figure 5B:
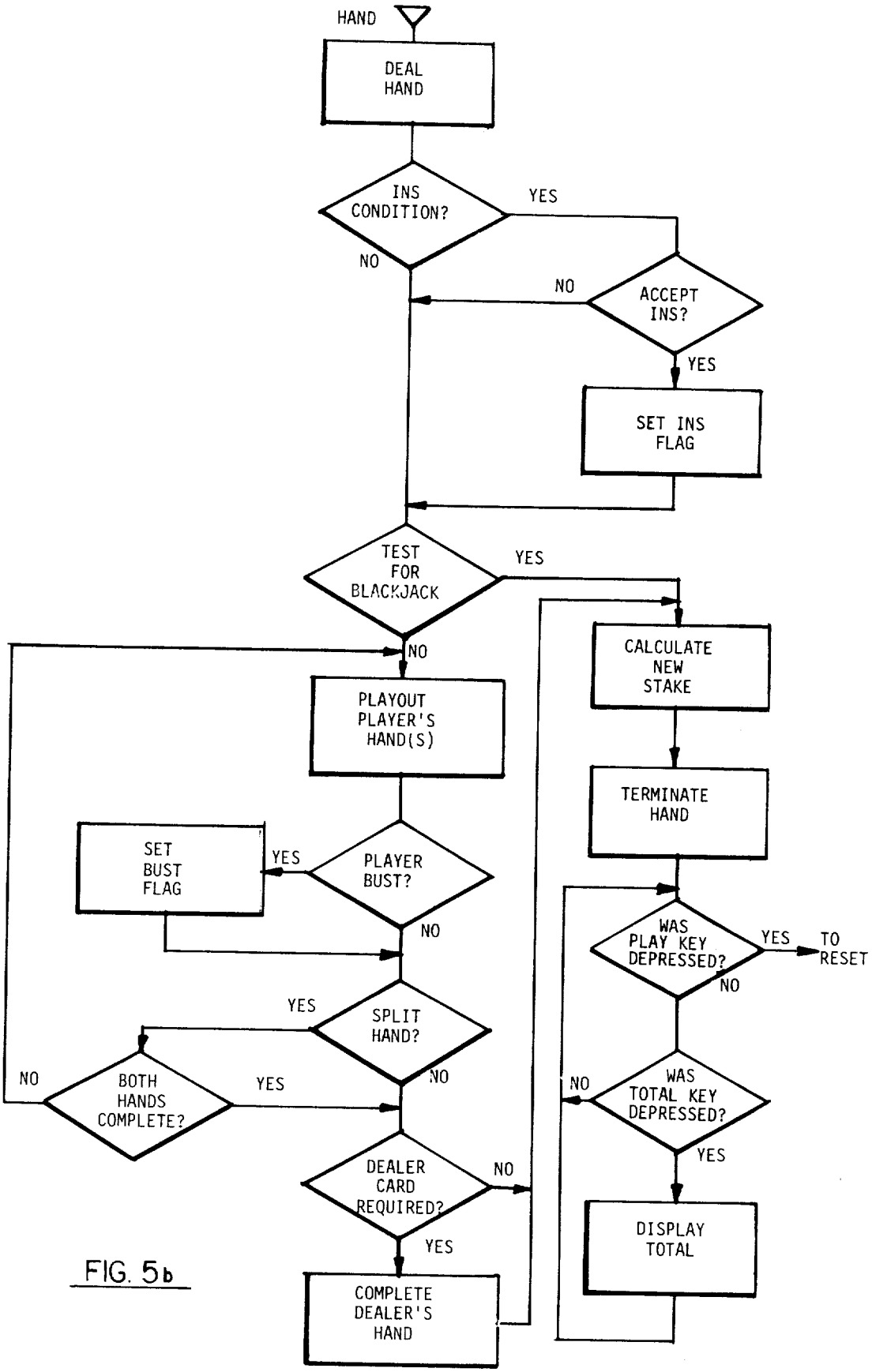

An understanding of the way in which the rules of the game of blackjack are accommodated by the invention, will be more clearly understood by examination of FIGS. 5*a* and 5*b* which are overview flow charts of the general functions performed in the play of the game of blackjack utilizing the invention. More detailed flow charts of specific program routines are provided in conjunction with descriptions of the program instruction sequence utilized in the game process.

Referring now to FIG. 5*a*, starting at the top thereof, there is shown the step of applying power to the blackjack game. In response thereto, all of the registers in programmable chip 30 (FIG. 3) are cleared and a decision is made regarding whether or not the game mode is on. If the game mode is not on, the program proceeds to the calculator routines wherein the invention functions as a common 4-function calculator. On the other hand, if the game mode switch 14 is in the game position, the next steps in the process of performing the game functions are the loading of base numbers that are used for the generation of random numbers and the setting of shuffle flag. All other flags in programmable chip 30 are reset and the player and dealer hands and card totals in registers in the random access memory are cleared.

Following the clearing of registers containing card totals and hands, a decision is made regarding whether or not a shuffle is required. It will be recalled that if in a previous hand, the thirty-eighth card of the deck was used, the blackjack game automatically "reshuffles" the deck. If such shuffling is indicated, the routine proceeds to the operation of clearing the card file, displaying the shuffle condition to the player and awaiting the depression of the CLEAR key to terminate the shuffling condition.

Once the CLEAR key is depressed, the program returns to the bet prompting step. If no shuffling is required, the program proceeds immediately to the bet prompting step. In the bet prompting step, the display flashes a 0 and decimal point indicating to the player that it is the appropriate time for a bet to be placed. The programmable microprocessor chip, in effect, awaits the depression of a number key which can be associated with the amount the player wishes to bet in the upcoming hand. Once the bet is entered, the Bet is displayed and the program proceeds to determine whether or not the bet key was depressed which indicates that the numbers entered constitute the entire bet. If Bet key has still not been depressed, the program returns to the enter bet step to enter additional numbers in the bet. Once the Bet key is depressed, the program then checks for a set stake flag. If the stake flag has not been set, this indicates that it is the player's stake that has been entered and not the bet, because the keys involved in entering the game stake are the same as those involved in entering a bet for each hand. The stake flag is set, the stake is entered and the program returns to the end of bet step so that the bet on that particular hand may be entered. Once this process is complete, and the stake flag is set, the program then exits to the DEAL HAND operation which is represented generally by the flow chart of FIG. 5*b*.

DEAL HAND represents the computer operation associated with the dealing of the first four cards, two each to the player and the dealer. The numerous program steps associated with this operation are enumerated more specifically in the program listing of Table III and the associated routine flow charts of FIGS. 6 through 30. Once the first four cards of the hand are dealt, the program then tests for an insurance condition which occurs when the dealer's showing card or up card is an Ace. If the insurance condition exists, the next decision to be made is whether or not the player accepts insurance, which he indicates by depression of the INS key (accept) or STAND key (decline). If he accepts insurance, the INS flag is set to allow proper accounting of the stake. After processing of the insurance decision the program then tests for blackjack.

If neither the player nor the dealer has blackjack, that is, an Ace and a 10(F), the player's hand is then played out. In other words, the player may then proceed to have additional cards dealt to his hand in an attempt to come as close as possible to or equal to a card total of 21 without exceeding a card total of 21. Once this is completed, the program tests for a bust condition, that is, for a player card value greater than 21. If the player's hand is in a bust condition, the bust flag is set for later use. In either case, the next step is a test for a split hand condition.

A split hand condition occurs when the player is dealt two cards of equal value in the original deal of the first four cards and chooses to split the pair and play as if he has two seperate hands. Accordingly, if a test for split hand indicates that indeed there is a split hand, the program branches to test whether or not both hands of the split hand have been completed. If both hands have not been completed, the program returns to the playout of the player's hand operation so that the second of the two split hands may also be completed. In either case, the next operation in the program is to determine whether or not any dealer cards are required. It will be recalled that in the usual rules of the game of blackjack, the dealer must stand pat if the value of his card total is 17 or greater, and he must continue to accept additional cards if the value of his cards is less than 17. In either case, after the dealer's hand is completed or if originally the test for blackjack indicated that there was a blackjack condition ending the game, the next step in the game operation is the calculation of the new stake. This calculation will depend upon the outcome of the hand, namely, whether the player or the dealer won the hand and whether or not the betting amount originally entered by the player was altered as a result of a split hand, insurance accepted, or doubling condition, each of which will be discussed in more detail below. Once the calculation of the new stake is completed, the hand is terminated and the program awaits depression of the TOTAL key to display the new stake value, or the PLAY key to initiate a new hand by returning to RESET.

It will be understood that the flow charts in FIGS. 5*a* and 5*b* provide a general overview of the game operation. More detailed descriptions of the various routines associated with the play of the game are contained within the program listing of Table III and the flow chart diagrams of FIGS. 6 through 30.

DESCRIPTION OF PROGRAM LISTING

The program listing comprising Table III includes all of the instructions and routines used to play the blackjack game in a preferred embodiment of the invention. Together with flow charts of FIG'S. 5*a* to 30, the RAM map of FIG. 4 and the block diagrams of FIG'S. 2 and 3, the program listing enables one of ordinary skill in the art to make and use the invention.

Page 1 of the program listing relates to the labeling of the RAM addresses. Rather than list the actual RAM locations, for example, 3, 10, a label, such as DS, is assigned to them. The program converts labels such as label DS into the corresponding RAM location (3, 10) for use by the blackjack program. For the programming function, a RAM location is simply referred to by its label which points to the proper RAM location.

Pages 2 through 49 of the program listing are organized in the following manner. RAM addresses corresponding to each instruction are listed in the column at the left. It will be recalled that there are 24 pages of RAM with each page having 64 words of storage. The pages are in sequential order with addresses 0 through 63 located on page 0 and addresses 100 through 163 on page 1 and so on. The programs for all of the 24 pages of RAM are described in the listing.

The next column to the right indicates the assembly language that is used in loading the program into the ROM and is a code representing that operation. The third column from the left is the mnemonic associated with the operation and the following column is also part of the instruction which initiates an operation. For example, the first entry on page 2 of the listing, namely LB 2, 10, is an instruction which loads the B register with address 2, 10.

The statement number is simply a convenience in cross-referencing the program and lists the statements in sequence through the end of the prgram. The next column provides for labeling routines contained in the program. A label is usually used to refer to a series of instructions comprising a routine if that routine is addressed by another part of the program. The next column is the mnemonic of the function performed by the instruction and in general is identical to the mnemonic mentioned earlier. The next column includes labels and other programming shortcuts for indirect addressing, so that when a program is written the numbers need not be changed every time a location changes. This allows a program to link one of its parts to another by looking for the appropriate label, rather than a program location. The last column consists of notes regarding the program operation and has no function other than to illustrate what is being done in the routine and to explain some of the operations in more easily understood language. The cross-reference table attached to the program listing is used to determine the location of any programming operation that has a name associated with it. For example, looking at page 1 of the cross-reference table, the first of the items called out is the program ADACED or add Ace to dealer's hand. The information given is that ADACED is located at statement 1100 and is called by statement 622. This allows one to examine the manner in which the various routines are used and if a routine is changed it allows the programmer to examine each using routine to determine the effect of that change.

THE PROGRAM ROUTINES

The Hand Routine

Figure 6:
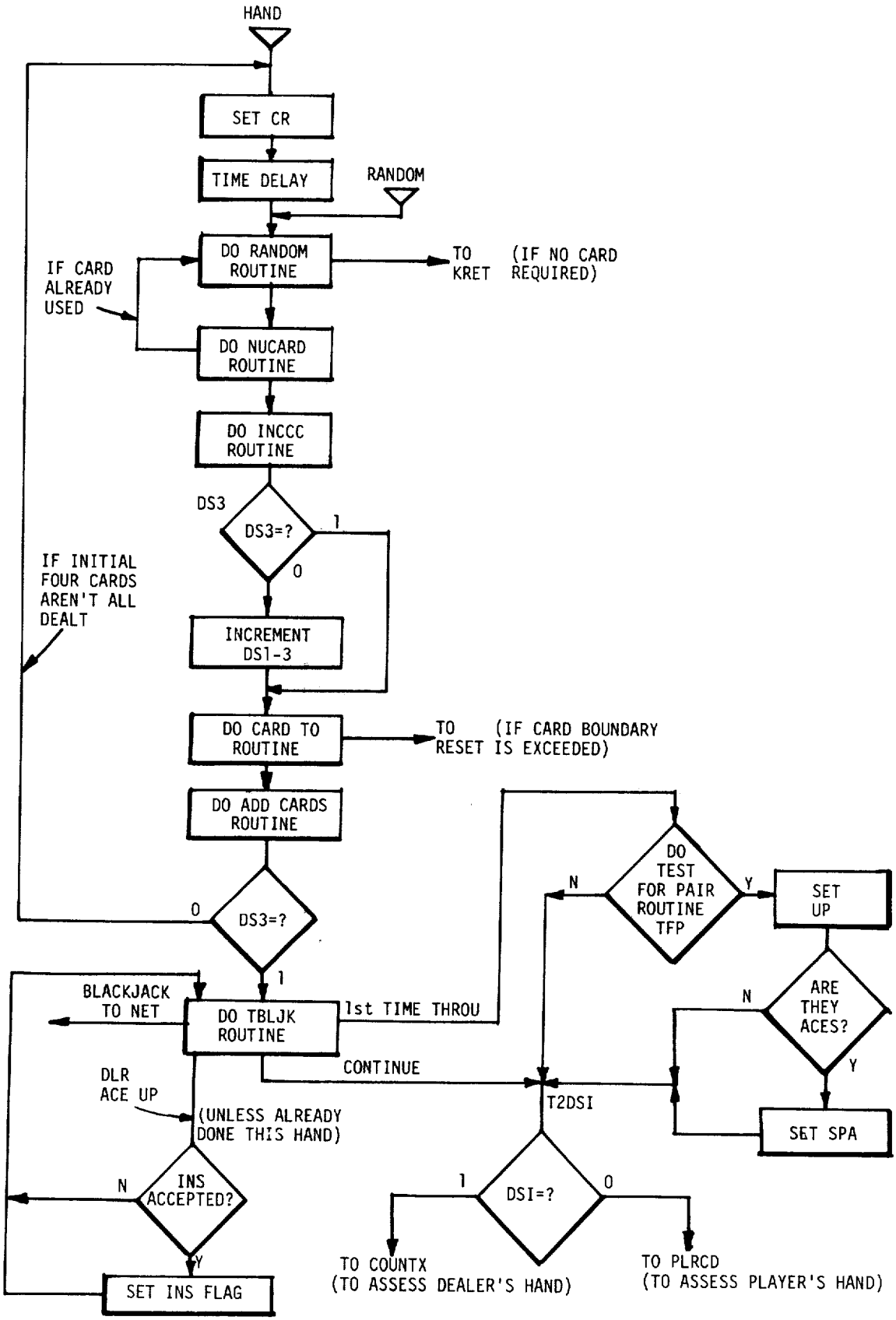

The HAND routine of FIG. 6 is used to deal each card of a hand. As shown at the top of FIG. 6 the first step in the HAND routine is to set the card required flag CR. Then a time delay is provided to add realism to the card dealing process. Next the RANDOM routine is performed (see FIG. 7). The RANDOM routine generates a random number which may or may not correspond to an acceptable code number for one of the 52 cards in a standard playing card deck. The RANDOM routine returns to key return KRET if no card is required, indicating entry from a point other than through the HAND routine. However, if a card is required, the random number is assessed by the NU CARD routine (see FIGS. 8*a* and 8*b*) to determine whether or not it corresponds to one of the 52 card codes. It also determines whether or not this code (card) has already been use in the play of the game since the last shuffling of the deck. If that card has already been used, the NU CARD routine returns to the RANDOM routine for the generation of a new random number.

TABLE III

| ADDR. | CODE | STMT. | LABEL |
|---|---|---|---|
| | | 3,10 | DS |
| | | 3,9 | NFW |
| | | 3,8 | PAD |
| | | 3,10 | MC |
| | | 2,11 | ND |
| | | 3,11 | B |
| | | 3,11 | H |
| | | 1,8 | SF |
| | | 1,7 | BJI |
| | | 2,10 | LS |
| | | 1,11 | VD |
| | | 1,10 | KI |

TABLE III

| ADDR. | CODE | | | STMT. | | | | | |
|---|---|---|---|---|---|---|---|---|---|
| | | | | | | NAME | A48(8) | | |
| | | | | | | PUNCHT | 5/16/77 | B/J GAME | |
| | | | | | | ORG | 000 | | |
| 0 | 1A | LB | 2,10 | 0 | GDISP | LB | LS | | 0 |
| 32 | 41 | LAX | 1, 0 | 1 | | LAX | 1 | | 1 |
| 16 | 7F | TAM | 0, 0 | 2 | | TAM | | | 2 |
| 8 | CF | TRA | 1,48 | 3 | | TRA | 1,GD1 | | 3 |
| 4 | A9 | TRA | 0,22 | 4 | | TRA | 0,TDS1 | LS = 1 | 4 |
| 2 | 29 | TM | 2, 0 | 5 | | TM | 2 | TDS2 | 5 |
| 33 | FA | TRA | 1, 5 | 6 | | TRA | 1,TBLNK | | 6 |
| 48 | 2C | SB7 | 0, 0 | 7 | GD1 | SB7 | | | 7 |
| 24 | 0A | LB | 2, 0 | 8 | | LB | 2,0 | | 8 |
| 12 | 79 | HTA | 0, 0 | 9 | | HTA | | | 9 |
| 6 | 76 | ATB | 0, 0 | 10 | | ATB | | PT TO CARD | 10 |
| 35 | 48 | LAX | 8, 0 | 11 | | LAX | 8 | | 11 |
| 17 | 75 | ATH | 0, 0 | 12 | | ATH | | | 12 |
| 40 | 4A | LAX | 10, 0 | 13 | | LAX | 10 | | 13 |
| 20 | 7F | TAM | 0, 0 | 14 | | TAM | | | 14 |
| 10 | CE | TRA | 1,49 | 15 | | TRA | 1,GD2 | | 15 |
| 37 | 4D | LAX | 13, 0 | 16 | | LAX | 13 | | 16 |
| 50 | 48 | LAX | 8, 0 | 17 | IS1 | LAX | 8 | | 17 |
| 57 | 2D | RSB7 | 0, 0 | 18 | | RSB7 | | | 18 |
| 60 | 07 | BTS | 0, 0 | 19 | | BTS | | | 19 |
| 30 | B0 | TRA | 0,15 | 20 | | TRA | 0,3BD | | 20 |
| 47 | 73 | ATD | 3, 0 | 21 | | ATD | 3 | | 21 |
| 23 | 3E | TL | 1, 0 | 22 | TKS1 | TL | | | 22 |
| 11 | FF | TRA | 1, 0 | 23 | | TRA | 1,KS1 | | 23 |
| 5 | 76 | ATB | 0, 0 | 24 | TBLNK | ATB | | | 24 |
| 34 | EC | TRA | 1,19 | 25 | | TRA | 1,BLANK | DSPLY BLANK | 25 |
| 49 | 50 | LDA | 0, 0 | 26 | GD2 | LDA | 0 | | 26 |
| 56 | 6E | ADX | 14, 0 | 27 | | ADX | 14 | | 27 |
| 28 | D2 | TRA | 1,45 | 28 | | TRA | 1,GD4 | | 28 |
| 14 | 61 | ADX | 1, 0 | 29 | | ADX | 1 | | 29 |
| 39 | CD | TRA | 1,50 | 30 | | TRA | 1,IS1 | | 30 |
| 19 | 4C | LAX | 12, 0 | 31 | BLANK | LAX | 12 | | 31 |
| 9 | 4D | LAX | 13, 0 | 32 | MIN | LAX | 13 | | 32 |
| 36 | 2D | RSB7 | 0, 0 | 33 | GD5 | RSB7 | | | 33 |

TABLE III

| ADDR. | | CODE | | STMT. | | | | | |
|---|---|---|---|---|---|---|---|---|---|
| 18 | 07 | BTS | 0, 0 | 34 | | BTS | | | 34 |
| 41 | 50 | TRA | 0,15 | 35 | | TRA | 0,3BD | | 35 |
| 52 | 72 | ATD | 2, 0 | 36 | | ATD | 2 | | 36 |
| 26 | E8 | TRA | 1,23 | 37 | | TRA | 1,TKS1 | | 37 |
| 45 | 50 | LDA | 0, 0 | 38 | GD4 | LDA | 0 | | 38 |
| 54 | D8 | TRA | 1,36 | 39 | | TRA | 1,GD5 | | 39 |
| 59 | 14 | LB | 0, 9 | 40 | DISPKC | LB | 0,9 | KE | 40 |
| 29 | 7F | TAM | 0, 0 | 41 | | TAM | | | 41 |
| 46 | E4 | TRA | 1,27 | 42 | | TRA | 1,*+2 | | 42 |
| 55 | 06 | SC | 0, 0 | 43 | | SC | | | 43 |
| 27 | 68 | ADX | 8, 0 | 44 | | ADX | 8 | T FOR STROBE 8 | 44 |
| 13 | EA | TRA | 1,21 | 45 | | TRA | 1,IS8 | | 45 |
| 38 | 61 | ADX | 1, 0 | 46 | | ADX | 1 | T FOR STROBE 7 | 46 |
| 51 | C2 | TRA | 1,61 | 47 | | TRA | 1,IS7 | | 47 |
| 25 | 08 | LB | 0, 0 | 48 | KD2 | LB | 0,0 | | 48 |
| 44 | 79 | HTA | 0, 0 | 49 | | HTA | | | 49 |
| 22 | 76 | ATB | 0, 0 | 50 | | ATB | | | 50 |
| 43 | D2 | TRA | 1,45 | 51 | | TRA | 1,GD4 | | 51 |
| 21 | 10 | LB | 0, 8 | 52 | IS8 | LB | 0,8 | | 52 |
| 42 | 28 | TM | 8, 0 | 53 | | TM | 8 | T MINUS | 53 |
| 53 | F6 | TRA | 1, 9 | 54 | | TRA | 1,MIN | | 54 |
| 58 | EC | TRA | 1,19 | 55 | | TRA | 1,BLANK | | 55 |
| 61 | 0C | LB | 0, 7 | 56 | IS7 | LB | 0,7 | | 56 |
| 62 | 50 | LDA | 0, 0 | 57 | | LDA | 0 | | 57 |
| 63 | 77 | COMP | 0, 0 | 58 | | COMP | | | 58 |
| 31 | 61 | ADX | 1, 0 | 59 | | ADX | 1 | T FOR 0 | 59 |
| 15 | 02 | TC | 0, 0 | 60 | | TC | | | 60 |
| 7 | D2 | TRA | 1,45 | 61 | | TRA | 1,GD4 | | 61 |
| 3 | EC | TRA | 1,19 | 62 | | TRA | 1,BLANK | | 62 |

TABLE III

| ADDR. | CODE | | | STMT. | | | | | |
|---|---|---|---|---|---|---|---|---|---|
| | | | | | | ORG | 100 | | |
| 100 | 01 | TKB | 0, 0 | 100 | KS1 | TKB | | | 114 |
| 132 | F7 | TRA | 1, 8 | 101 | | TRA | 1,KS2 | | 115 |
| 116 | E2 | TRA | 1,29 | 102 | | TRA | 1,KS5 | | |
| 108 | A1 | TRA | 0,30 | 103 | KS2 | TRA | 0,LLS | | |
| 104 | 6F | ADX | 15, 0 | 104 | | ADX | 15 | | 119 |
| 102 | C6 | TRA | 1,57 | 105 | | TRA | 1,KS4 | | 120 |
| 133 | 19 | LB | 1,10 | 106 | KS3 | LB | KI | | 121 |
| 148 | 29 | TM | 2, 0 | 107 | | TM | 2 | T U | 122 |
| 124 | F9 | TRA | 1, 6 | 108 | | TRA | 1,*+2 | | 123 |
| 112 | 24 | RSM | 1, 0 | 109 | | RSM | 1 | R V | 124 |
| 106 | 25 | RSM | 2, 0 | 110 | | RSM | 2 | R U | 125 |
| 135 | 1E | LB | 2,11 | 111 | | LB | ND | | 126 |
| 117 | 29 | TM | 2, 0 | 112 | | TM | 2 | T R | 127 |
| 140 | D2 | TRA | 1,45 | 113 | | TRA | 1,TRAND | | 128 |
| 120 | 1F | LB | 3,11 | 114 | RRET | LB | B | | 129 |
| 110 | 29 | TM | 2, 0 | 115 | | TM | 2 | T K | 130 |
| 137 | 48 | LAX | 11, 0 | 116 | | LAX | 11 | | 131 |
| 150 | 48 | LAX | 8, 0 | 117 | | LAX | 8 | | 132 |
| 157 | 1A | LB | 2,10 | 118 | KS4 | LB | LS | | 133 |
| 160 | 50 | EXC | 1, 0 | 119 | | EXC | 1,0 | | 134 |
| 130 | 03 | TDIN | 0, 0 | 120 | | TDIN | 0 | *** NO DELAY IF DIN 0 = GRD | |
| 147 | DD | TRA | 1,34 | 121 | | TRA | 1,KRET | | |
| 123 | 2A | TM | 4, 0 | 122 | | TM | 4 | T CR | 135 |
| 111 | 3D | TL | 2, 0 | 123 | | TL | | | 136 |
| 105 | C2 | TRA | 1,61 | 124 | | TRA | 1,TRDLY | | 137 |
| 134 | 2D | RSB7 | 0, 0 | 125 | KRET | RSB7 | | | 100 |
| 149 | 05 | RSC | 0, 0 | 126 | | RSC | | | 101 |
| 156 | A1 | TRA | 0,30 | 127 | | TRA | 0,LLS | | |
| 128 | 75 | ATH | 0, 0 | 128 | | ATH | | LS TO H | 104 |
| 114 | 1F | LB | 3,11 | 129 | | LB | B | | 105 |
| 139 | 29 | TM | 2, 0 | 130 | | TM | 2 | T K | 106 |
| 119 | 3F | TL | 0, 0 | 131 | | TL | | | 107 |
| 100 | FF | TRA | 1, 0 | 132 | | TRA | 1,GDISP | | 108 |
| 136 | 1E | LB | 2,11 | 133 | DISK | LB | ND | | 109 |
| 118 | 25 | TM | 1, 0 | 134 | | TM | 1 | T OF | 110 |
| 141 | 06 | SC | 0, 0 | 135 | | SC | | | 111 |

TABLE III

| ADDR. | CODE | | | STMT. | | | | | |
|---|---|---|---|---|---|---|---|---|---|
| 152 | 3F | TL | 0, 0 | 136 | | TL | | | 112 |
| 126 | C4 | TRA | 1,59 | 137 | | TRA | 1,DISPKC | | 113 |
| 145 | 00 | NOP | 0, 0 | 138 | TRAND | NOP | | | 139 |
| 154 | 38 | TL | 4, 0 | 139 | | TL | | | 140 |
| 159 | D7 | TRA | 1,40 | 140 | | TRA | 1,RANDOM | | 141 |
| 129 | 19 | LB | 1,10 | 141 | KS5 | LB | KI | | 142 |
| 146 | 21 | SM | 2, 0 | 142 | | SM | 2 | S U | 143 |
| 155 | 28 | TM | 1, 0 | 143 | | TM | 1 | T V | 144 |
| 127 | F7 | TRA | 1, 8 | 144 | | TRA | 1,KS2 | | 145 |
| 113 | 43 | LAX | 3, 0 | 145 | | LAX | 3 | | 146 |
| 138 | 5E | EXC | 2, 0 | 146 | | EXC | 2,0 | KI = 0 0 1 1 | 147 |
| 151 | 2A | TM | 4, 0 | 147 | | TM | 4 | T CR | 148 |
| 125 | F7 | TRA | 1, 8 | 148 | | TRA | 1,KS2 | | 149 |
| 144 | 07 | BTS | 0, 0 | 149 | | BTS | | 0 SEGMENTS | 150 |
| 122 | A1 | TRA | 0,30 | 150 | | TRA | 0,LLS | | 151 |
| 143 | 76 | ATB | 0, 0 | 151 | | ATB | | | 152 |
| 121 | 07 | BTS | 0, 0 | 152 | | BTS | | OUTPUT LS | 153 |
| 142 | 03 | TDIN | 0, 0 | 153 | | TDIN | 0 | | 154 |
| 153 | C1 | TRA | 1,62 | 154 | | TRA | 1,*+3 | | 155 |
| 158 | 37 | TL | 8, 0 | 155 | KEYDWN | TL | | | 156 |
| 161 | 95 | TRA | 0,42 | 156 | | TRA | 0,VDLY | | 157 |
| 162 | 19 | LB | 1,10 | 157 | | LB | KI | | 158 |
| 163 | 01 | TKB | 0, 0 | 158 | | TKB | | | 159 |
| 131 | DD | TRA | 1,34 | 159 | | TRA | 1,KRET | | 160 |
| 115 | 00 | NOP | 0, 0 | 160 | | NOP | | | 161 |
| 107 | 3D | TL | 2, 0 | 161 | | TL | | | 162 |
| 103 | FF | TRA | 1, 0 | 162 | | TRA | 1,KDN1 | | 163 |

TABLE III

| ADDR. | CODE | | | STMT. | | | | | |
|---|---|---|---|---|---|---|---|---|---|
| | | | | | | ORG | 200 | | |
| 200 | 85 | TRA | 0,58 | 200 | PLAYK | TRA | 0,THO | | 200 |
| 232 | E3 | TRA | 1,28 | 201 | | TRA | 1,TKRETS | | 201 |
| 216 | 1F | LB | 3,11 | 202 | RESET | LB | 3,11 | | 202 |
| 208 | 26 | RSM | 4, 0 | 203 | | RSM | 4 | R HO | 203 |
| 204 | 1B | LB | 3,10 | 204 | | LB | 3,10 | | 204 |
| 202 | B8 | TRA | 0, 7 | 205 | | TRA | 0,ZRO | 0 DS | 205 |
| 233 | 1E | LB | 2,11 | 206 | | LB | 2,11 | | 206 |
| 248 | B6 | TRA | 0, 4 | 207 | | TRA | 0,0TO | 0 H | 207 |
| 224 | 2C | SB7 | 0, 0 | 208 | | SB7 | | | 208 |
| 212 | 1D | LB | 1,11 | 209 | | LB | 1,11 | | 209 |
| 206 | 24 | RSM | 1, 0 | 210 | | RSM | 1 | 0 TBJ | 210 |
| 235 | 11 | LB | 1, 8 | 211 | | LB | 1,8 | | 211 |
| 217 | B6 | TRA | 0, 4 | 212 | | TRA | 0,0TO | 0 S | 212 |
| 240 | 1E | LB | 2,11 | 213 | | LB | ND | | 213 |
| 220 | 21 | SM | 2, 0 | 214 | | SM | 2 | S R | 214 |
| 210 | 1F | LB | 3,11 | 215 | | LB | 3,11 | | 215 |
| 237 | B8 | TRA | 0, 7 | 216 | | TRA | 0,ZRO | R K | 216 |
| 250 | 2C | SB7 | 0, 0 | 217 | | SB7 | | | 217 |
| 257 | 19 | LB | 1,10 | 218 | | LB | 1,10 | | 218 |
| 260 | 29 | TM | 2, 0 | 219 | | TM | 2 | T 32 | 219 |
| 230 | E8 | TRA | 1,23 | 220 | | TRA | 1,TSHUF | | 220 |
| 247 | E3 | TRA | 1,28 | 221 | | TRA | 1,TKRETS | | 221 |
| 223 | 15 | LB | 1, 9 | 222 | TSHUF | LB | 1,9 | | 222 |
| 211 | 50 | LDA | 0, 0 | 223 | | LDA | 0 | | 223 |
| 205 | 1C | LB | 0,11 | 224 | | LB | 0,11 | | 224 |
| 234 | 00 | NOP | 0, 0 | 225 | | NOP | | | 225 |
| 249 | 3E | TL | 1, 0 | 226 | | TL | | | 226 |
| 256 | CA | TRA | 1,53 | 227 | | TRA | 1,TSHUFL | | 227 |
| 228 | 3F | TL | 1, 0 | 228 | TKRETS | TL | | | 228 |
| 214 | DD | TRA | 1,34 | 229 | | TRA | 1,KRET | | 229 |
| 239 | 26 | RSM | 4, 0 | 230 | TH2C | RSM | 4 | R SP | 230 |
| 219 | 45 | LAX | 5, 0 | 231 | | LAX | 5 | | 231 |
| 209 | 76 | ATB | 0, 0 | 232 | | ATB | | | 232 |
| 236 | 28 | TM | 8, 0 | 233 | | TM | 8 | | 233 |
| 218 | 37 | TL | 8, 0 | 234 | | TL | | | 234 |
| 241 | EE | TRA | 1,17 | 235 | | TRA | 1,TOCNTX | | 235 |

TABLE III

| ADDR. | CODE | | | STMT. | | | | | |
|---|---|---|---|---|---|---|---|---|---|
| 252 | 23 | SM | 8, 0 | 236 | | SM | 8 | S H2C | 236 |
| 226 | 42 | LAX | 2, 0 | 237 | | LAX | 2 | | 237 |
| 245 | 76 | ATB | 0, 0 | 238 | | ATB | | | 238 |
| 254 | 53 | LDA | 3, 0 | 239 | | LDA | 3 | | 239 |
| 259 | 75 | ATH | 0, 0 | 240 | | ATH | | | 240 |
| 229 | 3B | TL | 4, 0 | 241 | | TL | | | 241 |
| 246 | A0 | TRA | 0,31 | 242 | | TRA | 0,RLZ | | 242 |
| 255 | 12 | LB | 2, 8 | 243 | | LB | 2,8 | | 243 |
| 227 | 3B | TL | 4, 0 | 244 | | TL | | | 244 |
| 213 | A0 | TRA | 0,31 | 245 | | TRA | 0,RLZ | | 245 |
| 238 | 1E | LB | 2,11 | 246 | | LB | 2,11 | | 246 |
| 251 | 79 | HTA | 0, 0 | 247 | | HTA | | | 247 |
| 225 | 5C | EXC | 0, 0 | 248 | | EXC | 0,0 | CD TO PC1 | 248 |
| 244 | 2D | RSB7 | 0, 0 | 249 | HAND | RSB7 | | | 249 |
| 222 | 1P | LB | 3,10 | 250 | | LB | MC | | 250 |
| 243 | 22 | SM | 4, 0 | 251 | | SM | 4 | S CR | 251 |
| 221 | 1D | LB | 1,11 | 252 | | LB | VD | | 252 |
| 242 | 4E | LAX | 14, 0 | 253 | | LAX | 14 | VARIABLE DELAY | 253 |
| 253 | 5D | EXC | 1, 0 | 254 | | EXC | 1,0 | | 254 |
| 258 | 88 | TRA | 0, 7 | 255 | | TRA | 0,ZRO | 0,K11 | 255 |
| 261 | 00 | NOP | 0, 0 | 256 | TRDLY | NOP | | | 256 |
| 262 | 3B | TL | 4, 0 | 257 | | TL | | | 257 |
| 263 | FF | TRA | 1, 0 | 258 | | TRA | 1,RDLY | | 258 |
| 231 | 8B | TRA | 0,52 | 259 | NET | TRA | 0,SETM | S DS | 259 |
| 215 | 23 | SM | 8, 0 | 260 | | SM | 8 | S HS | 260 |
| 207 | 1F | LB | 3,11 | 261 | | LB | H | | 261 |
| 203 | 22 | SM | 4, 0 | 262 | | SM | 4 | | 262 |
| 201 | E3 | TRA | 1,28 | 263 | | TRA | 1,TKRETS | | 263 |

TABLE III

| ADDR. | CODE | | | STMT. | | | | | |
|---|---|---|---|---|---|---|---|---|---|
| | | | | | | ORG | 300 | | |
| 300 | A6 | TRA | 0,25 | 300 | DBLK | TPA | 0,TAI | | 300 |
| 332 | 3E | TL | 1, 0 | 301 | TKRET | TL | | | 301 |
| 316 | DD | TRA | 1,34 | 302 | | TRA | 1,KRET | | 302 |
| 308 | B2 | TRA | 0,61 | 303 | | TRA | 0,TD3 | | 303 |
| 304 | DF | TRA | 1,32 | 304 | | TRA | 1,TKRET | | 304 |
| 302 | 28 | TM | 8, 0 | 305 | | TM | 8 | T HS | 305 |
| 333 | DF | TRA | 1,32 | 306 | | TRA | 1,TKRET | | 306 |
| 348 | 23 | SM | 8, 0 | 307 | | SM | 8 | S HS | 307 |
| 324 | 11 | LB | 1, 8 | 308 | | LB | SF | | 308 |
| 312 | 23 | SM | 8, 0 | 309 | | SM | 8 | S DBL | 309 |
| 306 | 30 | TL | 2, 0 | 310 | TOHAND | TL | | | 310 |
| 335 | D3 | TRA | 1,44 | 311 | | TRA | 1,HANU | | 311 |
| 317 | A9 | TRA | 0,22 | 312 | HITK | TRA | 0,TDS1 | | 312 |
| 340 | DF | TRA | 1,32 | 313 | | TRA | 1,TKRET | | 313 |
| 320 | A6 | TRA | 0,25 | 314 | | TRA | 0,TAI | | 314 |
| 310 | DF | TRA | 1,32 | 315 | | TRA | 1,TKRET | | 315 |
| 337 | B2 | TRA | 0,61 | 316 | | TRA | 0,TD3 | | 316 |
| 350 | DF | TRA | 1,32 | 317 | | TRA | 1,TKRET | | 317 |
| 357 | 23 | SM | 8, 0 | 318 | | SM | 8 | S HS | 318 |
| 360 | F9 | TRA | 1, 6 | 319 | | TRA | 1,TOHAND | | 319 |
| 330 | 85 | TRA | 0,58 | 320 | TOTK | TRA | 0,THO | | 320 |
| 347 | DF | TRA | 1-32 | 321 | | TRA | 1,TKRET | | 321 |
| 323 | 20 | RSR7 | 0, 0 | 322 | | RSR7 | | | 322 |
| 311 | 33 | TL | 12, 0 | 323 | | TL | | | 323 |
| 305 | A0 | TRA | 0,31 | 324 | | TRA | 0,TTOK | | 324 |
| 334 | A3 | TRA | 0,28 | 325 | | TRA | 0,SWAPKW | | 325 |
| 349 | AF | TRA | 0,16 | 326 | | TRA | 0,0TOK | | 326 |
| 356 | 08 | LB | 0, 0 | 327 | | LB | 0,0 | | 327 |
| 328 | 42 | LAX | 2, 0 | 328 | | LAX | 2 | | 328 |
| 314 | 5C | EXC | 0, 0 | 329 | | EXC | 0,0 | | 329 |
| 339 | 32 | TL | 13, 0 | 330 | | TL | | | 330 |
| 319 | BF | TRA | 0, 0 | 331 | | TRA | 0,MD1 | | 331 |
| 309 | A3 | TRA | 0,28 | 332 | | TRA | 0,SWAPKW | | 332 |
| 336 | 1F | LB | 3,11 | 333 | | LB | 3,11 | | 333 |
| 318 | 25 | RSM | 2, 0 | 334 | | RSM | 2 | R K | 334 |
| 341 | DF | TRA | 1,32 | 335 | | TRA | 1,TKRET | | 335 |

TABLE III

| ADDR. | CODE | | | STMT. | | | | | |
|---|---|---|---|---|---|---|---|---|---|
| 352 | 28 | TM | 8, 0 | 336 | BETK | TM | 8 | T PR | 336 |
| 326 | CA | TRA | 1,53 | 337 | | TRA | 1,BET1 | | 337 |
| 345 | 23 | SM | 8, 0 | 338 | | SM | 8 | S PR | 338 |
| 354 | 2D | RSB7 | 0, 0 | 339 | | RSB7 | | | 339 |
| 359 | 1E | LB | 2,11 | 340 | | LB | ND | | 340 |
| 329 | 27 | RSM | 8, 0 | 341 | | RSM | 8 | R N | 341 |
| 346 | 0A | LB | 2, 0 | 342 | | LB | 2,0 | | 342 |
| 355 | 42 | LAX | 2, 0 | 343 | | LAX | 2 | | 343 |
| 327 | 5C | EXC | 0, 0 | 344 | | EXC | 0,0 | | 344 |
| 313 | 8B | TRA | 0,52 | 345 | | TRA | 0,SETM | | 345 |
| 338 | 32 | TL | 13, 0 | 346 | | TL | | | 346 |
| 351 | BF | TRA | 0, 0 | 347 | | TRA | 0,MD1 | | 347 |
| 325 | 1B | LB | 3,10 | 348 | | LB | MC | | 348 |
| 344 | 24 | RSM | 1, 0 | 349 | | RSM | 1 | RESET M | 349 |
| 322 | AF | TRA | 0,16 | 350 | | TRA | 0,0TOK | | 350 |
| 343 | 16 | LB | 2, 9 | 351 | | LB | 2,9 | | 351 |
| 321 | 93 | TRA | 0,36 | 352 | | TRA | 0,SWAP1X | | 352 |
| 342 | DF | TRA | 1,32 | 353 | | TRA | 1,TKRET | | 353 |
| 353 | 82 | TRA | 0,61 | 354 | BET1 | TRA | 0,TD3 | | 354 |
| 358 | C1 | TRA | 1,62 | 355 | | TRA | 1,*+2 | | 355 |
| 361 | DF | TRA | 1,32 | 356 | | TRA | 1,TKRET | | 356 |
| 362 | 2D | RSB7 | 0, 0 | 357 | | RSB7 | | | 357 |
| 363 | 1E | LB | 2,11 | 358 | | LB | ND | | 358 |
| 331 | 27 | RSM | 8, 0 | 359 | | RSM | 8 | R N | 359 |
| 315 | 1F | LB | 3,11 | 360 | | LB | 8 | | 360 |
| 307 | 21 | SM | 2, 0 | 361 | | SM | 2 | | 361 |
| 303 | A3 | TRA | 0,28 | 362 | | TRA | 0,SWAPKW | | 362 |
| 301 | F9 | TRA | 1, 6 | 363 | | TRA | 1,TOHAND | | 363 |

TABLE III

| ADDR. | CODE | | | STMT. | | | | | |
|---|---|---|---|---|---|---|---|---|---|
| | | | | | | ORG | 400 | | |
| 400 | 7F | TAM | 0, 0 | 400 | INCCCX | TAM | | | 400 |
| 432 | FB | TRA | 1, 4 | 401 | | TRA | 1,DS3X | | 401 |
| 416 | 19 | LB | 1,10 | 402 | MSBC | LB | 1,10 | | 402 |
| 408 | 9A | TRA | 0,37 | 403 | | TRA | 0,PLUS1 | | 403 |
| 404 | 1B | LB | 3,10 | 404 | DS3X | LB | MC | | 404 |
| 402 | 2D | RSB7 | 0, 0 | 405 | | RSB7 | | | 405 |
| 433 | 26 | RSM | 4, 0 | 406 | | RSM | 4 | | 406 |
| 448 | B2 | TRA | 0,61 | 407 | DS3 | TRA | 0,TD3 | | 407 |
| 424 | 9A | TRA | 0,37 | 408 | | TRA | 0,PLUS1 | INC DS1-3 | 408 |
| 412 | 05 | RSC | 0, 0 | 409 | CARDTO | RSC | | | 409 |
| 406 | A9 | TRA | 0,22 | 410 | | TRA | 0,TDS1 | | 410 |
| 435 | 06 | SC | 0, 0 | 411 | | SC | | | 411 |
| 417 | 17 | LB | 3, 9 | 412 | | LB | NEW | | 412 |
| 440 | 50 | LDA | 0, 0 | 413 | | LDA | 0 | | 413 |
| 420 | 75 | ATH | 0, 0 | 414 | | ATH | | NU CD TO H | 414 |
| 410 | A9 | TRA | 0,22 | 415 | | TRA | 0,TDS1 | | 415 |
| 437 | 0A | LB | 2, 0 | 416 | | LB | 2,0 | | 416 |
| 450 | 1E | LB | 2,11 | 417 | | LB | 2,11 | | 417 |
| 457 | 40 | LAX | 0, 0 | 418 | CFZ | LAX | 0 | | 418 |
| 460 | 7F | TAM | 0, 0 | 419 | | TAM | | | 419 |
| 430 | E9 | TRA | 1,22 | 420 | | TRA | 1,CHGB | | 420 |
| 447 | 79 | HTA | 0, 0 | 421 | LDCARD | HTA | | | 421 |
| 423 | 5C | FXC | 0, 0 | 422 | | FXC | 0,0 | LD NU CD | 422 |
| 411 | 41 | LAX | 1, 0 | 423 | | LAX | 1 | | 423 |
| 405 | 05 | RSC | 0, 0 | 424 | | RSC | | | 424 |
| 434 | 7F | TAM | 0, 0 | 425 | | TAM | | TST FOR ACE | 425 |
| 449 | E3 | TRA | 1,28 | 426 | | TRA | 1,*+2 | | 426 |
| 456 | 06 | SC | 0, 0 | 427 | | SC | | | 427 |
| 428 | A9 | TRA | 0,22 | 428 | ADDCDS | TRA | 0,TDS1 | | 428 |
| 414 | CC | TRA | 1,51 | 429 | | TRA | 1,DADDDT | | 429 |
| 439 | BC | TRA | 0,51 | 430 | | TRA | 0,TSPLIT | | 430 |
| 419 | C4 | TRA | 1,59 | 431 | | TRA | 1,TH2C1 | | 431 |
| 409 | 35 | TL | 10, 0 | 432 | TOADPT | TL | | | 432 |
| 434 | B2 | TRA | 0,61 | 433 | | TRA | 0,ADDPT | | 433 |
| 418 | 1B | LB | 3,10 | 434 | TSTDS3 | LB | DS | | 434 |
| 441 | 2A | TM | 4, 0 | 435 | | TM | 4 | | 435 |

TABLE III

| ADDR. | CODE | | | STMT. | | | | | |
|---|---|---|---|---|---|---|---|---|---|
| 452 | 3A | TL | 5, 0 | 436 | | TL | | | 436 |
| 426 | FF | TRA | 1, 0 | 437 | | TRA | 1,TBLJK | | 437 |
| 445 | 3D | TL | 2, 0 | 438 | | TL | | | 438 |
| 454 | D3 | TRA | 1,44 | 439 | | TRA | 1,HAND | | 439 |
| 459 | 45 | LAX | 5, 0 | 440 | TH2C1 | LAX | 5 | | 440 |
| 429 | 76 | ATB | 0, 0 | 441 | | ATB | | | 441 |
| 446 | 2D | TM | 8, 0 | 442 | | TM | 8 | | 442 |
| 455 | F6 | TRA | 1, 9 | 443 | | TRA | 1,TOADPT | | 443 |
| 427 | 35 | TL | 10, 0 | 444 | | TL | | | 444 |
| 413 | 81 | TRA | 0,62 | 445 | | TRA | 0,ADDST | | 445 |
| 438 | ED | TRA | 1,18 | 446 | | TRA | 1,TSTDS3 | | 446 |
| 451 | 35 | TL | 10, 0 | 447 | DADDDT | TL | | | 447 |
| 425 | B5 | TRA | 0,58 | 448 | | TRA | 0,ADDDT | | 448 |
| 444 | ED | TRA | 1,18 | 449 | | TRA | 1,TSTDS3 | | 449 |
| 422 | 50 | LDA | 0, 0 | 450 | CHGB | LDA | 0 | | 450 |
| 443 | 82 | TC | 0, 0 | 451 | | TC | | | 451 |
| 421 | C5 | TRA | 1,54 | 452 | | TRA | 1,UP | | 452 |
| 442 | 5B | EXC | 0, 2 | 453 | | EXC | 0,-1 | | 453 |
| 453 | C6 | TRA | 1,57 | 454 | | TRA | 1,CFZ | | 454 |
| 458 | 54 | EXC | 0, 1 | 455 | UP | EXC | 0,+1 | | 455 |
| 461 | C6 | TRA | 1,57 | 456 | | TRA | 1,CFZ | | 456 |
| 462 | 3D | TL | 2, 0 | 457 | | TL | | | 457 |
| 463 | EF | TRA | 1,16 | 458 | | TRA | 1,RESET | | 458 |
| 431 | 40 | LAX | 0, 0 | 459 | RLZ | LAX | 0 | ZERO FROM | 459 |
| 415 | 54 | EXC | 0, 1 | 460 | | EXC | 0,+1 | START UP | 460 |
| 407 | E0 | TRA | 1,31 | 461 | | TRA | 1,*-2 | THRU 7 OR 11 | 461 |
| 403 | 2F | RET | 0, 0 | 462 | | RET | 0 | | 462 |

TABLE III

| ADDR. | CODE | | | STMT. | | | | | |
|---|---|---|---|---|---|---|---|---|---|
| | | | | | | ORG | 500 | | |
| 500 | 1D | LB | 1,11 | 500 | TBLJK | LB | 1,11 | | 500 |
| 532 | 28 | TM | 1, 0 | 501 | | TM | 1 | T TBJ | 501 |
| 516 | E4 | TRA | 1,27 | 502 | | TRA | 1,T2DS1 | | 502 |
| 508 | 0A | LB | 2, 0 | 503 | | LB | 2,0 | | 503 |
| 504 | 41 | LAX | 1, 0 | 504 | | LAX | 1 | | 504 |
| 502 | 7F | TAM | 0, 0 | 505 | | TAM | | TST FOR ACE | 505 |
| 533 | CD | TRA | 1,50 | 506 | | TRA | 1,BJL | | 506 |
| 548 | A6 | TRA | 0,25 | 507 | SETAI | TRA | 0,TAI | TST AI | 507 |
| 524 | DA | TRA | 1,37 | 508 | | TRA | 1,TBJL | | 508 |
| 512 | 20 | SM | 1, 0 | 509 | | SM | 1 | SET AI | 509 |
| 506 | 3E | TL | 1, 0 | 510 | TKRET7 | TL | | | 510 |
| 535 | DD | TRA | 1,34 | 511 | | TRA | 1,KRET | | 511 |
| 517 | A6 | TRA | 0,25 | 512 | INSK | TRA | 0,TAI | | 512 |
| 540 | F5 | TRA | 1,10 | 513 | | TRA | 1,*+2 | | 513 |
| 520 | F5 | TRA | 1, 6 | 514 | | TRA | 1,TKRET7 | | 514 |
| 510 | 22 | SM | 4, 0 | 515 | | SM | 4 | | 515 |
| 537 | 24 | RSM | 1, 0 | 516 | TBJL | RSM | 1 | | 516 |
| 550 | 1A | LB | 2,10 | 517 | BJL | LB | 2,10 | | 517 |
| 557 | 36 | TL | 9, 0 | 518 | | TL | | | 518 |
| 560 | BF | TRA | 0, 0 | 519 | | TRA | 0,BJTEST | TST PLR | 519 |
| 530 | 23 | SM | 8, 0 | 520 | | SM | 8 | | 520 |
| 547 | 0A | LB | 2, 0 | 521 | | LB | 2,0 | | 521 |
| 523 | 36 | TL | 9, 0 | 522 | | TL | | | 522 |
| 511 | BF | TRA | 0, 0 | 523 | | TRA | 0,BJTEST | TST DLR | 523 |
| 505 | 21 | SM | 2, 0 | 524 | | SM | 2 | | 524 |
| 534 | 1D | LB | 1,11 | 525 | | LB | 1,11 | | 525 |
| 549 | 20 | SM | 1, 0 | 526 | | SM | 1 | S TBJ | 526 |
| 556 | 0D | LB | 1, 7 | 527 | | LB | BJI | | 527 |
| 528 | 2A | TM | 4, 0 | 528 | | TM | 4 | TST INS | 528 |
| 514 | E9 | TRA | 1,22 | 529 | | TRA | 1,INSDLR | YES | 529 |
| 539 | 29 | TM | 2, 0 | 530 | | TM | 2 | NO INS | 530 |
| 519 | C1 | TRA | 1,62 | 531 | | TRA | 1,TPLRY | | 531 |
| 509 | 28 | TM | 8, 0 | 532 | TPLRN | TM | 8 | | 532 |
| 536 | D9 | TRA | 1,38 | 533 | | TRA | 1,3TON | PLR BJ | 533 |
| 518 | 1E | LB | 2,11 | 534 | TFP | LB | 2,11 | | 534 |
| 541 | 50 | LDA | 0, 0 | 535 | | LDA | 0 | | 535 |

TABLE III

| ADDR. | CODE | | | STMT. | | | | | |
|---|---|---|---|---|---|---|---|---|---|
| 552 | 1A | LB | 2,10 | 536 | | LB | 2,10 | | 536 |
| 526 | 7F | TAM | 0, 0 | 537 | | TAM | | TST FOR PAIR | 537 |
| 545 | E4 | TRA | 1,27 | 538 | | TRA | 1,T2DS1 | | 538 |
| 554 | 11 | LB | 1, 8 | 539 | | LB | SF | IS PAIR | 539 |
| 559 | 22 | SM | 4, 0 | 540 | | SM | 4 | | 540 |
| 529 | 6E | ADX | 14, 0 | 541 | | ADX | 14 | | 541 |
| 546 | E4 | TRA | 1,27 | 542 | | TRA | 1,*+2 | | 542 |
| 555 | 21 | SM | 2, 0 | 543 | | SM | 2 | SET SPA | 543 |
| 527 | 37 | TL | 8, 0 | 544 | T2DS1 | TL | | | 544 |
| 513 | FF | TRA | 1, 0 | 545 | | TRA | 1,T2DS1X | | 545 |
| 538 | 33 | TL | 12, 0 | 546 | 3TON | TL | | | 546 |
| 531 | BF | TRA | 0,48 | 547 | | TRA | 0,P3TON | | 547 |
| 525 | 30 | TL | 2, 0 | 548 | TONFT1 | TL | | | 548 |
| 544 | E0 | TRA | 1,31 | 549 | | TRA | 1,NFT | | 549 |
| 522 | 29 | TM | 2, 0 | 550 | INSDLR | TM | 2 | | 550 |
| 543 | C5 | TRA | 1,58 | 551 | | TRA | 1,2TON | | 551 |
| 521 | 33 | TL | 12, 0 | 552 | | TL | | | 552 |
| 542 | BF | TRA | 0, 0 | 553 | | TRA | 0,M1TON | | 553 |
| 553 | F6 | TRA | 1, 9 | 554 | | TRA | 1,TPLRN | | 554 |
| 558 | 33 | TL | 12, 0 | 555 | 2TON | TL | | | 555 |
| 561 | 9E | TRA | 0,33 | 556 | | TRA | 0,P2TON | | 556 |
| 562 | 2B | TM | 8, 0 | 557 | TPLRY | TM | 8 | | 557 |
| 563 | E6 | TRA | 1,25 | 558 | | TRA | 1,TONET1 | | 558 |
| 531 | 33 | TL | 12, 0 | 559 | TM2TON | TL | | | 559 |
| 515 | 9F | TRA | 0,32 | 560 | | TRA | 0,M2TON | | 560 |
| 507 | E6 | TRA | 1,25 | 561 | | TRA | 1,TONET1 | | 561 |

TABLE III

| ADDR. | CODE | | | STMT. | | | | | |
|---|---|---|---|---|---|---|---|---|---|
| | | | | | | ORG | 600 | | |
| 600 | 1B | LB | 3,10 | 600 | STANDX | LB | DS | | 600 |
| 632 | 23 | SM | 8, 0 | 601 | | SM | 8 | S HS | 601 |
| 616 | 8C | TRA | 0,51 | 602 | | TRA | 0,TSPLIT | | 602 |
| 608 | 30 | TL | 2, 0 | 603 | | TL | | | 603 |
| 604 | D8 | TRA | 1,39 | 604 | | TRA | 1,TH2C | | 604 |
| 602 | 05 | RSC | 0, 0 | 605 | COUNTX | RSC | | | 605 |
| 633 | 34 | TL | 11, 0 | 606 | | TL | | | 606 |
| 648 | AF | TRA | 0,16 | 607 | | TRA | 0,ADACES | | 607 |
| 624 | F3 | TRA | 1,12 | 608 | | TRA | 1,*+1 | | 608 |
| 612 | 05 | RSC | 0, 0 | 609 | | RSC | | | 609 |
| 606 | 34 | TL | 11, 0 | 610 | | TL | | | 610 |
| 635 | 9F | TRA | 0,32 | 611 | | TRA | 0,ADACEP | | 611 |
| 617 | D7 | TRA | 1,40 | 612 | | TRA | 1,*+1 | | 612 |
| 640 | 8B | TRA | 0,52 | 613 | | TRA | 0,SETM | S DS1 | 613 |
| 620 | 06 | SC | 0, 0 | 614 | COUNT | SC | | SET CARRY | 614 |
| 610 | 09 | LB | 1, 0 | 615 | | LB | 1,0 | | 615 |
| 637 | 41 | LAX | 1, 0 | 616 | | LAX | 1 | | 616 |
| 650 | 76 | ATB | 0, 0 | 617 | | ATB | | | 617 |
| 657 | 2A | TM | 4, 0 | 618 | | TM | 4 | T DB | 618 |
| 660 | 38 | TL | 7, 0 | 619 | | TL | | | 619 |
| 630 | FF | TRA | 1, 0 | 620 | | TRA | 1,DLROVR | | 620 |
| 647 | 34 | TL | 11, 0 | 621 | | TL | | | 621 |
| 623 | BF | TRA | 0, 0 | 622 | | TRA | 0,ADACED | | 622 |
| 611 | 30 | TL | 2, 0 | 623 | | TL | | | 623 |
| 605 | D3 | TRA | 1,44 | 624 | | TRA | 1,HAND | | 624 |
| 634 | 09 | LB | 1, 0 | 625 | DLRSTD | LB | 1,0 | | 625 |
| 649 | 50 | LDA | 0, 0 | 626 | | LDA | 0 | | 626 |
| 656 | 75 | ATH | 0, 0 | 627 | | ATH | | DLR TOT TO H | 627 |
| 628 | 33 | TL | 12, 0 | 628 | | TL | | | 628 |
| 614 | 98 | TRA | 0,36 | 629 | | TRA | 0,CMPRP | | 629 |
| 639 | C2 | TRA | 1,61 | 630 | | TRA | 1,DLRWN | | 630 |
| 619 | 02 | TC | 0, 0 | 631 | | TC | | | 631 |
| 609 | C9 | TRA | 1,54 | 632 | | TRA | 1,CHKH2C | T1E | 632 |
| 636 | 11 | LB | 1, 8 | 633 | PLRWN | LB | SF | | 633 |
| 618 | 23 | TM | 8, 0 | 634 | | TM | 8 | TST DBL | 634 |
| 641 | 33 | TL | 12, 0 | 635 | | TL | | | 635 |

TABLE III

| ADDR. | CODE | | | STMT. | | | | | |
|---|---|---|---|---|---|---|---|---|---|
| 652 | 9E | TRA | 0,33 | 636 | | TRA | 0,P2TON | | 636 |
| 626 | 33 | TL | 12, 0 | 637 | W1NSP | TL | | | 637 |
| 645 | 9E | TRA | 0,33 | 638 | | TRA | 0,P2TON | | 638 |
| 654 | 45 | LAX | 5, 0 | 639 | CHKH2C | LAX | 5 | | 639 |
| 659 | 76 | ATB | 0, 0 | 640 | | ATB | | | 640 |
| 629 | 2B | TM | 8, 0 | 641 | | TM | 8 | TST H2C | 641 |
| 646 | F2 | TRA | 1,13 | 642 | | TRA | 1,CKH2B | | 642 |
| 655 | 30 | TL | 2, 0 | 643 | TNET | TL | | | 643 |
| 627 | E0 | TRA | 1,31 | 644 | | TRA | 1,NET | | 644 |
| 613 | 09 | LB | 1, 0 | 645 | CKH2B | LB | 1,0 | | 645 |
| 638 | 50 | LDA | 0, 0 | 646 | | LDA | 0 | | 646 |
| 651 | 75 | ATH | 0, 0 | 647 | | ATH | | | 647 |
| 625 | 33 | TL | 12, 0 | 648 | | TL | | | 648 |
| 644 | B6 | TRA | 0, 9 | 649 | | TRA | 0,CMPRS | | 649 |
| 622 | 34 | TL | 5, 0 | 650 | | TL | | | 650 |
| 643 | E0 | TRA | 1,31 | 651 | | TRA | 1,TM2TON | | 651 |
| 621 | 02 | TC | 0, 0 | 652 | | TC | | | 652 |
| 642 | C8 | TRA | 1,55 | 653 | | TRA | 1,TNFT | TIE | 653 |
| 653 | 38 | TL | 7, 0 | 654 | | TL | | | 654 |
| 658 | C3 | TRA | 1,60 | 655 | | TRA | 1,TP2TON | | 655 |
| 661 | 11 | LB | 1, 8 | 656 | DLRWN | LB | SF | | 656 |
| 662 | 28 | TM | 8, 0 | 657 | | TM | 8 | TST DBL | 657 |
| 663 | 33 | TL | 12, 0 | 658 | | TL | | | 658 |
| 631 | 9F | TRA | 0,32 | 659 | | TRA | 0,M2TON | | 659 |
| 615 | 33 | TL | 12, 0 | 660 | | TL | | | 660 |
| 607 | 9F | TRA | 0,32 | 661 | | TRA | 0,M2TON | | 661 |
| 603 | C9 | TRA | 1,54 | 662 | | TRA | 1,CHKH2C | | 662 |

TABLE III

| ADDR. | CODE | | | STMT. | | | | | |
|---|---|---|---|---|---|---|---|---|---|
| | | | | | | ORG | 700 | | |
| 700 | 43 | LAX | 3, 0 | 700 | DLROVR | LAX | 3 | | 700 |
| 732 | 76 | ATB | 0, 0 | 701 | | ATB | | | 701 |
| 716 | 2A | TM | 4, 0 | 702 | | TM | 4 | | 702 |
| 708 | FB | TRA | 1,23 | 703 | | TRA | 1,TDRL2 | | 703 |
| 704 | 11 | LB | 1, 8 | 704 | | LB | SF | | 704 |
| 702 | 2B | TM | 8, 0 | 705 | | TM | 8 | | 705 |
| 733 | 33 | TL | 12, 0 | 706 | | TL | | | 706 |
| 748 | 9E | TRA | 0,33 | 707 | | TRA | 0,P2TON | | 707 |
| 724 | 33 | TL | 12, 0 | 708 | | TL | | | 708 |
| 712 | 9E | TRA | 0,33 | 709 | | TRA | 0,P2TON | | 709 |
| 706 | 45 | LAX | 5, 0 | 710 | H2C3 | LAX | 5 | | 710 |
| 735 | 76 | ATB | 0, 0 | 711 | | ATB | | | 711 |
| 717 | 28 | TM | 8, 0 | 712 | | TM | 8 | | 712 |
| 740 | DA | TRA | 1,37 | 713 | | TRA | 1,TH2B3 | | 713 |
| 720 | 3D | TL | 2, 0 | 714 | TONET | TL | | | 714 |
| 710 | E0 | TRA | 1,31 | 715 | | TRA | 1,NET | | 715 |
| 737 | 2A | TM | 4, 0 | 716 | TH2B3 | TM | 4 | | 716 |
| 750 | 33 | TL | 12, 0 | 717 | | TL | | | 717 |
| 757 | AF | TRA | 0,16 | 718 | | TRA | 0,M4TON | | 718 |
| 760 | 33 | TL | 12, 0 | 719 | TP2TON | TL | | | 719 |
| 730 | 9E | TRA | 0,33 | 720 | | TRA | 0,P2TON | | 720 |
| 747 | FB | TRA | 1,20 | 721 | | TRA | 1,TONET | | 721 |
| 723 | 11 | LB | 1, 8 | 722 | TDRL2 | LB | SF | | 722 |
| 711 | 2B | TM | 8, 0 | 723 | | TM | 8 | | 723 |
| 705 | 33 | TL | 12, 0 | 724 | | TL | | | 724 |
| 734 | 9F | TRA | 0,32 | 725 | | TRA | 0,M2TON | | 725 |
| 749 | 33 | TL | 12, 0 | 726 | | TL | | | 726 |
| 756 | 9F | TRA | 0,32 | 727 | | TRA | 0,M2TON | | 727 |
| 728 | F9 | TRA | 1, 6 | 728 | | TRA | 1,H2C3 | | 728 |
| 714 | 29 | TM | 2, 0 | 729 | SPLC | TM | 2 | T SPA | 729 |
| 739 | 06 | SC | 0, 0 | 730 | | SC | | ACES | 730 |
| 719 | 40 | LAX | 0, 0 | 731 | | LAX | 0 | | 731 |
| 709 | 1A | LB | 2,10 | 732 | | LB | 2,10 | | 732 |
| 736 | 5C | EXC | 0, 0 | 733 | | EXC | 0,0 | 0 TO PC2 | 733 |
| 718 | 75 | ATH | 0, 0 | 734 | | ATH | | | 734 |
| 741 | 09 | LB | 1, 0 | 735 | | LB | 1,0 | | 735 |

TABLE III

05/16/77 11:24 PAGE: 17

| ADDR. | | CODE | | STMT. | | | | | |
|---|---|---|---|---|---|---|---|---|---|
| 752 | 45 | LAX | 5, 0 | 736 | | LAX | 5 | | 736 |
| 726 | 76 | ATB | 0, 0 | 737 | | ATB | | | 737 |
| 745 | 02 | TC | 0, 0 | 738 | | TC | | | 738 |
| 754 | 20 | SM | 1, 0 | 739 | | SM | 1 | S SA | 739 |
| 759 | 50 | LDA | 0, 0 | 740 | | LDA | 0 | | 740 |
| 729 | 58 | EXC | 0, 2 | 741 | | EXC | 0,-1 | | 741 |
| 746 | 79 | HTA | 0, 0 | 742 | | HTA | | | 742 |
| 755 | 58 | EXC | 0, 2 | 743 | | EXC | 0,-1 | CARD TO S TOT | 743 |
| 727 | 02 | TC | 0, 0 | 744 | | TC | | | 744 |
| 713 | 20 | SM | 1, 0 | 745 | | SM | 1 | S PA | 745 |
| 738 | 25 | RSM | 2, 0 | 746 | | RSM | 2 | R 16P | 746 |
| 751 | 50 | LDA | 0, 0 | 747 | | LDA | 0 | | 747 |
| 725 | 58 | EXC | 0, 2 | 748 | | EXC | 0,-1 | | 748 |
| 744 | 79 | HTA | 0, 0 | 749 | | HTA | | | 749 |
| 722 | 5C | EXC | 0, 0 | 750 | | EXC | 0,0 | CARD TO P TOT | 750 |
| 743 | 3D | TL | 2, 0 | 751 | THAND | TL | | | 751 |
| 721 | D3 | TRA | 1,44 | 752 | | TRA | 1,HAND | | 752 |
| 742 | 08 | LB | 0, 0 | 753 | RTJUS | LB | 0,0 | | 753 |
| 753 | 40 | LAX | 0, 0 | 754 | | LAX | 0 | | 754 |
| 758 | 7F | TAM | 0, 0 | 755 | | TAM | | | 755 |
| 761 | 2F | RET | 0, 0 | 756 | | RET | 0 | | 756 |
| 762 | 14 | LB | 0, 9 | 757 | | LB | 0,9 | | 757 |
| 763 | 7F | TAM | 0, 0 | 758 | | TAM | | | 758 |
| 731 | F9 | TRA | 1, 7 | 759 | | TRA | 1,RTJUS1 | | 759 |
| 715 | 2F | RET | 0, 0 | 760 | | RET | 0 | | 760 |
| 707 | 64 | TRA | 0,11 | 761 | RTJUS1 | TRA | 0,KRIGHT | | 761 |
| 703 | B9 | TRA | 0, 6 | 762 | | TRA | 0,KEM1 | | 762 |
| 701 | D5 | TRA | 1,42 | 763 | | TRA | 1,RTJUS | | 763 |

TABLE III

| ADDR. | CODE | | | STMT. | | | | | |
|---|---|---|---|---|---|---|---|---|---|
| | | | | | | ORG | 800 | | |
| 800 | A9 | TRA | 0,22 | 800 | T2DS1X | TRA | 0,TDS1 | | 800 |
| 832 | 39 | TL | 6, 0 | 801 | | TL | | | 801 |
| 816 | EB | TRA | 1,20 | 802 | | TRA | 1,COUNT | | 802 |
| 808 | BC | TRA | 0,51 | 803 | PLRCD | TRA | 0,TSPLIT | T SPLIT | 803 |
| 804 | DA | TRA | 1,37 | 804 | | TRA | 1,TSPA | | 804 |
| 802 | 09 | LB | 1, 0 | 805 | TSH1B | LB | 1,0 | | 805 |
| 833 | 43 | LAX | 3, 0 | 806 | | LAX | 3 | | 806 |
| 848 | 76 | ATB | 0, 0 | 807 | | ATB | | | 807 |
| 824 | 2A | TM | 4, 0 | 808 | | TM | 4 | TST H1B | 808 |
| 812 | E5 | TRA | 1,26 | 809 | | TRA | 1,THB | | 809 |
| 806 | 11 | LB | 1, 8 | 810 | | LB | SF | | 810 |
| 835 | 2B | TM | 8, 0 | 811 | | TM | 8 | TST DBL | 811 |
| 817 | 39 | TL | 6, 0 | 812 | TOCNTX | TL | | | 812 |
| 840 | FD | TRA | 1, 2 | 813 | | TRA | 1,COUNTX | | 813 |
| 820 | 3E | TL | 1, 0 | 814 | TKRET3 | TL | | | 814 |
| 810 | DD | TRA | 1,34 | 815 | | TRA | 1,KRET | | 815 |
| 837 | 29 | TM | 2, 0 | 816 | TSPA | TM | 2 | TST SPA | 816 |
| 850 | F4 | TRA | 1,11 | 817 | | TRA | 1,TSH2C | | 817 |
| 857 | 45 | LAX | 5, 0 | 818 | | LAX | 5 | | 818 |
| 860 | 76 | ATB | 0, 0 | 819 | | ATB | | | 819 |
| 830 | 2B | TM | 8, 0 | 820 | | TM | 8 | T H2C | 820 |
| 847 | FD | TRA | 1, 2 | 821 | | TRA | 1,TSH1B | | 821 |
| 823 | EB | TRA | 1,20 | 822 | | TRA | 1,TKRET3 | | 822 |
| 811 | 45 | LAX | 5, 0 | 823 | TSH2C | LAX | 5 | | 823 |
| 805 | 76 | ATB | 0, 0 | 824 | | ATB | | | 824 |
| 834 | 2B | TM | 8, 0 | 825 | | TM | 8 | T H2C | 825 |
| 849 | D8 | TRA | 1,39 | 826 | | TRA | 1,MOVPC | | 826 |
| 856 | 23 | SM | 8, 0 | 827 | | SM | 8 | S H2C | 827 |
| 828 | 30 | TL | 2, 0 | 828 | | TL | | | 828 |
| 814 | D3 | TRA | 1,44 | 829 | | TRA | 1,HAND | | 829 |
| 839 | 16 | LB | 2, 9 | 830 | MOVPC | LB | 2,9 | | 830 |
| 819 | B9 | TRA | 0, 7 | 831 | | TRA | 0,ZRO | | 831 |
| 809 | 5C | EXC | 0, 0 | 832 | | EXC | 0,0 | | 832 |
| 836 | 41 | LAX | 1, 0 | 833 | | LAX | 1 | | 833 |
| 818 | 0E | LB | 2, 7 | 834 | | LB | 2,7 | | 834 |
| 841 | 5C | EXC | 0, 0 | 835 | | EXC | 0,0 | | 835 |

TABLE III

| ADDR. | | CODE | | STMT. | | | | |
|---|---|---|---|---|---|---|---|---|
| 852 | EE | TRA | 1,17 | 836 | | TRA | 1,TOCNTX | 836 |
| 826 | 45 | LAX | 5, 0 | 837 | THB | LAX | 5 | 837 |
| 845 | 76 | ATB | 0, 0 | 838 | | ATB | | 838 |
| 854 | 28 | TM | 8, 0 | 839 | | TM | 8 | 839 |
| 859 | 2A | TM | 4, 0 | 840 | | TM | 4 | 840 |
| 829 | 39 | TL | 6, 0 | 841 | | TL | | 841 |
| 846 | DD | TRA | 1,34 | 842 | | TRA | 1,DLRSTD | 842 |
| 855 | EF | TRA | 1,17 | 843 | | TRA | 1,TOCNTX | 843 |
| 827 | A9 | TRA | 0,22 | 844 | STANDK | TRA | 0,TDS1 | 844 |
| 813 | EB | TRA | 1,20 | 845 | | TRA | 1,TKRET3 | 845 |
| 838 | 82 | TRA | 0,61 | 846 | | TRA | 0,TD3 | 846 |
| 851 | EB | TRA | 1,20 | 847 | | TRA | 1,TKRET3 | 847 |
| 825 | A6 | TRA | 0,25 | 848 | | TRA | 0,TAI | 848 |
| 844 | 3A | TL | 5, 0 | 849 | | TL | | 849 |
| 822 | FF | TRA | 1, 0 | 850 | | TRA | 1,TBLJK | 850 |
| 843 | 39 | TL | 6, 0 | 851 | | TL | | 851 |
| 821 | FF | TRA | 1, 0 | 852 | | TRA | 1,STANDX | 852 |
| 842 | 4F | LAX | 15, 0 | 853 | VDLY | LAX | 15 | 853 |
| 853 | 1D | LB | 1,11 | 854 | VDLY2 | LB | VD | 854 |
| 858 | 5C | EXC | 0, 0 | 855 | VDLY3 | EXC | 0,0 | 855 |
| 861 | 4F | LAX | 15, 0 | 856 | | LAX | 15 | 856 |
| 862 | 05 | RSC | 0, 0 | 857 | | RSC | | 857 |
| 863 | 6F | ADX | 15, 0 | 858 | | ADX | 15 | 858 |
| 831 | C1 | TRA | 1,62 | 859 | | TRA | 1,*-2 | 859 |
| 815 | 7D | ADD | 1, 1 | 860 | | ADD | 1,1 | 860 |
| 807 | 2F | RET | 0, 0 | 861 | | RET | 0 | 861 |
| 803 | CA | TRA | 1,53 | 862 | | TRA | 1,VDLY2 | 862 |

TABLE III

| ADDR. | CODE | | | STMT. | | | | | |
|---|---|---|---|---|---|---|---|---|---|
| | | | | | | ORG | 900 | | |
| 900 | 41 | LAX | 1, 0 | 900 | BJTEST | LAX | 1 | | 900 |
| 932 | 7F | TAM | 0, 0 | 901 | | TAM | | | 901 |
| 916 | F9 | TRA | 1, 6 | 902 | | TRA | 1,TST10 | | 902 |
| 908 | 54 | EXC | 0, 1 | 903 | | EXC | 0,+1 | | 903 |
| 904 | 4A | LAX | 10, 0 | 904 | | LAX | 10 | | 904 |
| 902 | 41 | LAX | 1, 0 | 905 | TF01 | LAX | 1 | | 905 |
| 933 | 7F | TAM | 0, 0 | 906 | | TAM | | | 906 |
| 948 | 2E | RET | 1, 0 | 907 | BJN | RET | 1 | NO BJ | 907 |
| 924 | 0D | LB | 1, 7 | 908 | BJY | LB | 1,7 | | 908 |
| 912 | 2F | RET | 0, 0 | 909 | | RET | 0 | BJ | 909 |
| 906 | 4A | LAX | 10, 0 | 910 | TST10 | LAX | 10 | | 910 |
| 935 | 7F | TAM | 0, 0 | 911 | | TAM | | | 911 |
| 917 | CF | TRA | 1,48 | 912 | | TRA | 1,BJN | | 912 |
| 940 | 54 | EXC | 0, 1 | 913 | | EXC | 0,+1 | | 913 |
| 920 | FD | TRA | 1, 2 | 914 | | TRA | 1,TF01 | | 914 |
| 910 | 06 | SC | 0, 0 | 915 | HM4 | SC | | | 915 |
| 937 | 4B | LAX | 11, 0 | 916 | | LAX | 11 | | 916 |
| 950 | 17 | LB | 3, 9 | 917 | | LB | NEW | | 917 |
| 957 | 5C | EXC | 0, 0 | 918 | | EXC | 0,0 | | 918 |
| 960 | 79 | HTA | 0, 0 | 919 | | HTA | | | 919 |
| 930 | 70 | ADD | 1, 0 | 920 | | ADD | 1 | | 920 |
| 947 | 75 | ATH | 0, 0 | 921 | | ATH | | H-4 TO H | 921 |
| 923 | 05 | RSC | 0, 0 | 922 | | RSC | | | 922 |
| 911 | 2F | RET | 0, 0 | 923 | | RET | 0 | | 923 |
| 905 | 1E | LB | 2,11 | 924 | CEK | LB | ND | | 924 |
| 934 | 28 | TM | 8, 0 | 925 | | TM | 8 | T N | 925 |
| 949 | CB | TRA | 1,52 | 926 | | TRA | 1,C1 | | 926 |
| 956 | 29 | TM | 2, 0 | 927 | | TM | 2 | T R | 927 |
| 928 | E2 | TRA | 1,29 | 928 | | TRA | 1,ROF | | 928 |
| 914 | B7 | TRA | 0, 8 | 929 | C2 | TRA | 0,0TOZ | | 929 |
| 939 | 16 | LB | 2, 9 | 930 | | LB | 2,9 | | |
| 919 | BB | TRA | 0, 4 | 931 | | TRA | 0,0TO | W <-- 0 | 931 |
| 909 | 1F | LB | 3,11 | 932 | | LB | 8 | | 932 |
| 936 | 4B | LAX | 8, 0 | 933 | | LAX | 8 | | 933 |
| 918 | BC | TRA | 0, 3 | 934 | | TRA | 0,TEXCX | | 934 |
| 941 | B8 | TRA | 0, 7 | 935 | | TRA | 0,ZRO | | |

TABLE III

| ADDR. | | CODE | | STMT. | | | | | |
|---|---|---|---|---|---|---|---|---|---|
| 952 | AF | TRA | 0,16 | 936 | C1 | TRA | 0,OTOK | | 935 |
| 926 | 1E | LB | 2,11 | 937 | | LB | ND | | 936 |
| 945 | B8 | TRA | 0, 7 | 938 | | TRA | 0,ZRO | | 937 |
| 954 | 3E | TL | 1, 0 | 939 | TKRET1 | TL | | | 938 |
| 959 | DD | TRA | 1,34 | 940 | | TRA | 1,KRET | | 939 |
| 929 | 24 | RSM | 1, 0 | 941 | ROF | RSM | 1 | R OF | 940 |
| 946 | C9 | TRA | 1,54 | 942 | | TRA | 1,TKRET1 | | 941 |
| 955 | A3 | TRA | 0,28 | 943 | E2 | TRA | 0,SWAPKW | | 942 |
| 927 | EA | TRA | 1,21 | 944 | | TRA | 1,E3 | | 943 |
| 913 | 23 | TM | 8, 0 | 945 | E1 | TM | 8 | T Q | 944 |
| 938 | C8 | TRA | 1,55 | 946 | | TRA | 1,E2 | | 945 |
| 951 | 23 | SM | 8, 0 | 947 | | SM | 8 | S Q | 946 |
| 925 | 1E | LB | 2,11 | 948 | | LB | ND | | 947 |
| 944 | 2B | TM | 8, 0 | 949 | | TM | 8 | T N | 948 |
| 922 | EA | TRA | 1,21 | 950 | | TRA | 1,E3 | | 949 |
| 943 | B6 | TRA | 0, 9 | 951 | | TRA | 0,SWAPKZ | | 950 |
| 921 | 32 | TL | 13, 0 | 952 | E3 | TL | | | 951 |
| 942 | BF | TRA | 0, 0 | 953 | | TRA | 0,MD1 | | 952 |
| 953 | A3 | TRA | 0,28 | 954 | | TRA | 0,SWAPKW | | 953 |
| 958 | 38 | TL | 7, 0 | 955 | RND | TL | | | 954 |
| 961 | 95 | TRA | 0,42 | 956 | | TRA | 0,RTJUS | | 955 |
| 962 | 1E | LB | 2,11 | 957 | | LB | ND | | 956 |
| 963 | 26 | RSM | 4, 0 | 958 | | RSM | 4 | R D | 957 |
| 931 | 27 | RSM | 8, 0 | 959 | | RSM | 8 | R N | 958 |
| 915 | C9 | TRA | 1,54 | 960 | | TRA | 1,TKRET1 | | 959 |

TABLE III

| ADDR. | CODE | | | STMT. | | | | | |
|---|---|---|---|---|---|---|---|---|---|
| | | | | | | ORG | 1000 | | |
| 1000 | 05 | RSC | 0, 0 | 1000 | ADD | RSC | | | 1000 |
| 1032 | 8D | TRA | 0,50 | 1001 | | TRA | 0,LKE | KE | 1001 |
| 1016 | 7F | TAM | 0, 0 | 1002 | | TAM | | T ZE=KE | 1002 |
| 1008 | C4 | TRA | 1,59 | 1003 | | TRA | 1,A1A | | 1003 |
| 1004 | 86 | TRA | 0,57 | 1004 | A1 | TRA | 0,LKS | | 1004 |
| 1002 | 7E | ADD | 0, 0 | 1005 | | ADD | 0 | KS+ZS | 1005 |
| 1033 | 1F | LB | 3,11 | 1006 | | LB | 8 | | 1006 |
| 1048 | 28 | TM | 1, 0 | 1007 | | TM | 1 | | 1007 |
| 1024 | 77 | COMP | 0, 0 | 1008 | | COMP | | MINUS | 1008 |
| 1012 | 68 | ADX | 8, 0 | 1009 | | ADX | 8 | ADD | 1009 |
| 1006 | D0 | TRA | 1,47 | 1010 | | TRA | 1,A9 | SIGNS ODD | 1010 |
| 1035 | BF | TRA | 0, 0 | 1011 | | TRA | 0,ADDZK | Z+K=Z | 1011 |
| 1017 | E8 | TRA | 1,20 | 1012 | | TRA | 1,A4 | C=1 | 1012 |
| 1040 | D6 | TRA | 1,41 | 1013 | | TRA | 1,TADRET | END A1 | 1013 |
| 1020 | 41 | LAX | 1, 0 | 1014 | A4 | LAX | 1 | | 1014 |
| 1010 | 8A | TRA | 0, 5 | 1015 | | TRA | 0,ZRIGHT | | 1015 |
| 1037 | 19 | LB | 1, 9 | 1016 | | LB | 1,9 | | 1016 |
| 1050 | 82 | TRA | 0,55 | 1017 | | TRA | 0,ISZERO. | | 1017 |
| 1057 | 96 | TRA | 0,41 | 1018 | | TRA | 0,SETOF | | 1018 |
| 1060 | 9C | TRA | 0,35 | 1019 | | TRA | 0,ZFM1 | ZE-1 | 1019 |
| 1030 | D6 | TRA | 1,41 | 1020 | END | TRA | 1,TADRET | | 1020 |
| 1047 | 9F | TRA | 0,32 | 1021 | A9 | TRA | 0,SUBZK | Z-K TOZ | 1021 |
| 1023 | D6 | TRA | 1,41 | 1022 | | TRA | 1,TADRET | | 1022 |
| 1011 | 11 | LB | 1, 8 | 1023 | A6 | LB | 1,8 | ZS | 1023 |
| 1005 | 48 | LAX | 8, 0 | 1024 | | LAX | 8 | | 1024 |
| 1034 | 97 | TRA | 0,40 | 1025 | | TRA | 0,ADDX | TOGGLE ZS | 1025 |
| 1049 | 06 | SC | 0, 0 | 1026 | | SC | | | 1026 |
| 1056 | 09 | LB | 1, 0 | 1027 | | LB | 1,0 | | 1027 |
| 1028 | 40 | LAX | 0, 0 | 1028 | A7 | LAX | 0 | | 1028 |
| 1014 | 5C | EXC | 0, 0 | 1029 | | EXC | 0,0 | | 1029 |
| 1039 | 77 | COMP | 0, 0 | 1030 | | COMP | | | 1030 |
| 1019 | 7D | ADD | 1, 1 | 1031 | | ADD | 1,1 | | 1031 |
| 1009 | 6A | ADX | 10, 0 | 1032 | | ADX | 10 | | 1032 |
| 1036 | 54 | EXC | 0, 1 | 1033 | | EXC | 0,+1 | | 1033 |
| 1018 | E3 | TRA | 1,28 | 1034 | | TRA | 1,A7 | | 1034 |
| 1041 | 93 | TRA | 0,44 | 1035 | TADRET | TRA | 0,TG | END A7 | 1035 |

TABLE III

| ADDR. | CODE | | | STMT. | | | | | |
|---|---|---|---|---|---|---|---|---|---|
| 1032 | 33 | TL | 12, 0 | 1036 | | TL | | | 1036 |
| 1026 | CD | TRA | 1,50 | 1037 | | TRA | 1,ADDRET | | 1037 |
| 1045 | 2D | RSB7 | 0, 0 | 1038 | | RSB7 | | | 1038 |
| 1054 | 2F | RET | 0, 0 | 1039 | | RET | 0 | | 1039 |
| 1059 | 77 | COMP | 0, 0 | 1040 | A1A | COMP | | | 1040 |
| 1029 | 7D | ADD | 1, 1 | 1041 | | ADD | 1,1 | | 1041 |
| 1046 | E4 | TRA | 1,27 | 1042 | | TRA | 1,A1B | ZE<KE | 1042 |
| 1055 | B6 | TRA | 0, 9 | 1043 | | TRA | 0,SWAPKZ | | 1043 |
| 1027 | 0D | LB | 1, 7 | 1044 | A1B | LB | 1,7 | | 1044 |
| 1013 | 88 | TRA | 0,55 | 1045 | | TRA | 0,ISZERO | | 1045 |
| 1038 | EA | TRA | 1,21 | 1046 | | TRA | 1,A2 | Z7=0 | 1046 |
| 1031 | B9 | TRA | 0, 6 | 1047 | | TRA | 0,KFM1 | | 1047 |
| 1025 | B4 | TRA | 0,11 | 1048 | | TRA | 0,KRIGHT | | 1048 |
| 1044 | 02 | TC | 0, 0 | 1049 | A3 | TC | | | 1049 |
| 1022 | B6 | TRA | 0, 9 | 1050 | | TRA | 0,SWAPKZ | C=1 | 1050 |
| 1043 | EF | TRA | 1, 0 | 1051 | | TRA | 1,ADD | | 1051 |
| 1021 | AB | TRA | 0,20 | 1052 | A2 | TRA | 0,ZEP1 | | 1052 |
| 1042 | BE | TRA | 0,49 | 1053 | | TRA | 0,ZLEFT | | 1053 |
| 1053 | D3 | TRA | 1,44 | 1054 | | TRA | 1,A3 | | 1054 |
| 1058 | 41 | LAX | 1, 0 | 1055 | ADDDT | LAX | 1 | | 1055 |
| 1061 | 43 | LAX | 3, 0 | 1056 | ADDPT | LAX | 3 | | 1056 |
| 1062 | 45 | LAX | 5, 0 | 1057 | ADDST | LAX | 5 | | 1057 |
| 1063 | 09 | LB | 1, 0 | 1058 | | LB | 1,0 | | 1058 |
| 1031 | 76 | ATB | 0, 0 | 1059 | | ATB | | | 1059 |
| 1015 | 02 | TC | 0, 0 | 1060 | | TC | | | 1060 |
| 1007 | 20 | SM | 1, 0 | 1061 | | SM | 1 | S ACE | 1061 |
| 1003 | 34 | TL | 11, 0 | 1062 | | TL | | | 1062 |
| 1001 | D1 | TRA | 1,46 | 1063 | | TRA | 1,ADPSX | | 1063 |

TABLE III

| ADDR. | CODE | | | STMT. | | | | | | |
|---|---|---|---|---|---|---|---|---|---|---|
| | | | | | | ORG | 1100 | | | 1100 |
| 1100 | 41 | LAX | 1, 0 | 1100 | ADACED | LAX | 1 | | | 1101 |
| 1132 | 43 | LAX | 3, 0 | 1101 | ADACEP | LAX | 3 | | | 1102 |
| 1116 | 45 | LAX | 5, 0 | 1102 | ADACES | LAX | 5 | | | 1103 |
| 1108 | 09 | LB | 1, 0 | 1103 | | LB | 1,0 | | | 1104 |
| 1104 | 76 | ATB | 0, 0 | 1104 | | ATB | | | | 1105 |
| 1102 | 29 | TM | 2, 0 | 1105 | | TM | 2 | T 16 | ASSUMES C=1 FOR DS1=1 (DLR) | 1106 |
| 1133 | 5E | TRA | 1,17 | 1106 | | TRA | 1,TC1 | | C=0 FOR DS1=0 | 1107 |
| 1148 | 28 | TM | 1, 0 | 1107 | | TM | 1 | | | 1108 |
| 1124 | E8 | TRA | 1,23 | 1108 | | TRA | 1,TC2 | | FOR PLR OR SPLIT | 1109 |
| 1112 | 02 | TC | 0, 0 | 1109 | TC3 | TC | | | RETURN WILL BE RET1 | 1110 |
| 1106 | 2F | RET | 0, 0 | 1110 | | RET | 0 | | | 1111 |
| 1135 | 2E | RET | 1, 0 | 1111 | | RET | 1 | | FOR DLR RET0 = HAND | 1112 |
| 1117 | 02 | TC | 0, 0 | 1112 | TC1 | TC | | | RET1 = NO NU CD | 1113 |
| 1140 | F5 | TRA | 1,10 | 1113 | | TRA | 1,OVRZRO | | | 1114 |
| 1120 | 2E | RET | 1, 0 | 1114 | | RET | 1 | | | 1115 |
| 1110 | 50 | LDA | 0, 0 | 1115 | OVRZRO | LDA | 0 | | | 1116 |
| 1137 | 58 | EXC | 0, 2 | 1116 | | EXC | 0,-1 | | | |
| 1150 | 00 | NOP | 0, 0 | 1117 | | NOP | | | | 1119 |
| 1157 | 50 | LDA | 0, 0 | 1118 | | LDA | 0 | TOT TO A | | 1119 |
| 1160 | 6F | ADX | 15, 0 | 1119 | | ADX | 15 | | | 1120 |
| 1130 | 2E | RET | 1, 0 | 1120 | | RET | 1 | | DLR STANDS ON | 1121 |
| 1147 | 2F | RET | 0, 0 | 1121 | | RET | 0 | | | 1122 |
| 1123 | 50 | LDA | 0, 0 | 1122 | TC2 | LDA | 0 | | SOFT 17 | 1123 |
| 1111 | 58 | EXC | 0, 2 | 1123 | | EXC | 0,-1 | | | 1124 |
| 1105 | 00 | NOP | 0, 0 | 1124 | | NOP | | | | 1125 |
| 1134 | 50 | LDA | 0, 0 | 1125 | | LDA | 0 | TOT TO A | | 1126 |
| 1149 | 02 | TC | 0, 0 | 1126 | | TC | | | | 1127 |
| 1156 | E5 | TRA | 1,26 | 1127 | | TRA | 1,OVR6 | | | 1128 |
| 1128 | 64 | ADX | 4, 0 | 1128 | OVR11 | ADX | 4 | | | 1129 |
| 1114 | F3 | TRA | 1,12 | 1129 | | TRA | 1,TC3 | | | 1130 |
| 1139 | 4A | LAX | 10, 0 | 1130 | | LAX | 10 | ADD 10 | | 1131 |
| 1119 | 05 | RSC | 0, 0 | 1131 | | RSC | | | | 1132 |
| 1109 | 7C | ADD | 1, 0 | 1132 | | ADD | 1 | | | 1133 |
| 1136 | 54 | EXC | 0, 1 | 1133 | | EXC | 0,+1 | | | 1134 |
| 1118 | 02 | TC | 0, 0 | 1134 | | TC | | | | 1135 |
| 1141 | 21 | SM | 2, 0 | 1135 | | SM | 2 | S 16 | | |

TABLE III

| ADDR. | CODE | | | STMT. | | | | | |
|---|---|---|---|---|---|---|---|---|---|
| 1152 | 2E | RET | 1, 0 | 1136 | | RET | 1 | | 1136 |
| 1126 | 69 | ADX | 9, 0 | 1137 | OVR6 | ADX | 9 | | 1137 |
| 1145 | C4 | TRA | 1,59 | 1138 | | TRA | 1,OVR6X | | 1138 |
| 1154 | 2F | RET | 0, 0 | 1139 | | RET | 0 | | 1139 |
| 1159 | 50 | LDA | 0, 0 | 1140 | OVR6X | LDA | 0 | | 1140 |
| 1129 | E3 | TRA | 1,28 | 1141 | | TRA | 1,OVR11 | | 1141 |
| 1146 | 05 | RSC | 0, 0 | 1142 | ADPSX | RSC | | | 1142 |
| 1155 | 6F | ADX | 15, 0 | 1143 | | ADX | 15 | | 1143 |
| 1127 | 76 | ATB | 0, 0 | 1144 | | ATB | | | 1144 |
| 1113 | 79 | HTA | 0, 0 | 1145 | | HTA | | | 1145 |
| 1138 | 7C | ADD | 1, 0 | 1146 | | ADD | 1 | | 1146 |
| 1151 | 75 | ATH | 0, 0 | 1147 | | ATH | | | 1147 |
| 1125 | 54 | EXC | 0, 1 | 1148 | | EXC | 0,+1 | | 1148 |
| 1144 | 02 | TC | 0, 0 | 1149 | | TC | | | 1149 |
| 1122 | C0 | TRA | 1,63 | 1150 | | TRA | 1,TESTXT | | 1150 |
| 1143 | 29 | TM | 2, 0 | 1151 | | TM | 2 | | 1151 |
| 1121 | CA | TRA | 1,53 | 1152 | | TRA | 1,*+2 | | 1152 |
| 1142 | 2F | RET | 0, 0 | 1153 | | RET | 0 | UNDER 22 | 1153 |
| 1153 | 79 | HTA | 0, 0 | 1154 | TST5 | HTA | | | 1154 |
| 1158 | 6A | ADX | 10, 0 | 1155 | | ADX | 10 | | 1155 |
| 1161 | 22 | SM | 4, 0 | 1156 | | SM | 4 | BUST | 1156 |
| 1162 | 2F | RET | 0, 0 | 1157 | | RET | 0 | UNDER 22 | 1157 |
| 1163 | 29 | TM | 2, 0 | 1158 | TESTXT | TM | 2 | | 1158 |
| 1131 | 22 | SM | 4, 0 | 1159 | | SM | 4 | | 1159 |
| 1115 | 21 | SM | 2, 0 | 1160 | | SM | 2 | | 1160 |
| 1107 | CA | TRA | 1,53 | 1161 | | TRA | 1,TST5 | | 1161 |

TABLE IXA

```
ADDR.   CODE                                                                  1200
                                         ORG     1200
1200  40  LAX    0, 0  1200  M1TON  LAX     0                                 1200
1232  41  LAX    1, 0  1201  M2TON  LAX     1                                 1201
1216  43  LAX    3, 0  1202  M4TON  LAX     3                                 1202
1208  2D  RSB7   0, 0  1203        RSB7                                       1203
1204  AD  TRA    0,18  1204        TRA     0,SETPM                            1204
1202  E7  TRA    1,24  1205        TRA     1,PLX                              1205
1233  41  LAX    1, 0  1206  P2TON  LAX     1                                 1206
1248  42  LAX    2, 0  1207  P3TON  LAX     2                                 1207
1224  2D  RSB7   0, 0  1208  PLX    RSB7                                       1208
1212  75  ATH    0, 0  1209        ATH                                        1209
1206  12  LB     2, 8  1210        LB      2,8                                1210
1235  27  RSM    8, 0  1211        RSM     8            R  WS                 1211
1217  A3  TRA    0,28  1212        TRA     0,SWAPKW     RET TO K              1212
1240  17  LB     3, 9  1213        LB      3,9                                1213
1220  B1  TRA    0,14  1214        TRA     0,SWAP2X     SWAP T 7              1214
1210  35  TL    10, 0  1215  FAD    TL                                         1215
1237  FF  TRA    1, 0  1216        TRA     1,ADD                              1216
1250  79  HTA    0, 0  1217  ADDRET HTA                                       1217
1257  2D  RSB7   0, 0  1218        RSB7                                       1218
1260  6F  ADX   15, 0  1219        ADX     15                                 1219
1230  D8  TRA    1,39  1220        TRA     1,TFAD                             1220
1247  1F  LB     3,11  1221        LB      8                                  1221
1223  24  RSM    1, 0  1222        RSM     1            R  PM                 1222
1211  A3  TRA    0,28  1223        TRA     0,SWAPKW     RET TO W              1223
1205  B6  TRA    0, 9  1224        TRA     0,SWAPKZ     TOT TO K              1224
1234  33  TL    12, 0  1225        TL                                         1225
1249  80  TRA    0,63  1226        TRA     0,KTOT       TOTAL  TO  T          1226
1256  0D  LB     1, 7  1227        LB      1,7                                1227
1228  2C  SB7    0, 0  1228        SB7                                        1228
1214  2F  RET    0, 0  1229        RET     0                                  1229
1239  75  ATH    0, 0  1230  TFAD   ATH                                       1230
1219  F5  TRA    1,10  1231        TRA     1,FAD                              1231
1209  45  LAX    5, 0  1232  CMPRS  LAX     5                                 1232
1236  43  LAX    3, 0  1233  CMPRP  LAX     3                                 1233
1218  78  ATB    0, 0  1234        ATB                                        1234
1241  2A  TM     4, 0  1235        TM      4            TEST HB               1235
```

TABLE III

| ADDR. | CODE | | | SIMT. | | | | | | |
|---|---|---|---|---|---|---|---|---|---|---|
| 1252 | 2F | RET | 0, 0 | 1236 | | RET | 0 | PLR BUST | | 1236 |
| 1226 | 29 | TM | 2, 0 | 1237 | | TM | 2 | TEST 16 | | 1237 |
| 1245 | C4 | TRA | 1,59 | 1238 | | TRA | 1,*+2 | | | 1238 |
| 1254 | 2F | RET | 0, 0 | 1239 | | RET | 0 | UNDER 16 | | 1239 |
| 1259 | 50 | LDA | 0, 0 | 1240 | | LDA | 0 | | | 1240 |
| 1229 | 58 | EXC | 0, 2 | 1241 | | EXC | 0,-1 | PT TO TOTAL | | 1241 |
| 1246 | 79 | HTA | 0, 0 | 1242 | | HTA | | | | 1242 |
| 1255 | 05 | RSC | 0, 0 | 1243 | | RSC | | | RET 0 = DLR WINS | 1243 |
| 1227 | 7F | TAM | 0, 0 | 1244 | | TAM | | | | 1244 |
| 1213 | E6 | TRA | 1,25 | 1245 | | TRA | 1,CMP | | RET 1 C = 0 PLR WINS | 1245 |
| 1238 | 06 | SC | 0, 0 | 1246 | | SC | | | | 1246 |
| 1251 | 2E | RET | 1, 0 | 1247 | | RET | 1 | TIE | RET 1 C = 1 = TIE | 1247 |
| 1225 | 50 | LDA | 0, 0 | 1248 | CMP | LDA | 0 | | | 1248 |
| 1244 | 77 | COMP | 0, 0 | 1249 | | COMP | | | | 1249 |
| 1222 | 5C | EXC | 0, 0 | 1250 | | EXC | 0,0 | | | 1250 |
| 1243 | 06 | SC | 0, 0 | 1251 | | SC | | | | 1251 |
| 1221 | 79 | HTA | 0, 0 | 1252 | | HTA | | | | 1252 |
| 1242 | 70 | ADD | 1, 1 | 1253 | | ADD | 1,1 | | | 1253 |
| 1253 | 2E | RET | 1, 0 | 1254 | | RET | 1 | PLR WIN | | 1254 |
| 1258 | 2F | RET | 0, 0 | 1255 | | RET | 0 | DLR WIN | | 1255 |
| 1261 | 16 | LB | 2, 9 | 1256 | WTOZ | LB | 2,9 | | | 1256 |
| 1262 | 15 | LB | 1, 9 | 1257 | ZTOW | LB | 1,9 | | | 1257 |
| 1263 | 14 | LB | 0, 9 | 1258 | KTOT | LB | 0,9 | | | 1258 |
| 1231 | 17 | LB | 3, 9 | 1259 | TTOK | LB | 3,9 | | | 1259 |
| 1215 | 53 | LDA | 3, 0 | 1260 | SWAPX3 | LDA | 3 | | | 1260 |
| 1207 | 58 | EXC | 3, 2 | 1261 | | EXC | 3,-1 | | | 1261 |
| 1203 | F0 | TRA | 1,15 | 1262 | | TRA | 1,*-2 | | | 1262 |
| 1201 | 2F | RET | 0, 0 | 1263 | | RET | 0 | | | 1263 |

TABLE III

| ADDR. | CODE | | | STMT. | | | | | |
|---|---|---|---|---|---|---|---|---|---|
| | | | | | | ORG | 1300 | | |
| 1300 | B7 | TRA | 0, 8 | 1300 | MD1 | TRA | 0,0TOZ | | |
| 1332 | 89 | TRA | 0,54 | 1301 | | TRA | 0,LDK10 | | |
| 1316 | 84 | TRA | 0,59 | 1302 | | TRA | 0,LDK11 | 0 TO K 11 | 1302 |
| 1308 | B6 | TRA | 0,57 | 1303 | | TRA | 0,LKS | | 1303 |
| 1304 | 12 | LB | 2, 8 | 1304 | | LB | 2,8 | WS | 1304 |
| 1302 | 97 | TRA | 0,40 | 1305 | | TRA | 0,ADDX | | 1305 |
| 1333 | 18 | LB | 3,10 | 1306 | | LB | MC | | 1306 |
| 1348 | 06 | SC | 0, 0 | 1307 | | SC | | | 1307 |
| 1324 | 28 | TM | 1, 0 | 1308 | | TM | 1 | TEST.M | 1308 |
| 1312 | 05 | RSC | 0, 0 | 1309 | | RSC | | | 1309 |
| 1306 | BD | TRA | 0,50 | 1310 | MD1X | TRA | 0,LKE | | 1310 |
| 1335 | 16 | LB | 2, 9 | 1311 | | LB | 2,9 | | 1311 |
| 1317 | 02 | TC | 0, 0 | 1312 | | TC | | | 1312 |
| 1340 | 77 | COMP | 0, 0 | 1313 | | COMP | | | 1313 |
| 1320 | 7C | ADD | 1, 0 | 1314 | | ADD | 1,0 | | 1314 |
| 1310 | 5C | EXC | 0, 0 | 1315 | | EXC | 0,0 | | 1315 |
| 1337 | 02 | TC | 0, 0 | 1316 | | TC | | | 1316 |
| 1350 | AB | TRA | 0,20 | 1317 | | TRA | 0,ZEP1 | | 1317 |
| 1357 | 1B | LB | 3,10 | 1318 | | LB | MC | | 1318 |
| 1360 | 28 | TM | 1, 0 | 1319 | | TM | 1 | T M | 1319 |
| 1330 | CE | TRA | 1,49 | 1320 | | TRA | 1,MULT | | 1320 |
| 1347 | A4 | TRA | 0,27 | 1321 | | TRA | 0,KREGRZ | | 1321 |
| 1323 | 31 | TL | 14, 0 | 1322 | | TL | | | 1322 |
| 1311 | D2 | TRA | 1,45 | 1323 | | TRA | 1,D10FX | | 1323 |
| 1305 | 0A | LB | 2, 0 | 1324 | DIV1 | LB | 2,0 | | 1324 |
| 1334 | 99 | TRA | 0,38 | 1325 | | TRA | 0,REZ | | 1325 |
| 1349 | 31 | TL | 14, 0 | 1326 | MULT | TL | | | 1326 |
| 1356 | F9 | TRA | 1, 6 | 1327 | | TRA | 1,M1 | | 1327 |
| 1328 | 9C | TRA | 0,35 | 1328 | DIV2 | TRA | 0,ZEM1 | | 1328 |
| 1314 | 9F | TRA | 0,32 | 1329 | DIV4 | TRA | 0,SUBZK | | 1329 |
| 1339 | F8 | TRA | 1, 7 | 1330 | | TRA | 1,DIV5 | | 1330 |
| 1319 | 40 | LAX | 0, 0 | 1331 | | LAX | 0 | | 1331 |
| 1309 | 18 | LB | 0,10 | 1332 | | LB | 0,10 | | 1332 |
| 1336 | 7F | TAM | 0, 0 | 1333 | | TAM | | | 1333 |
| 1318 | F0 | TRA | 1,15 | 1334 | | TRA | 1,DIV5X | | 1334 |
| 1341 | BF | TRA | 0, 0 | 1335 | DIV4X | TRA | 0,ADDZK | | 1335 |

TABLE III

| ADDR. | | CODE | | STMT. | | | | | |
|---|---|---|---|---|---|---|---|---|---|
| 1352 | B3 | TRA | 0,60 | 1336 | | TRA | 0,LZS | | 1336 |
| 1326 | 67 | ADX | 7, 0 | 1337 | | ADX | 7 | | 1337 |
| 1345 | CC | TRA | 1,51 | 1338 | | TRA | 1,DIV8 | | 1338 |
| 1354 | B5 | TRA | 0,10 | 1339 | | TRA | 0,ZSP1 | | 1339 |
| 1359 | 1C | LB | 0,11 | 1340 | DIV7 | LB | 0,11 | | |
| 1329 | BB | TRA | 0, 7 | 1341 | | TRA | 0,ZRO | | |
| 1346 | 0A | LB | 2, 0 | 1342 | | LB | 2,0 | | 1343 |
| 1355 | 87 | TRA | 0,56 | 1343 | | TRA | 0,LFFTX | | 1344 |
| 1327 | BE | TRA | 0,49 | 1344 | | TRA | 0,ZLFFT | | 1345 |
| 1313 | 89 | TRA | 0,54 | 1345 | | TRA | 0,LDK10 | | 1346 |
| 1338 | F1 | TRA | 1,14 | 1346 | | TRA | 1,DIV4 | | 1347 |
| 1351 | 0E | LB | 2, 7 | 1347 | DIV8 | LB | 2,7 | | |
| 1325 | BB | TRA | 0,55 | 1348 | | TRA | 0,ISZERO | | |
| 1344 | CA | TRA | 1,53 | 1349 | | TRA | 1,DIV10 | W7=0 | 1349 |
| 1322 | 0D | LB | 1, 7 | 1350 | DIV8X | LB | 1,7 | | 1350 |
| 1343 | BB | TRA | 0, 4 | 1351 | | TRA | 0,0TO | | 1351 |
| 1321 | 31 | TL | 14, 0 | 1352 | | TL | | | 1352 |
| 1342 | C3 | TRA | 1,60 | 1353 | | TRA | 1,DM1 | | 1353 |
| 1353 | 16 | LB | 2, 9 | 1354 | DIV10 | LB | 2,9 | | 1354 |
| 1358 | 9A | TRA | 0,37 | 1355 | | TRA | 0,PLUS1 | | 1355 |
| 1361 | 7F | TAM | 0, 0 | 1356 | | TAM | | TEST WE =0 | 1356 |
| 1362 | C4 | TRA | 1,59 | 1357 | | TRA | 1,DIV7 | | 1357 |
| 1363 | AB | TRA | 0,20 | 1358 | | TRA | 0,ZFP1 | | 1358 |
| 1331 | C4 | TRA | 1,59 | 1359 | | TRA | 1,DIV7 | | 1359 |
| 1315 | AE | TRA | 0,17 | 1360 | DIV5X | TRA | 0,MINUS1 | | 1360 |
| 1307 | 1C | LB | 0,11 | 1361 | DIV5 | LB | 0,11 | | 1361 |
| 1303 | 9A | TRA | 0,37 | 1362 | | TRA | 0,PLUS1 | | 1362 |
| 1301 | F1 | TRA | 1,14 | 1363 | | TRA | 1,DIV4 | | 1363 |

TABLE III

| ADDR. | CODE | | | STMT. | | | | | |
|---|---|---|---|---|---|---|---|---|---|
| | | | | | | ORG | 1400 | | |
| 1400 | B5 | TRA | 0,10 | 1400 | M2 | TRA | 0,ZSP1 | | 1400 |
| 1432 | 18 | LB | 0,10 | 1401 | M2X | LB | 0,10 | | 1401 |
| 1416 | 5C | EXC | 0, 0 | 1402 | | EXC | 0,0 | | 1402 |
| 1408 | BA | TRA | 0, 5 | 1403 | | TRA | 0,ZRIGHT | | 1403 |
| 1404 | 0E | LB | 2, 7 | 1404 | | LB | 2,7 | | 1404 |
| 1402 | 9D | TRA | 0,34 | 1405 | | TRA | 0,RIGHTX | | 1405 |
| 1433 | B4 | TRA | 0,59 | 1406 | | TRA | 0,LDK11 | | 1406 |
| 1448 | 83 | TRA | 0,60 | 1407 | | TRA | 0,LZS | | 1407 |
| 1424 | 68 | ADX | 8, 0 | 1408 | | ADX | 8 | | 1408 |
| 1412 | E6 | TRA | 1,25 | 1409 | | TRA | 1,GMCHK | | 1409 |
| 1406 | 91 | TRA | 0,46 | 1410 | M1 | TRA | 0,W0ISZ | W0=0 | 1410 |
| 1435 | FF | TRA | 1, 0 | 1411 | | TRA | 1,M2 | W0=1 | 1411 |
| 1417 | 5C | EXC | 0, 0 | 1412 | | EXC | 0,0 | | 1412 |
| 1440 | BF | TRA | 0, 0 | 1413 | | TRA | 0,ADDZK | Z+K | 1413 |
| 1420 | F2 | TRA | 1,13 | 1414 | | TRA | 1,M1X | | 1414 |
| 1410 | F9 | TRA | 1, 6 | 1415 | | TRA | 1,M1 | C=0 | 1415 |
| 1437 | B2 | TRA | 0,13 | 1416 | M3 | TRA | 0,ZREGRZ | | 1416 |
| 1450 | C3 | TRA | 1,60 | 1417 | | TRA | 1,DM1 | | 1417 |
| 1457 | FA | TRA | 1, 5 | 1418 | | TRA | 1,MX2 | | 1418 |
| 1460 | 15 | LB | 1, 9 | 1419 | DM1 | LB | 1,9 | ZE | 1419 |
| 1430 | 28 | TM | 8, 0 | 1420 | | TM | 8 | | 1420 |
| 1447 | C9 | TRA | 1,54 | 1421 | | TRA | 1,D10F | | 1421 |
| 1423 | 83 | TRA | 0,55 | 1422 | DIV3 | TRA | 0,ISZERO | | 1422 |
| 1411 | D8 | TRA | 1,39 | 1423 | | TRA | 1,DM2 | | 1423 |
| 1405 | 16 | LB | 2, 9 | 1424 | MX2 | LB | 2,9 | WE | 1424 |
| 1434 | 88 | TRA | 0,55 | 1425 | | TRA | 0,ISZERO | | 1425 |
| 1449 | 9C | TRA | 0,35 | 1426 | | TRA | 0,ZFM1 | | 1426 |
| 1456 | 16 | LB | 2, 9 | 1427 | | LB | 2,9 | WE | 1427 |
| 1428 | AE | TRA | 0,17 | 1428 | | TRA | 0,MINUS1 | | 1428 |
| 1414 | DF | TRA | 1,32 | 1429 | | TRA | 1,M2X | | 1429 |
| 1439 | 16 | LB | 2, 9 | 1430 | DM2 | LB | 2,9 | | 1430 |
| 1419 | 88 | TRA | 0,55 | 1431 | | TRA | 0,ISZERO | | 1431 |
| 1409 | CB | TRA | 1,55 | 1432 | | TRA | 1,ENDMD | | 1432 |
| 1436 | 69 | ADX | 9, 0 | 1433 | | ADX | 9 | | 1433 |
| 1418 | FA | TRA | 1, 5 | 1434 | | TRA | 1,MX2 | | 1434 |
| 1441 | 91 | TRA | 0,46 | 1435 | | TRA | 0,W0ISZ | | 1435 |

TABLE III

| ADDR. | CODE | | | STMT. | | | | | |
|---|---|---|---|---|---|---|---|---|---|
| 1452 | FA | TRA | 1, 5 | 1436 | | TRA | 1,MX2 | | 1436 |
| 1426 | C8 | TRA | 1,55 | 1437 | | TRA | 1,ENDMD | | 1437 |
| 1445 | A3 | TRA | 0,28 | 1438 | D10FX | TRA | 0,SWAPKW | | 1438 |
| 1454 | 96 | TRA | 0,41 | 1439 | D10F | TRA | 0,SETOF | | 1439 |
| 1459 | 40 | LAX | 0, 0 | 1440 | ENDGM | LAX | 0 | | 1440 |
| 1429 | 16 | LB | 2, 9 | 1441 | | LB | 2,9 | | 1441 |
| 1446 | 5C | EXC | 0, 0 | 1442 | | EXC | 0,0 | | 1442 |
| 1455 | B7 | TRA | 0, 8 | 1443 | ENDMD | TRA | 0,0TOZ | | 1443 |
| 1427 | 2F | RET | 0, 0 | 1444 | | RET | 0 | | 1444 |
| 1413 | 18 | LB | 0,10 | 1445 | M1X | LB | 0,10 | | 1445 |
| 1438 | 9A | TRA | 0,37 | 1446 | | TRA | 0,PLUS1 | | 1446 |
| 1451 | F9 | TRA | 1, 6 | 1447 | | TRA | 1,M1 | | 1447 |
| 1425 | 1B | LB | 3,10 | 1448 | GMCHK | LB | MC | | 1448 |
| 1444 | 28 | TM | 8, 0 | 1449 | | TM | 8 | T RN | 1449 |
| 1422 | C4 | TRA | 1,59 | 1450 | | TRA | 1,ENDGM | | 1450 |
| 1443 | CA | TRA | 1,37 | 1451 | | TRA | 1,M3 | | 1451 |
| 1421 | 16 | LB | 2, 9 | 1452 | WTOK | LB | 2,9 | | 1452 |
| 1442 | 14 | LB | 0, 9 | 1453 | KTOW | LB | 0,9 | | 1453 |
| 1453 | 52 | LDA | 2, 0 | 1454 | LDA2 | LDA | 2 | | 1454 |
| 1458 | 5A | EXC | 2, 2 | 1455 | | EXC | 2,-1 | | 1455 |
| 1461 | CA | TRA | 1,53 | 1456 | | TRA | 1,*-2 | | 1456 |
| 1462 | 2F | RET | 0, 0 | 1457 | | RET | 0 | | 1457 |
| 1463 | 14 | LB | 0, 9 | 1458 | KTOZ | LB | 0,9 | | 1458 |
| 1431 | 15 | LB | 1, 9 | 1459 | ZTOK | LB | 1,9 | | 1459 |
| 1415 | 51 | LDA | 1, 0 | 1460 | | LDA | 1 | | 1460 |
| 1407 | 59 | EXC | 1, 2 | 1461 | | EXC | 1,-1 | | 1461 |
| 1403 | F0 | TRA | 1,15 | 1462 | | TRA | 1,*-2 | | 1462 |
| 1401 | 2F | RET | 0, 0 | 1463 | | RET | 0 | | 1463 |

TABLE III

| ADDR. | CODE | | | STMT. | | | | | | |
|---|---|---|---|---|---|---|---|---|---|---|
| | | | | | | ORG | 1500 | | | |
| 1500 | 07 | BTS | 0, 0 | 1500 | PWRON | BTS | | | | 1500 |
| 1532 | 05 | RSC | 0, 0 | 1501 | | RSC | | | | 1501 |
| 1516 | 1F | LB | 3,11 | 1502 | | LB | 3,11 | | | 1502 |
| 1508 | 2C | SB7 | 0, 0 | 1503 | | SB7 | | | | 1503 |
| 1504 | BB | TRA | 0, 4 | 1504 | | TRA | 0,0TO | 0R1 | | 1504 |
| 1502 | 2C | SB7 | 0, 0 | 1505 | | SB7 | | | | 1505 |
| 1533 | 1E | LB | 2,11 | 1506 | | LB | 2,11 | | | 1506 |
| 1548 | BB | TRA | 0, 4 | 1507 | | TRA | 0,0TO | 0W1 | | 1507 |
| 1524 | 2C | SB7 | 0, 0 | 1508 | | SB7 | | | | 1508 |
| 1512 | 1D | LB | 1,11 | 1509 | | LB | 1,11 | | | 1509 |
| 1506 | BB | TRA | 0, 4 | 1510 | | TRA | 0,0TO | 0Z1 | | 1510 |
| 1535 | 2C | SB7 | 0, 0 | 1511 | | SB7 | | | | 1511 |
| 1517 | 1C | LB | 0,11 | 1512 | | LB | 0,11 | | | 1512 |
| 1540 | BB | TRA | 0, 4 | 1513 | | TRA | 0,0TO | 0K1 | | 1513 |
| 1520 | 1C | LB | 0,11 | 1514 | | LB | 0,11 | | | 1514 |
| 1510 | BB | TRA | 0, 4 | 1515 | | TRA | 0,0TO | 0K | | 1515 |
| 1537 | 1D | LB | 1,11 | 1516 | | LB | 1,11 | | | 1516 |
| 1550 | BB | TRA | 0, 4 | 1517 | | TRA | 0,0TO | 0Z | | 1517 |
| 1557 | 1E | LB | 2,11 | 1518 | | LB | 2,11 | | | 1518 |
| 1560 | BB | TRA | 0, 4 | 1519 | | TRA | 0,0TO | 0W | | 1519 |
| 1530 | 1F | LB | 3,11 | 1520 | | LB | 3,11 | | | 1520 |
| 1547 | BB | TRA | 0, 4 | 1521 | | TRA | 0,0TO | 0R | | 1521 |
| 1523 | 4C | LAX | 12, 0 | 1522 | | LAX | 12 | | | 1522 |
| 1511 | 76 | ATB | 0, 0 | 1523 | | ATB | | | | 1523 |
| 1505 | 07 | BTS | 0, 0 | 1524 | | BTS | | | | 1524 |
| 1534 | 92 | TRA | 0,45 | 1525 | | TRA | 0,DELAY | | | 1525 |
| 1549 | 04 | TDIN | 1, 0 | 1526 | | TDIN | 1 | | | 1526 |
| 1556 | DB | TRA | 1,36 | 1527 | | TRA | 1,GAME | | | 1527 |
| 1528 | 1F | LB | 3,11 | 1528 | | LB | 8 | | | 1528 |
| 1514 | 23 | SM | 8, 0 | 1529 | | SM | 8 | S | O | 1529 |
| 1539 | 2D | RSB7 | 0, 0 | 1530 | TKS3 | RSB7 | | | | 1530 |
| 1519 | 3E | TL | 1, 0 | 1531 | | TL | | | | 1531 |
| 1509 | DE | TRA | 1,33 | 1532 | | TRA | 1,KS3 | | | 1532 |
| 1536 | 96 | TRA | 0,41 | 1533 | GAME | TRA | 0,SETOF | S | OF | 1533 |
| 1518 | 2C | SB7 | 0, 0 | 1534 | | SB7 | | | | 1534 |
| 1541 | AD | TRA | 0,18 | 1535 | | TRA | 0,SETPM | S | G | 1535 |

TABLE III

| ADDR. | | CODE | | STMT. | | | | | |
|---|---|---|---|---|---|---|---|---|---|
| 1552 | 0F | LB | 3, 7 | 1536 | | LB | 3,7 | | 1536 |
| 1526 | 42 | LAX | 2, 0 | 1537 | | LAX | 2 | | 1537 |
| 1545 | 58 | EXC | 0, 2 | 1538 | | EXC | 0,-1 | | 1538 |
| 1554 | 48 | LAX | 8, 0 | 1539 | | LAX | 8 | | 1539 |
| 1559 | 58 | EXC | 0, 2 | 1540 | | EXC | 0,-1 | | 1540 |
| 1529 | 42 | LAX | 2, 0 | 1541 | | LAX | 2 | | 1541 |
| 1546 | 58 | EXC | 0, 2 | 1542 | | EXC | 0,-1 | | 1542 |
| 1555 | 42 | LAX | 2, 0 | 1543 | | LAX | 2 | | 1543 |
| 1527 | 58 | EXC | 0, 2 | 1544 | | EXC | 0,-1 | | 1544 |
| 1513 | 44 | LAX | 4, 0 | 1545 | | LAX | 4 | | 1545 |
| 1538 | 58 | EXC | 0, 2 | 1546 | | EXC | 0,-1 | | 1546 |
| 1551 | 47 | LAX | 7, 0 | 1547 | | LAX | 7 | | 1547 |
| 1525 | 5C | EXC | 0, 0 | 1548 | | EXC | 0,0 | | 1548 |
| 1544 | 30 | TL | 2, 0 | 1549 | | TL | | | 1549 |
| 1522 | EF | TRA | 1,16 | 1550 | | TRA | 1,RESET | | 1550 |
| 1543 | 11 | LB | 1, 8 | 1551 | SPLITK | LB | SF | | |
| 1521 | 81 | TRA | 0,62 | 1552 | | TRA | 0,TSP | | |
| 1542 | 3E | TL | 1, 0 | 1553 | TKRET2 | TL | | | 1552 |
| 1553 | DD | TRA | 1,34 | 1554 | | TRA | 1,KRET | | 1553 |
| 1558 | 18 | LB | 3,10 | 1555 | | LB | DS | | 1554 |
| 1561 | 28 | TM | 8, 0 | 1556 | | TM | 8 | T HS | 1555 |
| 1562 | D5 | TRA | 1,42 | 1557 | | TRA | 1,TKRET2 | | 1556 |
| 1563 | 23 | SM | 8, 0 | 1558 | | SM | 8 | S HS | 1557 |
| 1531 | 11 | LB | 1, 8 | 1559 | | LB | SF | | 1558 |
| 1515 | 20 | SM | 1, 0 | 1560 | | SM | 1 | S SPLIT | 1559 |
| 1507 | 05 | RSC | 0, 0 | 1561 | | RSC | | | 1560 |
| 1503 | 38 | TL | 7, 0 | 1562 | | TL | | | 1561 |
| 1501 | F1 | TRA | 1,14 | 1563 | | TRA | 1,SPLC | | 1562 |

TABLE III

| ADDR. | CODE | | | STMT. | | | | | |
|---|---|---|---|---|---|---|---|---|---|
| | | | | | | ORG | 1600 | | |
| 1600 | 93 | TRA | 0,44 | 1600 | KON2 | TRA | 0,TG | | 1600 |
| 1632 | 3E | TL | 1, 0 | 1601 | TKRET6 | TL | | | 1601 |
| 1616 | DD | TRA | 1,34 | 1602 | | TRA | 1,KRET | | 1602 |
| 1608 | 20 | RSB7 | 0, 0 | 1603 | | RSB7 | | | 1603 |
| 1604 | 1F | LB | 3,11 | 1604 | | LB | B | | 1604 |
| 1602 | 6D | ADX | 13, 0 | 1605 | KON2X | ADX | 13 | | 1605 |
| 1633 | CE | TRA | 1,49 | 1606 | | TRA | 1,PMK | | 1606 |
| 1648 | 62 | ADX | 2, 0 | 1607 | | ADX | 2 | | 1607 |
| 1624 | F0 | TRA | 1,15 | 1608 | | TRA | 1,TMDK | | 1608 |
| 1612 | 2A | TM | 4, 0 | 1609 | EQK | TM | 4 | T MD | 1609 |
| 1606 | 36 | TL | 9, 0 | 1610 | | TL | | | 1610 |
| 1635 | F2 | TRA | 1,13 | 1611 | | TRA | 1,E1 | | 1611 |
| 1617 | 28 | TM | 8, 0 | 1612 | | TM | 8 | T Q | 1612 |
| 1640 | FA | TRA | 1, 5 | 1613 | | TRA | 1,E5 | | 1613 |
| 1620 | 23 | SM | 8, 0 | 1614 | | SM | 8 | S Q | 1614 |
| 1610 | 1E | LB | 2,11 | 1615 | | LB | ND | | 1615 |
| 1637 | 28 | TM | 8, 0 | 1616 | | TM | 8 | T N | 1616 |
| 1650 | C3 | TRA | 1,60 | 1617 | | TRA | 1,E6 | | 1617 |
| 1657 | A3 | TRA | 0,28 | 1618 | | TRA | 0,SWAPKW | | 1618 |
| 1660 | 35 | TL | 10, 0 | 1619 | E6 | TL | | | 1619 |
| 1630 | BF | TRA | 0, 0 | 1620 | | TRA | 0,ADD | | 1620 |
| 1647 | B6 | TRA | 0, 9 | 1621 | | TRA | 0,SWAPKZ | | 1621 |
| 1623 | 36 | TL | 9, 0 | 1622 | | TL | | | 1622 |
| 1611 | C5 | TRA | 1,58 | 1623 | | TRA | 1,RND | | 1623 |
| 1605 | B6 | TRA | 0, 9 | 1624 | E5 | TRA | 0,SWAPKZ | | 1624 |
| 1634 | C3 | TRA | 1,60 | 1625 | | TRA | 1,E6 | | 1625 |
| 1649 | 28 | TM | 8, 0 | 1626 | PMK | TM | 8 | T Q | 1626 |
| 1656 | CC | TRA | 1,51 | 1627 | | TRA | 1,P1 | | 1627 |
| 1628 | 2A | TM | 4, 0 | 1628 | | TM | 4 | | 1628 |
| 1614 | E9 | TRA | 1,22 | 1629 | | TRA | 1,P3 | | 1629 |
| 1639 | 1F | LB | 2,11 | 1630 | | LB | ND | | 1630 |
| 1619 | 28 | TM | 8, 0 | 1631 | | TM | 8 | T N | 1631 |
| 1609 | ED | TRA | 1,18 | 1632 | | TRA | 1,P4 | | 1632 |
| 1636 | A3 | TRA | 0,28 | 1633 | | TRA | 0,SWAPKW | | 1633 |
| 1618 | 35 | TL | 10, 0 | 1634 | P4 | TL | | | 1634 |
| 1641 | BF | TRA | 0, 0 | 1635 | | TRA | 0,ADD | | 1635 |

TABLE III

```
ADDR.    CODE          STMT.
1652  31  TL    14, 0   1636  P2     TL
1626  95  TRA    0,42   1637         TRA    0,KTOW
1645  31  TL    14, 0   1638  P7     TL
1654  A0  TRA    0,31   1639         TRA    0,ZTOK
1659  1F  LB     3,11   1640  P6     LB     B
1629  B8  TRA    0, 7   1641         TRA    0,ZRO
1646  1D  LB     1,11   1642         LB     VD
1655  2A  TM     4, 0   1643         TM     4          MIN = 0100  PLUS =  0011
1627  AD  TRA    0,18   1644         TRA    0,SETPM
1613  36  TL     9, 0   1645         TL
1638  C5  TRA    1,58   1646         TRA    1,RND
1651  31  TL    14, 0   1647  P1     TL
1625  80  TRA    0,63   1648         TRA    0,KTOZ
1644  CB  TRA    1,52   1649         TRA    1,P2
1622  1E  LB     2,11   1650  P3     LB     ND
1643  28  TM     8, 0   1651         TM     8          T N
1621  CA  TRA    1,53   1652         TRA    1,P5
1642  86  TRA    0, 9   1653         TRA    0,SWAPKZ
1653  32  TL    13, 0   1654  P5     TL
1658  BF  TRA    0, 0   1655         TRA    0,MD1
1661  A3  TRA    0,28   1656         TRA    0,SWAPKW
1662  31  TL    14, 0   1657         TL
1663  80  TRA    0,63   1658         TRA    0,KTOZ
1631  C4  TRA    1,59   1659         TRA    1,P6
1615  00  NOP    0, 0   1660  TMDK   NOP
1607  3E  TL     1, 0   1661         TL
1603  FF  TRA    1, 0   1662         TRA    1,MDK
```

TABLE III

| ADDR. | CODE | | | STMT. | | | | | |
|---|---|---|---|---|---|---|---|---|---|
| | | | | | | ORG | 1700 | | |
| 1700 | 28 | TM | 8, 0 | 1700 | MDK | TM | 8 | T Q | 1700 |
| 1732 | E8 | TRA | 1,23 | 1701 | | TRA | 1,MK1 | | 1701 |
| 1716 | 2A | TM | 4, 0 | 1702 | | TM | 4 | T MD | 1702 |
| 1708 | F1 | TRA | 1,14 | 1703 | | TRA | 1,MK3 | | 1703 |
| 1704 | 1E | LB | 2,11 | 1704 | | LB | ND | | 1704 |
| 1702 | 28 | TM | 8, 0 | 1705 | | TM | 8 | T N | 1705 |
| 1733 | E7 | TRA | 1,24 | 1706 | | TRA | 1,MK5 | | 1706 |
| 1748 | A3 | TRA | 0,28 | 1707 | | TRA | 0,SWAPKW | | 1707 |
| 1724 | 35 | TL | 10, 0 | 1708 | MK5 | TL | | | 1708 |
| 1712 | BF | TRA | 0, 0 | 1709 | | TRA | 0,ADD | | 1709 |
| 1706 | B6 | TRA | 0, 9 | 1710 | | TRA | 0,SWAPKZ | | 1710 |
| 1735 | 31 | TL | 14, 0 | 1711 | | TL | | | 1711 |
| 1717 | 95 | TRA | 0,42 | 1712 | | TRA | 0,KTOW | | 1712 |
| 1740 | 1F | LB | 3,11 | 1713 | MK6 | LB | B | | 1713 |
| 1720 | 44 | LAX | 4, 0 | 1714 | | LAX | 4 | | 1714 |
| 1710 | BC | TRA | 0, 3 | 1715 | | TRA | 0,TEXCX | | 1715 |
| 1737 | 24 | RSM | 1, 0 | 1716 | | RSM | 1 | R M | 1716 |
| 1750 | 1D | LB | 1,11 | 1717 | | LB | VD | | 1717 |
| 1757 | 28 | TM | 1, 0 | 1718 | | TM | 1 | DIV = 0010 MULT = 0001 | 1718 |
| 1760 | 89 | TRA | 0,52 | 1719 | | TRA | 0,SETM | | 1719 |
| 1730 | 36 | TL | 9, 0 | 1720 | | TL | | | 1720 |
| 1747 | C5 | TRA | 1,58 | 1721 | | TRA | 1,RND | | 1721 |
| 1723 | 31 | TL | 14, 0 | 1722 | MK1 | TL | | | 1722 |
| 1711 | 95 | TRA | 0,42 | 1723 | | TRA | 0,KTOW | | 1723 |
| 1705 | 31 | TL | 14, 0 | 1724 | MK2 | TL | | | 1724 |
| 1734 | 80 | TRA | 0,63 | 1725 | | TRA | 0,KTOZ | | 1725 |
| 1749 | 31 | TL | 14, 0 | 1726 | | TL | | | 1726 |
| 1756 | AA | TRA | 0,21 | 1727 | | TRA | 0,WTOK | | 1727 |
| 1728 | D7 | TRA | 1,40 | 1728 | — | TRA | 1,MK6 | | 1728 |
| 1714 | 1E | LB | 2,11 | 1729 | MK3 | LB | ND | | 1729 |
| 1739 | 28 | TM | 8, 0 | 1730 | | TM | 8 | T N | 1730 |
| 1719 | DB | TRA | 1,36 | 1731 | | TRA | 1,MK4 | | 1731 |
| 1709 | B6 | TRA | 0, 9 | 1732 | | TRA | 0,SWAPKZ | | 1732 |
| 1736 | 32 | TL | 13, 0 | 1733 | MK4 | TL | | | 1733 |
| 1718 | BF | TRA | 0, 0 | 1734 | | TRA | 0,MD1 | | 1734 |
| 1741 | FA | TRA | 1, 5 | 1735 | | TRA | 1,MK2 | | 1735 |

TABLE III

| ADDR. | | CODE | | STMT. | | | | | |
|---|---|---|---|---|---|---|---|---|---|
| 1752 | 61 | ADX | 1, 0 | 1736 | KDN2C | ADX | 1 | | 1736 |
| 1726 | 4E | LAX | 14, 0 | 1737 | | LAX | 14 | | 1737 |
| 1745 | 19 | LB | 1,10 | 1738 | | LB | KI | | 1738 |
| 1754 | 28 | TM | 8, 0 | 1739 | | TM | 8 | T DI | 1739 |
| 1759 | 40 | LAX | 0, 0 | 1740 | | LAX | 0 | | 1740 |
| 1729 | 1A | LB | 2,10 | 1741 | | LB | LS | | 1741 |
| 1746 | 7E | ADD | 0, 0 | 1742 | | ADD | | | 1742 |
| 1755 | 75 | ATH | 0, 0 | 1743 | | ATH | | MKC TO H | 1743 |
| 1727 | 53 | LDA | 3, 0 | 1744 | | LDA | 3 | | 1744 |
| 1713 | 6D | ADX | 13, 0 | 1745 | | ADX | 13 | | 1745 |
| 1738 | 22 | SM | 4, 0 | 1746 | | SM | 4 | S CF | 1746 |
| 1751 | 79 | HTA | 0, 0 | 1747 | | HTA | | | 1747 |
| 1725 | 1D | LB | 1,11 | 1748 | | LB | VD | | 1748 |
| 1744 | 5C | EXC | 0, 0 | 1749 | | EXC | 0,0 | MKC TO VD | 1749 |
| 1722 | 79 | HTA | 0, 0 | 1750 | | HTA | | | 1750 |
| 1743 | 00 | NOP | 0, 0 | 1751 | | NOP | | | 1751 |
| 1721 | 3C | TL | 3, 0 | 1752 | | TL | | | 1752 |
| 1742 | FF | TRA | 1, 0 | 1753 | | TRA | 1,KEYON | | 1753 |
| 1753 | 6A | ADX | 10, 0 | 1754 | TSHUFL | ADX | 10 | SHUFFLES IF 38 CARDS HAVE BEEN DEALT | 1754 |
| 1758 | C0 | TRA | 1,63 | 1755 | | TRA | 1,SHUFL. | | 1755 |
| 1761 | 3E | TL | 1, 0 | 1756 | TKRET9 | TL | | | 1756 |
| 1762 | DD | TRA | 1,34 | 1757 | | TRA | 1,KRET | | 1757 |
| 1763 | BB | TRA | 0, 4 | 1758 | SHUFL | TRA | 0,0TO | 0 C | 1758 |
| 1731 | 2C | SB7 | 0, 0 | 1759 | | SB7 | | | 1759 |
| 1715 | 1D | LB | 1,11 | 1760 | | LB | 1,11 | | 1760 |
| 1707 | BB | TRA | 0, 4 | 1761 | | TRA | 0,0TO | 0 S | 1761 |
| 1703 | 96 | TRA | 0,41 | 1762 | | TRA | 0,SETOF | | 1762 |
| 1701 | C2 | TRA | 1,61 | 1763 | | TRA | 1,TKRET9 | | 1763 |

TABLE III

| ADDR. | CODE | | | STMT. | | | | | |
|---|---|---|---|---|---|---|---|---|---|
| | | | | | | ORG | 1800 | | |
| 1800 | 78 | READ | 0, 0 | 1800 | KDN1 | READ | 0 | | 1800 |
| 1832 | 04 | TDIN | 1, 0 | 1801 | | TDIN | 1 | | 1801 |
| 1816 | 23 | SM | 8, 0 | 1802 | | SM | 8 | S DI | 1802 |
| 1608 | 75 | ATH | 0, 0 | 1803 | | ATH | | | 1803 |
| 1804 | 89 | TRA | 0,54 | 1804 | KDN1X | TRA | 0,LDK10 | KC TO K10 | 1804 |
| 1802 | 7F | TAM | 0, 0 | 1805 | | TAM | | | 1805 |
| 1833 | 41 | LAX | 1, 0 | 1806 | | LAX | 1 | | 1806 |
| 1848 | 7F | TAM | 0, 0 | 1807 | | TAM | | | 1807 |
| 1824 | 42 | LAX | 2, 0 | 1808 | | LAX | 2 | | 1808 |
| 1612 | 7F | TAM | 0, 0 | 1809 | | TAM | | | 1809 |
| 1806 | 44 | LAX | 4, 0 | 1810 | | LAX | 4 | | 1810 |
| 1835 | 7F | TAM | 0, 0 | 1811 | | TAM | | | 1811 |
| 1817 | 48 | LAX | 8, 0 | 1812 | | LAX | 8 | | 1812 |
| 1640 | 7F | TAM | 0, 0 | 1813 | | TAM | | | 1813 |
| 1820 | C2 | TRA | 1,61 | 1814 | | TRA | 1,TKRET8 | | 1814 |
| 1810 | 19 | LB | 1,10 | 1815 | | LB | KI | | 1815 |
| 1837 | 6F | ADX | 15, 0 | 1816 | | ADX | 15 | | 1816 |
| 1650 | D0 | TRA | 1,47 | 1817 | | TRA | 1,KDNX3 | | 1817 |
| 1857 | 28 | TM | 8, 0 | 1818 | | TM | 8 | T DI | 1818 |
| 1860 | F4 | TRA | 1,11 | 1819 | | TRA | 1,KDN2X | | 1819 |
| 1830 | C2 | TRA | 1,61 | 1820 | | TRA | 1,TKRET8 | | 1820 |
| 1847 | 28 | TM | 8, 0 | 1821 | KDNX3 | TM | 8 | T DI | 1821 |
| 1823 | C2 | TRA | 1,61 | 1822 | | TRA | 1,TKRET8 | | 1822 |
| 1811 | 79 | HTA | 0, 0 | 1823 | KDN2X | HTA | | | 1823 |
| 1805 | 68 | ADX | 8, 0 | 1824 | KDN2 | ADX | 8 | | 1824 |
| 1834 | 40 | LAX | 0, 0 | 1825 | | LAX | 0 | | 1825 |
| 1849 | 64 | ADX | 4, 0 | 1826 | | ADX | 4 | | 1826 |
| 1856 | 41 | LAX | 1, 0 | 1827 | | LAX | 1 | | 1827 |
| 1828 | 62 | ADX | 2, 0 | 1828 | | ADX | 2 | | 1828 |
| 1814 | 40 | LAX | 0, 0 | 1829 | | LAX | 0 | | 1829 |
| 1839 | 00 | NOP | 0, 0 | 1830 | | NOP | | | 1830 |
| 1819 | 3E | TL | 1, 0 | 1831 | | TL | | | 1831 |
| 1809 | C8 | TRA | 1,52 | 1832 | | TRA | 1,KDN2C | | 1832 |
| 1836 | 1E | LB | 2,11 | 1833 | N1 | LB | ND | | 1833 |
| 1818 | 28 | TM | 8, 0 | 1834 | | TM | 8 | T N | 1834 |
| 1841 | C0 | TRA | 1,63 | 1835 | | TRA | 1,N2 | | 1835 |

TABLE III

| ADDR. | CODE | | | STMT. | | | | | |
|---|---|---|---|---|---|---|---|---|---|
| 1652 | 23 | SM | 8, 0 | 1836 | | SM | 8 | | 1836 |
| 1826 | AF | TRA | 0,16 | 1837 | | TRA | 0,0TOK | | 1837 |
| 1845 | 1E | LB | 2,11 | 1838 | N3 | LB | ND | | 1838 |
| 1654 | 2A | TM | 4, 0 | 1839 | | TM | 4 | T D | 1839 |
| 1859 | D1 | TRA | 1,46 | 1840 | | TRA | 1,TDP | | 1840 |
| 1829 | EA | TRA | 1,21 | 1841 | | TRA | 1,N5 | | 1841 |
| 1846 | 1D | LB | 1,11 | 1842 | TDP | LB | VD | | 1842 |
| 1855 | 4E | LAX | 14, 0 | 1843 | | LAX | 14 | | 1843 |
| 1827 | 7F | TAM | 0, 0 | 1844 | | TAM | | | 1844 |
| 1813 | CC | TRA | 1,51 | 1845 | | TRA | 1,N4 | | 1845 |
| 1838 | C2 | TRA | 1,61 | 1846 | | TRA | 1,TKRET8 | | 1846 |
| 1851 | 8D | TRA | 0,50 | 1847 | N4 | TRA | 0,LKE | | 1847 |
| 1825 | 69 | ADX | 9, 0 | 1848 | | ADX | 9 | | 1848 |
| 1844 | C2 | TRA | 1,61 | 1849 | | TRA | 1,TKRET8 | | 1849 |
| 1822 | 14 | LB | 0, 9 | 1850 | | LB | 0,9 | | 1850 |
| 1843 | 9A | TRA | 0,37 | 1851 | | TRA | 0,PLUS1 | KE PLUS 1 | 1851 |
| 1821 | 1D | LB | 1,11 | 1852 | N5 | LB | VD | | 1852 |
| 1842 | 50 | LDA | 0, 0 | 1853 | | LDA | 0 | | 1853 |
| 1653 | 08 | LB | 0, 0 | 1854 | | LB | 0,0 | | 1854 |
| 1858 | 87 | TRA | 0,56 | 1855 | | TRA | 0,LEFTX | | 1855 |
| 1861 | 3E | TL | 1, 0 | 1856 | TKRET8 | TL | | | 1856 |
| 1862 | DD | TRA | 1,34 | 1857 | | TRA | 1,KRET | | 1857 |
| 1863 | 0C | LB | 0, 7 | 1858 | N2 | LB | 0,7 | | 1858 |
| 1831 | 88 | TRA | 0,55 | 1859 | | TRA | 0,ISZERO | | 1859 |
| 1815 | D2 | TRA | 1,45 | 1860 | | TRA | 1,N3 | | 1860 |
| 1607 | C2 | TRA | 1,61 | 1861 | | TRA | 1,TKRET8 | | 1861 |

TABLE III

| ADDR. | CODE | | | STMT. | | | | | |
|---|---|---|---|---|---|---|---|---|---|
| | | | | | | ORG | 1900 | | |
| 1900 | 1E | LB | 2,11 | 1900 | KEYON | LB | ND | | 1900 |
| 1932 | 28 | TM | 1, 0 | 1901 | | TM | 1 | T OF | 1901 |
| 1916 | E1 | TRA | 1,30 | 1902 | | TRA | 1,KON1 | | 1902 |
| 1908 | 25 | RSM | 2, 0 | 1903 | | RSM | 2 | R M | 1903 |
| 1904 | 19 | LB | 1,10 | 1904 | | LB | KI | | 1904 |
| 1902 | 28 | TM | 8, 0 | 1905 | | TM | 8 | | 1905 |
| 1933 | DD | TRA | 1,34 | 1906 | | TRA | 1,TKON2 | | 1906 |
| 1948 | 2A | TM | 4, 0 | 1907 | | TM | 4 | | 1907 |
| 1924 | E3 | TRA | 1,28 | 1908 | | TRA | 1,KON4 | | 1908 |
| 1912 | 82 | TRA | 0,61 | 1909 | KON3X | TRA | 0,TD3 | | 1909 |
| 1906 | EE | TRA | 1,17 | 1910 | | TRA | 1,*+2 | | 1910 |
| 1935 | F4 | TRA | 1,11 | 1911 | | TRA | 1,TKRET4 | | 1911 |
| 1917 | 2D | RSB7 | 0, 0 | 1912 | | RSB7 | | | 1912 |
| 1940 | 61 | ADX | 1, 0 | 1913 | KON3 | ADX | 1 | | 1913 |
| 1920 | DD | TRA | 1,47 | 1914 | | TRA | 1,TCEK | | 1914 |
| 1910 | 61 | ADX | 1, 0 | 1915 | | ADX | 1 | | 1915 |
| 1937 | CA | TRA | 1,53 | 1916 | | TRA | 1,DPCK | | 1916 |
| 1950 | 00 | NOP | 0, 0 | 1917 | TN1 | NOP | | | 1917 |
| 1957 | 3D | TL | 2, 0 | 1918 | | TL | | | 1918 |
| 1960 | DB | TRA | 1,36 | 1919 | | TRA | 1,N1 | | 1919 |
| 1930 | 61 | ADX | 1, 0 | 1920 | KON1 | ADX | 1 | | 1920 |
| 1947 | 36 | TL | 9, 0 | 1921 | TCEK | TL | | | 1921 |
| 1923 | FA | TRA | 1, 5 | 1922 | | TRA | 1,CEK | | 1922 |
| 1911 | 3E | TL | 1, 0 | 1923 | TKRET4 | TL | | | 1923 |
| 1905 | DD | TRA | 1,34 | 1924 | | TRA | 1,KRET | | 1924 |
| 1934 | 00 | NOP | 0, 0 | 1925 | TKON2 | NOP | | | 1925 |
| 1949 | 3F | TL | 0, 0 | 1926 | | TL | | | 1926 |
| 1956 | FF | TRA | 1, 0 | 1927 | | TRA | 1,KON2 | | 1927 |
| 1928 | 93 | TRA | 0,44 | 1928 | KON4 | TRA | 0,TG | | 1928 |
| 1914 | EC | TRA | 1,19 | 1929 | | TRA | 1,*+2 | | 1929 |
| 1939 | F4 | TRA | 1,11 | 1930 | | TRA | 1,TKRET4 | | 1930 |
| 1919 | 65 | ADX | 5, 0 | 1931 | | ADX | 5 | | 1931 |
| 1909 | 3C | TL | 3, 0 | 1932 | | TL | | | 1932 |
| 1936 | EE | TRA | 1,17 | 1933 | | TRA | 1,HITK | | 1933 |
| 1918 | 61 | ADX | 1, 0 | 1934 | | ADX | 1 | | 1934 |
| 1941 | 3A | TL | 5, 0 | 1935 | | TL | | | 1935 |

TABLE III

| ADDR. | CODE | | | STMT. | | | | | |
|---|---|---|---|---|---|---|---|---|---|
| 1952 | EE | TRA | 1,17 | 1936 | | TRA | 1,INSK | | 1936 |
| 1926 | 62 | ADX | 2, 0 | 1937 | | ADX | 2 | | 1937 |
| 1945 | 30 | TL | 15, 0 | 1938 | | TL | | | 1938 |
| 1954 | D4 | TRA | 1,43 | 1939 | | TRA | 1,SPLITK | | 1939 |
| 1959 | 61 | ADX | 1, 0 | 1940 | | ADX | 1 | | 1940 |
| 1929 | 30 | TL | 2, 0 | 1941 | | TL | | | 1941 |
| 1946 | FF | TRA | 1, 0 | 1942 | | TRA | 1,PLAYK | | 1942 |
| 1955 | 62 | ADX | 2, 0 | 1943 | KON4C | ADX | 2 | | 1943 |
| 1927 | 37 | TL | 8, 0 | 1944 | | TL | | | 1944 |
| 1913 | E4 | TRA | 1,27 | 1945 | | TRA | 1,STANDK | | 1945 |
| 1938 | 61 | ADX | 1, 0 | 1946 | | ADX | 1 | | 1946 |
| 1951 | 3C | TL | 3, 0 | 1947 | | TL | | | 1947 |
| 1925 | CB | TRA | 1,52 | 1948 | | TRA | 1,BETK | | 1948 |
| 1944 | 62 | ADX | 2, 0 | 1949 | | ADX | 2 | | 1949 |
| 1922 | 3C | TL | 3, 0 | 1950 | | TL | | | 1950 |
| 1943 | FF | TRA | 1, 0 | 1951 | | TRA | 1,DBLK | | 1951 |
| 1921 | 3C | TL | 3, 0 | 1952 | | TL | | | 1952 |
| 1942 | E1 | TRA | 1,30 | 1953 | | TRA | 1,TOTK | | 1953 |
| 1953 | 93 | TRA | 0,44 | 1954 | DPCK | TRA | 0,TG | | 1954 |
| 1958 | F4 | TRA | 1,11 | 1955 | | TRA | 1,TKRET4 | | 1955 |
| 1961 | 2D | RSB7 | 0, 0 | 1956 | | RSB7 | | | 1956 |
| 1962 | 1E | LB | 2,11 | 1957 | | LB | ND | | 1957 |
| 1963 | 2A | TM | 4, 0 | 1958 | | TM | 4 | T D | 1958 |
| 1931 | F4 | TRA | 1,11 | 1959 | | TRA | 1,TKRET4 | | 1959 |
| 1915 | 22 | SM | 4, 0 | 1960 | | SM | 4 | | 1960 |
| 1907 | 14 | LB | 0, 9 | 1961 | | LB | 0,9 | | 1961 |
| 1903 | B8 | TRA | 0, 7 | 1962 | | TRA | 0,ZRO | 0 KE | 1962 |
| 1901 | CD | TRA | 1,50 | 1963 | | TRA | 1,TN1 | | 1963 |

TABLE III

| ADDR. | CODE | | | STMT. | | | | | |
|---|---|---|---|---|---|---|---|---|---|
| | | | | | | ORG | 2000 | | |
| 2000 | 18 | LB | 0,10 | 2000 | RDLY | LB | 0,10 | | 2000 |
| 2032 | 9A | TRA | 0,37 | 2001 | | TRA | 0,PLUS1 | | 2001 |
| 2016 | 7F | TAM | 0, 0 | 2002 | | TAM | | | 2002 |
| 2008 | DC | TRA | 1,35 | 2003 | | TRA | 1,TKRETD | | 2003 |
| 2004 | 1C | LB | 0,11 | 2004 | | LB | 0,11 | | 2004 |
| 2002 | 9A | TRA | 0,37 | 2005 | | TRA | 0,PLUS1 | | 2005 |
| 2033 | 7F | TAM | 0, 0 | 2006 | | TAM | | | 2006 |
| 2048 | DC | TRA | 1,35 | 2007 | | TRA | 1,TKRETD | | 2007 |
| 2024 | 1D | LB | 1,11 | 2008 | | LB | VD | | 2008 |
| 2012 | 9A | TRA | 0,37 | 2009 | | TRA | 0,PLUS1 | | 2009 |
| 2006 | 7F | TAM | 0, 0 | 2010 | | TAM | | | 2010 |
| 2035 | 3E | TL | 1, 0 | 2011 | TKRETD | TL | | | 2011 |
| 2017 | DD | TRA | 1,34 | 2012 | | TRA | 1,KRET | | 2012 |
| 2040 | 20 | RSB7 | 0, 0 | 2013 | RANDOM | RSB7 | | | 2013 |
| 2020 | 08 | LB | 0, 0 | 2014 | | LB | 0,0 | | 2014 |
| 2010 | 07 | BTS | 0, 0 | 2015 | | BTS | | | 2015 |
| 2037 | 47 | LAX | 7, 0 | 2016 | | LAX | 7 | LOAD K | 2016 |
| 2050 | 54 | EXC | 0, 1 | 2017 | | EXC | 0,+1 | | 2017 |
| 2057 | 49 | LAX | 9, 0 | 2018 | | LAX | 9 | | 2018 |
| 2060 | 54 | EXC | 0, 1 | 2019 | | EXC | 0,+1 | | 2019 |
| 2030 | 48 | LAX | 8, 0 | 2020 | | LAX | 8 | | 2020 |
| 2047 | 54 | EXC | 0, 1 | 2021 | | EXC | 0,+1 | | 2021 |
| 2023 | 48 | LAX | 8, 0 | 2022 | | LAX | 8 | | 2022 |
| 2011 | 54 | EXC | 0, 1 | 2023 | | EXC | 0,+1 | | 2023 |
| 2005 | 46 | LAX | 6, 0 | 2024 | | LAX | 6 | | 2024 |
| 2034 | 54 | EXC | 0, 1 | 2025 | | EXC | 0,+1 | | 2025 |
| 2049 | 43 | LAX | 3, 0 | 2026 | | LAX | 3 | | 2026 |
| 2056 | 54 | EXC | 0, 1 | 2027 | | EXC | 0,+1 | | 2027 |
| 2028 | 40 | LAX | 0, 0 | 2028 | | LAX | 0 | | 2028 |
| 2014 | 54 | EXC | 0, 1 | 2029 | | EXC | 0,+1 | | 2029 |
| 2039 | 41 | LAX | 1, 0 | 2030 | | LAX | 1 | | 2030 |
| 2019 | 5C | EXC | 0, 0 | 2031 | | EXC | 0,0 | | 2031 |
| 2009 | 98 | TRA | 0,39 | 2032 | NEWN | TRA | 0,SWPWR8 | | 2032 |
| 2036 | 8B | TRA | 0,52 | 2033 | | TRA | 0,SETM | | 2033 |
| 2018 | 23 | SM | 8, 0 | 2034 | | SM | 8 | SET RN | 2034 |
| 2041 | 32 | TL | 13, 0 | 2035 | | TL | | | 2035 |

```
ADDR.    CODE          STMT.
2052  BF  TRA   0, 0   2036          TRA    0,MD1                                2036
2026  98  TRA   0,39   2037          TRA    0,SWPWR8                             2037
2045  AF  TRA   0,16   2038          TRA    0,0TOK                               2038
2054  1B  LB    3,10   2039          LB     MC                                   2039
2059  24  RSM   1, 0   2040          RSM    1          RESET M                   2040
2029  27  RSM   8, 0   2041          RSM    8          RESET RN                  2041
2046  2A  TM    4, 0   2042          TM     4                                    2042
2055  D9  TRA   1,38   2043          TRA    1,NUCARD                             2043
2027  3E  TL    1, 0   2044          TL                                          2044
2013  EB  TRA   1,20   2045          TRA    1,RRET                               2045
2038  0F  LB    3, 7   2046  NUCARD  LB     3,7                                  2046
2051  2C  SB7   0, 0   2047          SB7                                         2047
2025  50  LDA   0, 0   2048          LDA    0                                    2048
2044  75  ATH   0, 0   2049          ATH                R7 TO H                   2049
2022  6C  ADX  12, 0   2050          ADX    12                                   2050
2043  F0  TRA   1,15   2051          TRA    1,TR7LG                              2051
2021  46  LAX   6, 0   2052          LAX    6                                    2052
2042  76  ATB   0, 0   2053          ATB                                         2053
2053  50  LDA   0, 0   2054          LDA    0           R6 TO A                  2054
2058  08  LB    0, 0   2055          LB     0,0                                  2055
2061  76  ATB   0, 0   2056          ATB                POINT TO NUMBER           2056
2062  00  NOP   0, 0   2057          NOP                                         2057
2063  3A  TL    5, 0   2058          TL                                          2058
2031  DD  TRA   1,34   2059          TRA    1,TESTR7                             2059
2015  00  NOP   0, 0   2060  TR7LG   NOP                                         2060
2007  3A  TL    5, 0   2061          TL                                          2061
2003  FF  TRA   1, 0   2062          TRA    1,R7LG                               2062
```

TABLE III

| ADDR. | CODE | | | STMT. | | | | | |
|---|---|---|---|---|---|---|---|---|---|
| | | | | | | ORG | 2100 | | |
| 2100 | 46 | LAX | 6, 0 | 2100 | R7LG | LAX | 6 | | 2100 |
| 2132 | 76 | ATB | 0, 0 | 2101 | | ATB | | | 2101 |
| 2116 | 50 | LDA | 0, 0 | 2102 | | LDA | 0 | | 2102 |
| 2108 | 6E | ADX | 14, 0 | 2103 | | ADX | 14 | | 2103 |
| 2104 | DB | TRA | 1,36 | 2104 | | TRA | 1,TORAND | | 2104 |
| 2102 | 50 | LDA | 0, 0 | 2105 | | LDA | 0 | | 2105 |
| 2133 | 6A | ADX | 10, 0 | 2106 | | ADX | 10 | | 2106 |
| 2148 | E7 | TRA | 1,24 | 2107 | | TRA | 1,*+1 | | 2107 |
| 2124 | 13 | LB | 3, 8 | 2108 | | LB | PAD | | 2108 |
| 2112 | 5C | EXC | 0, 0 | 2109 | | EXC | 0,0 | R6+10 TO PAD | 2109 |
| 2106 | 36 | TL | 9, 0 | 2110 | | TL | | | 2110 |
| 2135 | B5 | TRA | 0,10 | 2111 | | TRA | 0,HM4 | | 2111 |
| 2117 | 6C | ADX | 12, 0 | 2112 | | ADX | 12 | | 2112 |
| 2140 | C3 | TRA | 1,60 | 2113 | | TRA | 1,89R7 | | 2113 |
| 2120 | 13 | LB | 3, 8 | 2114 | | LB | PAD | | 2114 |
| 2110 | 50 | LDA | 0, 0 | 2115 | | LDA | 0 | | 2115 |
| 2137 | 18 | LB | 0,10 | 2116 | | LB | 0,10 | | 2116 |
| 2150 | 76 | ATB | 0, 0 | 2117 | | ATB | | | 2117 |
| 2157 | DD | TRA | 1,34 | 2118 | | TRA | 1,TESTR7 | | 2118 |
| 2160 | 36 | TL | 9, 0 | 2119 | 89R7 | TL | | | 2119 |
| 2130 | B5 | TRA | 0,10 | 2120 | | TRA | 0,HM4 | | 2120 |
| 2147 | 13 | LB | 3, 8 | 2121 | | LB | PAD | | 2121 |
| 2123 | 50 | LDA | 0, 0 | 2122 | | LDA | 0 | | 2122 |
| 2111 | 09 | LB | 1, 0 | 2123 | | LB | 1,0 | | 2123 |
| 2105 | 76 | ATB | 0, 0 | 2124 | | ATB | | | 2124 |
| 2134 | 79 | HTA | 0, 0 | 2125 | TESTR7 | HTA | | | 2125 |
| 2149 | 6D | ADX | 13, 0 | 2126 | | ADX | 13 | | 2126 |
| 2156 | D4 | TRA | 1,43 | 2127 | | TRA | 1,3R7 | | 2127 |
| 2128 | 61 | ADX | 1, 0 | 2128 | | ADX | 1 | | 2128 |
| 2114 | C5 | TRA | 1,58 | 2129 | | TRA | 1,2R7 | | 2129 |
| 2139 | 61 | ADX | 1, 0 | 2130 | | ADX | 1 | | 2130 |
| 2119 | E0 | TRA | 1,31 | 2131 | | TRA | 1,1R7 | | 2131 |
| 2109 | 2B | TM | 8, 0 | 2132 | | TM | 8 | | 2132 |
| 2136 | 3E | TL | 1, 0 | 2133 | TORAND | TL | | | 2133 |
| 2118 | D2 | TRA | 1,45 | 2134 | | TRA | 1,TRAND | | 2134 |
| 2141 | 23 | SM | 8, 0 | 2135 | | SM | 8 | | 2135 |

TABLE III

| ADDR. | CODE | | | STMT. | | | | |
|---|---|---|---|---|---|---|---|---|
| 2152 | 7A | BTA | 0, 0 | 2136 | LDNUCD | BTA | | 2136 |
| 2126 | 17 | LB | 3, 9 | 2137 | | LB | NEW | 2137 |
| 2145 | 5C | EXC | 0, 0 | 2138 | | EXC | 0,0 | 2138 |
| 2154 | 50 | LDA | 0, 0 | 2139 | | LDA | 0 | 2139 |
| 2159 | 65 | ADX | 5, 0 | 2140 | | ADX | 5 | 2140 |
| 2129 | E4 | TRA | 1,27 | 2141 | | TRA | 1,LD10 | 2141 |
| 2146 | 6A | ADX | 10, 0 | 2142 | | ADX | 10 | 2142 |
| 2155 | D9 | TRA | 1,38 | 2143 | | TRA | 1,INCCC | 2143 |
| 2127 | 4A | LAX | 10, 0 | 2144 | LD10 | LAX | 10 | 2144 |
| 2113 | 5C | EXC | 0, 0 | 2145 | | EXC | 0,0 | 2145 |
| 2138 | 15 | LB | 1, 9 | 2146 | INCCC | LB | 1,9 | 2146 |
| 2151 | 9A | TRA | 0,37 | 2147 | | TRA | 0,PLUS1 | 2147 |
| 2125 | 2C | SB7 | 0, 0 | 2148 | | SB7 | | 2148 |
| 2144 | 38 | TL | 4, 0 | 2149 | | TL | | 2149 |
| 2122 | FF | TRA | 1, 0 | 2150 | | TRA | 1,INCCCX | 2150 |
| 2143 | 28 | TM | 1, 0 | 2151 | 3R7 | TM | 1 | 2151 |
| 2121 | DB | TRA | 1,36 | 2152 | | TRA | 1,TORAND | 2152 |
| 2142 | 20 | SM | 1, 0 | 2153 | | SM | 1 | 2153 |
| 2153 | CB | TRA | 1,52 | 2154 | | TRA | 1,LDNUCD | 2154 |
| 2158 | 29 | TM | 2, 0 | 2155 | 2R7 | TM | 2 | 2155 |
| 2161 | DB | TRA | 1,36 | 2156 | | TRA | 1,TORAND | 2156 |
| 2162 | 21 | SM | 2, 0 | 2157 | | SM | 2 | 2157 |
| 2163 | CB | TRA | 1,52 | 2158 | | TRA | 1,LDNUCD | 2158 |
| 2131 | 2A | TM | 4, 0 | 2159 | 1R7 | TM | 4 | 2159 |
| 2115 | DB | TRA | 1,36 | 2160 | | TRA | 1,TORAND | 2160 |
| 2107 | 22 | SM | 4, 0 | 2161 | | SM | 4 | 2161 |
| 2103 | CB | TRA | 1,52 | 2162 | | TRA | 1,LDNUCD | 2162 |

TABLE III

| ADDR. | CODE | | | STMT. | | | | |
|---|---|---|---|---|---|---|---|---|
| | | | | | | OPG | 2300 | |
| 2300 | DE | TRA | 1,33 | 2300 | ADDZK | TRA | 1,ADDB | 2300 |
| 2332 | CD | TRA | 1,50 | 2301 | SUBZK | TRA | 1,SUBS | 2301 |
| 2316 | 14 | LB | 0, 9 | 2302 | OTOK | LB | 0,9 | 2302 |
| 2308 | 15 | LB | 1, 9 | 2303 | OTOZ | LB | 1,9 | 2303 |
| 2304 | 4F | LAX | 15, 0 | 2304 | OTO | LAX | 15 | |
| 2302 | 5C | EXC | 0, 0 | 2305 | | EXC | 0,0 | |
| 2333 | 40 | LAX | 0, 0 | 2306 | | LAX | 0 | |
| 2348 | 5C | EXC | 0, 0 | 2307 | | EXC | 0,0 | |
| 2324 | 77 | COMP | 0, 0 | 2308 | | COMP | | |
| 2312 | EA | TRA | 1,21 | 2309 | | TRA | 1,OTO1 | |
| 2306 | 14 | LB | 0, 9 | 2310 | KEM1 | LB | 0,9 | 2307 |
| 2335 | 15 | LB | 1, 9 | 2311 | ZEM1 | LB | 1,9 | 2308 |
| 2317 | 4F | LAX | 15, 0 | 2312 | MINUS1 | LAX | 15 | 2309 |
| 2340 | C7 | TRA | 1,56 | 2313 | ADDX | TRA | 1,POMS | 2310 |
| 2320 | 15 | LB | 1, 9 | 2314 | ZEP1 | LB | 1,9 | 2311 |
| 2310 | 11 | LB | 1, 8 | 2315 | ZSP1 | LB | 1,8 | 2312 |
| 2337 | CE | TRA | 1,49 | 2316 | PLUS1 | TRA | 1,POMS1 | 2313 |
| 2350 | 14 | LB | 0, 9 | 2317 | LKE | LB | 0,9 | 2314 |
| 2357 | 10 | LB | 0, 8 | 2318 | LKS | LB | 0,8 | 2315 |
| 2360 | 11 | LB | 1, 8 | 2319 | LZS | LB | 1,8 | 2316 |
| 2330 | 1A | LB | 2,10 | 2320 | LLS | LB | LS | 2317 |
| 2347 | 51 | LDA | 1, 0 | 2321 | | LDA | 1 | 2318 |
| 2323 | 2F | RET | 0, 0 | 2322 | | RET | 0 | 2319 |
| 2311 | 0C | LB | 0, 7 | 2323 | KRIGHT | LB | 0,7 | 2320 |
| 2305 | 0D | LB | 1, 7 | 2324 | ZRIGHT | LB | 1,7 | 2321 |
| 2334 | FF | TRA | 1, 0 | 2325 | RIGHTX | TRA | 1,RIGHT | 2322 |
| 2349 | 09 | LB | 1, 0 | 2326 | ZLEFT | LB | 1,0 | 2323 |
| 2356 | F7 | TRA | 1, 8 | 2327 | LEFTX | TRA | 1,LEFT | 2324 |
| 2328 | 14 | LB | 0, 9 | 2328 | SWAPKW | LB | 0,9 | 2325 |
| 2314 | F2 | TRA | 1,13 | 2329 | SWAP2X | TRA | 1,SWAP2 | 2326 |
| 2339 | 0E | LB | 2, 7 | 2330 | SWPWK8 | LB | 2,7 | 2327 |
| 2319 | C1 | TRA | 1,62 | 2331 | | TRA | 1,SWPIB7 | 2328 |
| 2309 | 14 | LB | 0, 9 | 2332 | SWAPKZ | LB | 0,9 | 2329 |
| 2336 | C4 | TRA | 1,59 | 2333 | SWAP1X | TRA | 1,SWAP1 | 2330 |
| 2318 | 1F | LB | 3,11 | 2334 | SETPM | LB | B | 2331 |
| 2341 | 1E | LB | 2,11 | 2335 | SETOF | LB | ND | 2332 |

TABLE III

| ADDR. | CODE | | | STMT. | | | | |
|---|---|---|---|---|---|---|---|---|
| 2352 | 1B | LB | 3,10 | 2336 | SETM | LB | MC | 2333 |
| 2326 | 20 | SM | 1, 0 | 2337 | | SM | 1 | 2334 |
| 2345 | FD | TRA | 1, 2 | 2338 | DELAY | TRA | 1,RETD | 2335 |
| 2354 | 1B | LB | 0,10 | 2339 | LDK10 | LB | 0,10 | 2337 |
| 2359 | 1C | LB | 0,11 | 2340 | LDK11 | LB | 0,11 | 2338 |
| 2329 | E3 | TRA | 1,28 | 2341 | LDM | TRA | 1,EXCS | 2339 |
| 2346 | 0A | LB | 2, 0 | 2342 | WOTSZ | LB | 2,0 | 2340 |
| 2355 | CB | TRA | 1,52 | 2343 | TSZERO | TRA | 1,ISZ | 2342 |
| 2327 | 0B | LB | 0, 0 | 2344 | KREGRZ | LB | 0,0 | 2343 |
| 2313 | 09 | LB | 1, 0 | 2345 | ZREGRZ | LB | 1,0 | 2344 |
| 2338 | DB | TRA | 1,39 | 2346 | REZ | TRA | 1,REZS | 2345 |
| 2351 | 11 | LB | 1, 8 | 2347 | TSPLIT | LB | SF | 2346 |
| 2325 | 0D | LB | 1, 7 | 2348 | TAI | LB | BJI | 2347 |
| 2344 | 1F | LB | 3,11 | 2349 | TG | LB | H | 2348 |
| 2322 | 1B | LB | 3,10 | 2350 | TDS1 | LB | DS | 2349 |
| 2343 | 2C | SB7 | 0, 0 | 2351 | | SB7 | | 2350 |
| 2321 | 28 | TM | 1, 0 | 2352 | | TM | 1 | 2351 |
| 2342 | 2F | RET | 0, 0 | 2353 | | RET | 0 | 2352 |
| 2353 | 2E | RET | 1, 0 | 2354 | | RET | 1 | 2353 |
| 2358 | 1F | LB | 3,11 | 2355 | THO | LB | H | 2354 |
| 2361 | 1B | LB | 3,10 | 2356 | TD3 | LB | DS | 2355 |
| 2362 | 2C | SB7 | 0, 0 | 2357 | TSP | SB7 | | |
| 2363 | 2A | TM | 4, 0 | 2358 | | TM | 4 | 2359 |
| 2331 | 2E | RET | 1, 0 | 2359 | | RET | 1 | 2360 |
| 2315 | 2F | RET | 0, 0 | 2360 | 3BD | RET | 0 | 2361 |
| 2307 | 40 | LAX | 0, 0 | 2361 | ZRO | LAX | 0 | 2362 |
| 2303 | 58 | EXC | 0, 2 | 2362 | TEXCX | EXC | 0,-1 | |
| 2301 | 2F | RET | 0, 0 | 2363 | | RET | 0 | |

TABLE III

| ADDR. | CODE | | | STMT. | | | | |
|---|---|---|---|---|---|---|---|---|
| | | | | | | ORG | 2200 | |
| 2200 | 58 | EXC | 0, 2 | 2200 | RIGHT | EXC | 0,-1 | 2200 |
| 2232 | FF | TRA | 1, 0 | 2201 | | TRA | 1,*-1 | 2201 |
| 2216 | 2F | RET | 0, 0 | 2202 | | RET | 0 | 2202 |
| 2208 | 54 | EXC | 0, 1 | 2203 | LEFT | EXC | 0,+1 | 2203 |
| 2204 | F7 | TRA | 1, 8 | 2204 | | TRA | 1,*-1 | 2204 |
| 2202 | 2F | RET | 0, 0 | 2205 | RETD | RET | 0 | 2205 |
| 2233 | 05 | RSC | 0, 0 | 2206 | ADDB | RSC | | 2206 |
| 2248 | 08 | LB | 0, 0 | 2207 | ADDS | LB | 0,0 | 2207 |
| 2224 | 51 | LDA | 1, 0 | 2208 | ADDS1 | LDA | 1 | 2208 |
| 2212 | 66 | ADX | 6, 0 | 2209 | | ADX | 6 | 2209 |
| 2206 | 7D | ADD | 1, 1 | 2210 | | ADD | 1,1 | 2210 |
| 2235 | 6A | ADX | 10, 0 | 2211 | | ADX | 10 | 2211 |
| 2217 | 55 | EXC | 1, 1 | 2212 | | EXC | 1,+1 | 2212 |
| 2240 | E7 | TRA | 1,24 | 2213 | | TRA | 1,ADDS1 | 2213 |
| 2220 | 02 | TC | 0, 0 | 2214 | TCS | TC | | 2214 |
| 2210 | 2F | RET | 0, 0 | 2215 | RET0 | RET | 0 | 2215 |
| 2237 | 2E | RET | 1, 0 | 2216 | RET1 | RET | 1 | 2216 |
| 2250 | 06 | SC | 0, 0 | 2217 | SUBS | SC | | 2217 |
| 2257 | 08 | LB | 0, 0 | 2218 | | LB | 0,0 | 2218 |
| 2260 | 51 | LDA | 1, 0 | 2219 | SUBS1 | LDA | 1 | 2219 |
| 2230 | 77 | COMP | 0, 0 | 2220 | SUBS2 | COMP | | 2220 |
| 2247 | 7D | ADD | 1, 1 | 2221 | | ADD | 1,1 | 2221 |
| 2223 | 6A | ADX | 10, 0 | 2222 | | ADX | 10 | 2222 |
| 2211 | 55 | EXC | 1, 1 | 2223 | | EXC | 1,+1 | 2223 |
| 2205 | C3 | TRA | 1,60 | 2224 | | TRA | 1,SUBS1 | 2224 |
| 2234 | EB | TRA | 1,20 | 2225 | | TRA | 1,TCS | 2225 |
| 2249 | 41 | LAX | 1, 0 | 2226 | POMS1 | LAX | 1 | 2226 |
| 2256 | 7E | ADD | 0, 0 | 2227 | POMS | ADD | 0 | 2227 |
| 2228 | 5C | EXC | 0, 0 | 2228 | EXCS | EXC | 0,0 | 2228 |
| 2214 | D3 | TRA | 1,44 | 2229 | | TRA | 1,RSB7AZ | 2229 |
| 2239 | 40 | LAX | 0, 0 | 2230 | REZS | LAX | 0 | 2230 |
| 2219 | 7F | TAM | 0, 0 | 2231 | | TAM | | 2231 |
| 2209 | 2E | RET | 1, 0 | 2232 | | RET | 1 | 2232 |
| 2236 | 54 | EXC | 0, 1 | 2233 | | EXC | 0,+1 | 2233 |
| 2218 | D8 | TRA | 1,39 | 2234 | | TRA | 1,REZS | 2234 |
| 2241 | 2F | RET | 0, 0 | 2235 | | RET | 0 | 2235 |

TABLE III

| ADDR. | | CODE | | STMT. | | | | |
|---|---|---|---|---|---|---|---|---|
| 2252 | 50 | LDA | 0, 0 | 2236 | ISZ | LDA | 0 | 2236 |
| 2226 | 6F | ADX | 15, 0 | 2237 | | ADX | 15 | 2237 |
| 2245 | 2E | RET | 1, 0 | 2238 | | RET | 1 | 2238 |
| 2254 | 2F | RET | 0, 0 | 2239 | | RET | 0 | 2239 |
| 2259 | 51 | LDA | 1, 0 | 2240 | SWAP1 | LDA | 1 | 2240 |
| 2229 | 5D | EXC | 1, 0 | 2241 | | EXC | 1,0 | 2241 |
| 2246 | 58 | EXC | 0, 2 | 2242 | | EXC | 0,-1 | 2242 |
| 2255 | C4 | TRA | 1,59 | 2243 | | TRA | 1,SWAP1 | 2243 |
| 2227 | D3 | TRA | 1,44 | 2244 | | TRA | 1,RSB7AZ | 2244 |
| 2213 | 52 | LDA | 2, 0 | 2245 | SWAP2 | LDA | 2 | 2245 |
| 2238 | 5E | EXC | 2, 0 | 2246 | | EXC | 2,0 | 2246 |
| 2251 | 58 | EXC | 0, 2 | 2247 | | EXC | 0,-1 | 2247 |
| 2225 | F2 | TRA | 1,13 | 2248 | | TRA | 1,SWAP2 | 2248 |
| 2244 | 40 | LAX | 0, 0 | 2249 | RSB7AZ | LAX | 0 | 2249 |
| 2222 | 2D | RSB7 | 0, 0 | 2250 | RSB7 | RSB7 | | 2250 |
| 2243 | 2F | RET | 0, 0 | 2251 | | RET | 0 | 2251 |
| 2221 | 7F | TAM | 0, 0 | 2252 | OTO1 | TAM | | |
| 2242 | EA | TRA | 1,21 | 2253 | | TRA | 1,*-1 | |
| 2253 | 59 | EXC | 0, 2 | 2254 | | EXC | 0,-1 | |
| 2258 | BB | TRA | 0, 4 | 2255 | | TRA | 0,OTO | 2253 |
| 2261 | D3 | TRA | 1,44 | 2256 | | TRA | 1,RSB7AZ | 2254 |
| 2262 | 51 | LDA | 1, 0 | 2257 | SWP1B7 | LDA | 1 | 2255 |
| 2263 | 2C | SB7 | 0, 0 | 2258 | | SB7 | | 2256 |
| 2231 | 5D | EXC | 1, 0 | 2259 | | EXC | 1,0 | 2257 |
| 2215 | 2D | RSB7 | 0, 0 | 2260 | | RSB7 | | 2258 |
| 2207 | 58 | EXC | 0, 2 | 2261 | | EXC | 0,-1 | 2259 |
| 2203 | C1 | TRA | 1,62 | 2262 | | TRA | 1,SWP1B7 | 2260 |
| 2201 | D3 | TRA | 1,44 | 2263 | | TRA | 1,RSB7AZ | 2261 |
| | | | | | | END | | |

THE NUMBER OF ROM STEPS USED IS 1519

TABLE III

CROSS REFERENCE TABLE

| STMT. | NAME | USING STATEMENTS | | | | |
|---|---|---|---|---|---|---|
| 1100 | ADACED | 622 | | | | |
| 1101 | ADACEP | 611 | | | | |
| 1102 | ADACES | 607 | | | | |
| 1000 | ADD | 1709 | 1635 | 1620 | 1216 | 1051 |
| 2206 | ADDB | 2300 | | | | |
| 428 | ADDCDS | | | | | |
| 1055 | ADDDT | 448 | | | | |
| 1056 | ADDPT | 433 | | | | |
| 1217 | ADDRET | 1037 | | | | |
| 2207 | ADDS | | | | | |
| 1057 | ADDST | 445 | | | | |
| 2208 | ADDS1 | 2213 | | | | |
| 2313 | ADDX | 1305 | 1025 | | | |
| 2300 | ADDZK | 1413 | 1335 | 1011 | | |
| 1142 | ADPSX | 1063 | | | | |
| 1004 | A1 | | | | | |
| 1040 | A1A | 1003 | | | | |
| 1044 | A1B | 1042 | | | | |

TABLE III

CROSS REFERENCE TABLE

| STMT. | NAME | USING STATEMENTS | | |
|---|---|---|---|---|
| 1052 | A2 | 1046 | | |
| 1049 | A3 | 1054 | | |
| 1014 | A4 | 1012 | | |
| 1023 | A6 | | | |
| 1028 | A7 | 1034 | | |
| 1021 | A9 | 1010 | | |
| 336 | BETK | 1948 | | |
| 354 | BET1 | 337 | | |
| 517 | BJL | 506 | | |
| 907 | BJN | 912 | | |
| 900 | BJTEST | 523 | 519 | |
| 908 | BJY | | | |
| 31 | BLANK | 62 | 55 | 25 |
| 409 | CARDTO | | | |
| 924 | CEK | 1922 | | |
| 418 | CFZ | 456 | 454 | |
| 450 | CHGB | 420 | | |
| 639 | CHKH2C | 662 | 632 | |
| 645 | CKH2B | 642 | | |

TABLE III

CROSS REFERENCE TABLE

| STMT. | NAME | USING STATEMENTS | |
|---|---|---|---|
| 1248 | CMP | 1245 | |
| 1233 | CMPRP | 629 | |
| 1232 | CMPRS | 649 | |
| 614 | COUNT | 802 | |
| 605 | COUNTX | 813 | |
| 936 | C1 | 926 | |
| 929 | C2 | | |
| 447 | DADDDT | 429 | |
| 300 | DBLK | 1951 | |
| 2338 | DELAY | 1525 | |
| 133 | DISK | | |
| 40 | DISPKC | 137 | |
| 1324 | DIV1 | | |
| 1354 | DIV10 | 1349 | |
| 1328 | DIV2 | | |
| 1422 | DIV3 | | |
| 1329 | DIV4 | 1363 | 1346 |
| 1335 | DIV4X | | |
| 1361 | DIV5 | 1330 | |

TABLE III

CROSS REFERENCE TABLE

| STMT. | NAME | USING STATEMENTS | |
|---|---|---|---|
| 1360 | DIV5X | 1334 | |
| 1340 | DIV7 | 1359 | 1357 |
| 1347 | DIV8 | 1338 | |
| 1350 | DIV8X | | |
| 700 | DLROVR | 620 | |
| 625 | DLRSTD | 842 | |
| 656 | DLRWN | 630 | |
| 1419 | DM1 | 1417 | 1353 |
| 1430 | DM2 | 1423 | |
| 1954 | DPCK | 1916 | |
| 407 | DS3 | | |
| 404 | DS3X | 401 | |
| 1439 | D10F | 1421 | |
| 1438 | D10FX | 1323 | |
| 1020 | END | | |
| 1440 | ENDGM | 1450 | |
| 1443 | ENDMD | 1437 | 1432 |
| 1609 | EQK | | |
| 2228 | EXCS | 2341 | |

TABLE III

CROSS REFERENCE TABLE

| STMT. | NAME | USING STATEMENTS | | | | |
|---|---|---|---|---|---|---|
| 945 | E1 | 1611 | | | | |
| 943 | E2 | 946 | | | | |
| 952 | E3 | 950 | 944 | | | |
| 1624 | E5 | 1613 | | | | |
| 1619 | E6 | 1625 | 1617 | | | |
| 1215 | FAD | 1231 | | | | |
| 1533 | GAME | 1527 | | | | |
| 0 | GDISP | 132 | | | | |
| 7 | GD1 | 3 | | | | |
| 26 | GD2 | 15 | | | | |
| 38 | GD4 | 61 | 51 | 28 | | |
| 33 | GD5 | 39 | | | | |
| 1448 | GMCHK | 1409 | | | | |
| 249 | HAND | 829 | 752 | 624 | 439 | 311 |
| 312 | HITK | 1933 | | | | |
| 915 | HM4 | 2120 | 2111 | | | |
| 710 | H2C3 | 728 | | | | |
| 2146 | INCCC | 2143 | | | | |
| 400 | INCCCX | 2150 | | | | |

TABLE III

CROSS REFERENCE TABLE

| STMT. | NAME | USING STATEMENTS | | | | | | |
|---|---|---|---|---|---|---|---|---|
| 550 | INSDLR | 529 | | | | | | |
| 512 | INSK | 1936 | | | | | | |
| 2236 | ISZ | 2343 | | | | | | |
| 2343 | ISZERO | 1859 | 1431 | 1425 | 1422 | 1348 | 1045 | 1017 |
| 17 | IS1 | 30 | | | | | | |
| 56 | IS7 | 47 | | | | | | |
| 52 | IS8 | 45 | | | | | | |
| 1821 | KDNX3 | 1817 | | | | | | |
| 1800 | KDN1 | 162 | | | | | | |
| 1804 | KDN1X | | | | | | | |
| 1824 | KDN2 | | | | | | | |
| 1736 | KDN2C | 1832 | | | | | | |
| 1823 | KDN2X | 1819 | | | | | | |
| 48 | KD2 | | | | | | | |
| 2310 | KEM1 | 1047 | 762 | | | | | |
| 155 | KEYDWN | | | | | | | |
| 1900 | KEYON | 1753 | | | | | | |
| 1920 | KON1 | 1902 | | | | | | |
| 1600 | KON2 | 1927 | | | | | | |

TABLE III

CROSS REFERENCE TABLE

| STMT. | NAME | USING STATEMENTS | | | | | | | | | | | |
|---|---|---|---|---|---|---|---|---|---|---|---|---|---|
| 1605 | KON2X | | | | | | | | | | | | |
| 1913 | KON3 | | | | | | | | | | | | |
| 1909 | KON3X | | | | | | | | | | | | |
| 1928 | KON4 | 1908 | | | | | | | | | | | |
| 1943 | KON4C | | | | | | | | | | | | |
| 2344 | KREGRZ | 1321 | | | | | | | | | | | |
| 125 | KRET | 2012<br>121 | 1924 | 1857 | 1757 | 1602 | 1554 | 940 | 815 | 511 | 302 | 229 | 159 |
| 2323 | KRIGHT | 1048 | 761 | | | | | | | | | | |
| 100 | KS1 | 23 | | | | | | | | | | | |
| 103 | KS2 | 148 | 144 | 101 | | | | | | | | | |
| 106 | KS3 | 1532 | | | | | | | | | | | |
| 118 | KS4 | 105 | | | | | | | | | | | |
| 141 | KS5 | 102 | | | | | | | | | | | |
| 1258 | KTOT | 1226 | | | | | | | | | | | |
| 1453 | KTOW | 1723 | 1712 | 1637 | | | | | | | | | |
| 1458 | KTOZ | 1725 | 1658 | 1648 | | | | | | | | | |
| 1454 | LDA2 | | | | | | | | | | | | |
| 421 | LDCARD | | | | | | | | | | | | |
| 2339 | LDK10 | 1804 | 1345 | 1301 | | | | | | | | | |

TABLE III

CROSS REFERENCE TABLE

| STMT. | NAME | USING STATEMENTS | | | | | |
|---|---|---|---|---|---|---|---|
| 2340 | LDK11 | 1406 | 1302 | | | | |
| 2341 | LDM | | | | | | |
| 2136 | LDNUCD | 2162 | 2158 | 2154 | | | |
| 2144 | LD10 | 2141 | | | | | |
| 2203 | LEFT | 2327 | | | | | |
| 2327 | LEFTX | 1855 | 1343 | | | | |
| 2317 | LKE | 1847 | 1310 | 1001 | | | |
| 2318 | LKS | 1303 | 1004 | | | | |
| 2320 | LLS | 150 | 127 | 103 | | | |
| 2319 | LZS | 1407 | 1336 | | | | |
| 1700 | MDK | 1662 | | | | | |
| 1300 | MD1 | 2036 | 1734 | 1655 | 953 | 347 | 331 |
| 1310 | MD1X | | | | | | |
| 32 | MIN | 54 | | | | | |
| 2312 | MINUS1 | 1428 | 1360 | | | | |
| 1722 | MK1 | 1701 | | | | | |
| 1724 | MK2 | 1735 | | | | | |
| 1729 | MK3 | 1703 | | | | | |
| 1733 | MK4 | 1731 | | | | | |

TABLE III

CROSS REFERENCE TABLE

| STMT. | NAME | USING STATEMENTS | | | | |
|---|---|---|---|---|---|---|
| 1708 | MK5 | 1706 | | | | |
| 1713 | MK6 | 1728 | | | | |
| 830 | MOVPC | 826 | | | | |
| 402 | MSBC | | | | | |
| 1326 | MULT | 1320 | | | | |
| 1424 | MX2 | 1436 | 1434 | 1418 | | |
| 1410 | M1 | 1447 | 1415 | 1327 | | |
| 1200 | M1TON | 553 | | | | |
| 1445 | M1X | 1414 | | | | |
| 1400 | M2 | 1411 | | | | |
| 1201 | M2TON | 727 | 725 | 661 | 659 | 560 |
| 1401 | M2X | 1429 | | | | |
| 1416 | M3 | 1451 | | | | |
| 1202 | M4TON | 718 | | | | |
| 259 | NET | 715 | 644 | 549 | | |
| 2032 | NEWN | | | | | |
| 2046 | NUCARD | 2043 | | | | |
| 1833 | N1 | 1919 | | | | |
| 1858 | N2 | 1835 | | | | |

CROSS REFERENCE TABLE

| STMT. | NAME | USING STATEMENTS | | | | | | | | | |
|---|---|---|---|---|---|---|---|---|---|---|---|
| 1838 | N3 | 1860 | | | | | | | | | |
| 1847 | N4 | 1845 | | | | | | | | | |
| 1852 | N5 | 1841 | | | | | | | | | |
| 1115 | OVRZRO | 1113 | | | | | | | | | |
| 1128 | OVR11 | 1141 | | | | | | | | | |
| 1137 | OVR6 | 1127 | | | | | | | | | |
| 1140 | OVR6X | 1138 | | | | | | | | | |
| 200 | PLAYK | 1942 | | | | | | | | | |
| 803 | PLRCD | | | | | | | | | | |
| 633 | PLRWN | | | | | | | | | | |
| 2316 | PLUS1 | 2147 | 2009 | 2005 | 2001 | 1851 | 1446 | 1362 | 1355 | 408 | 403 |
| 1208 | PLX | 1205 | | | | | | | | | |
| 1626 | PMK | 1606 | | | | | | | | | |
| 2227 | POMS | 2313 | | | | | | | | | |
| 2226 | POMS1 | 2316 | | | | | | | | | |
| 1500 | PWRON | | | | | | | | | | |
| 1647 | P1 | 1627 | | | | | | | | | |
| 1636 | P2 | 1649 | | | | | | | | | |
| 1206 | P2TON | 720 | 709 | 707 | 638 | 636 | 556 | | | | |

TABLE III

CROSS REFERENCE TABLE

| STMT. | NAME | USING STATEMENTS | | |
|---|---|---|---|---|
| 1650 | P3 | 1629 | | |
| 1207 | P3TON | 547 | | |
| 1634 | P4 | 1632 | | |
| 1654 | P5 | 1652 | | |
| 1640 | P6 | 1659 | | |
| 1638 | P7 | | | |
| 2013 | RANDOM | 140 | | |
| 2000 | RDLY | 258 | | |
| 202 | RESET | 1550 | 458 | |
| 2205 | RET0 | 2338 | | |
| 2215 | RET0 | | | |
| 2216 | RET1 | | | |
| 2346 | REZ | 1325 | | |
| 2230 | REZS | 2234 | 2346 | |
| 2200 | RIGHT | 2325 | | |
| 2325 | RIGHTX | 1405 | | |
| 459 | RLZ | 245 | 242 | |
| 955 | RND | 1721 | 1646 | 1623 |
| 941 | ROF | 928 | | |

TABLE III

CROSS REFERENCE TABLE

| STMT. | NAME | USING STATEMENTS | | | | |
|---|---|---|---|---|---|---|
| 114 | RRET | 2045 | | | | |
| 2250 | RSB7 | | | | | |
| 2249 | RSB7AZ | 2263 | 2256 | 2244 | 2229 | |
| 753 | RTJUS | 956 | 763 | | | |
| 761 | RTJUS1 | 759 | | | | |
| 2100 | R7LG | 2062 | | | | |
| 507 | SETAI | | | | | |
| 2336 | SETM | 2033 | 1719 | 613 | 345 | 259 |
| 2335 | SETOF | 1762 | 1533 | 1439 | 1018 | |
| 2334 | SETPM | 1644 | 1535 | 1204 | | |
| 1758 | SHUFL | 1755 | | | | |
| 729 | SPLC | 1563 | | | | |
| 1551 | SPLITK | 1939 | | | | |
| 844 | STANDK | 1945 | | | | |
| 600 | STANDX | 852 | | | | |
| 2217 | SUBS | 2301 | | | | |
| 2219 | SUBS1 | 2224 | | | | |
| 2220 | SUBS2 | | | | | |
| 2301 | SUBZK | 1329 | 1021 | | | |

TABLE III

CROSS REFERENCE TABLE

| STMT. | NAME | USING STATEMENTS | | | | | | | | | | | |
|---|---|---|---|---|---|---|---|---|---|---|---|---|---|
| 2328 | SWAPKW | 1707 | 1656 | 1633 | 1618 | 1438 | 1223 | 1212 | 954 | 943 | 362 | 332 | 325 |
| 2332 | SWAPKZ | 1732 | 1710 | 1653 | 1624 | 1621 | 1224 | 1050 | 1043 | 951 | | | |
| 1260 | SWAPX3 | | | | | | | | | | | | |
| 2240 | SWAP1 | 2243 | 2333 | | | | | | | | | | |
| 2333 | SWAP1X | 352 | | | | | | | | | | | |
| 2245 | SWAP2 | 2248 | 2329 | | | | | | | | | | |
| 2329 | SWAP2X | 1214 | | | | | | | | | | | |
| 2330 | SWPWR8 | 2037 | 2032 | | | | | | | | | | |
| 2257 | SWP1B7 | 2262 | 2331 | | | | | | | | | | |
| 1035 | TADRET | 1022 | 1020 | 1013 | | | | | | | | | |
| 2348 | TAI | 848 | 512 | 507 | 314 | 300 | | | | | | | |
| 516 | TBJL | 508 | | | | | | | | | | | |
| 500 | TBLJK | 850 | 437 | | | | | | | | | | |
| 24 | TBLNK | 6 | | | | | | | | | | | |
| 1921 | TCEK | 1914 | | | | | | | | | | | |
| 2214 | TCS | 2225 | | | | | | | | | | | |
| 1112 | TC1 | 1106 | | | | | | | | | | | |
| 1122 | TC2 | 1108 | | | | | | | | | | | |
| 1109 | TC3 | 1129 | | | | | | | | | | | |

CROSS REFERENCE TABLE

| STMT. | NAME | USING STATEMENTS | | | | | | | | |
|---|---|---|---|---|---|---|---|---|---|---|
| 722 | TDBL2 | 703 | | | | | | | | |
| 1842 | TDP | 1840 | | | | | | | | |
| 2350 | TDS1 | 844 | 800 | 428 | 415 | 410 | 312 | 4 | | |
| 2356 | TD3 | 1909 | 846 | 407 | 354 | 316 | 303 | | | |
| 2125 | TESTR7 | 2118 | 2059 | | | | | | | |
| 1158 | TESTXT | 1150 | | | | | | | | |
| 2362 | TEXCX | 1715 | 934 | | | | | | | |
| 1230 | TFAD | 1220 | | | | | | | | |
| 534 | TFP | | | | | | | | | |
| 905 | TF01 | 914 | | | | | | | | |
| 2349 | TG | 1954 | 1928 | 1600 | 1035 | | | | | |
| 751 | THAND | | | | | | | | | |
| 837 | THB | 809 | | | | | | | | |
| 2355 | THO | 320 | 200 | | | | | | | |
| 716 | TH2B3 | 713 | | | | | | | | |
| 230 | TH2C | 604 | | | | | | | | |
| 440 | TH2C1 | 431 | | | | | | | | |
| 1925 | TKON2 | 1906 | | | | | | | | |
| 301 | TKRET | 356 | 353 | 335 | 321 | 317 | 315 | 313 | 306 | 304 |

TABLE III

CROSS REFERENCE TABLE

| STMT. | NAME | USING STATEMENTS | | | | | |
|---|---|---|---|---|---|---|---|
| 2011 | TKRETD | 2007 | 2003 | | | | |
| 939 | TKRET1 | 960 | 942 | | | | |
| 1553 | TKRET2 | 1557 | | | | | |
| 814 | TKRET3 | 847 | 845 | 822 | | | |
| 1923 | TKRET4 | 1959 | 1955 | 1930 | 1911 | | |
| 228 | TKRET5 | 263 | 221 | 201 | | | |
| 1601 | TKRET6 | | | | | | |
| 510 | TKRET7 | 514 | | | | | |
| 1856 | TKRET8 | 1861 | 1849 | 1846 | 1822 | 1820 | 1814 |
| 1756 | TKRET9 | 1763 | | | | | |
| 22 | TKS1 | 37 | | | | | |
| 1530 | TKS3 | | | | | | |
| 1660 | TMDK | 1608 | | | | | |
| 559 | TM2TON | 651 | | | | | |
| 643 | TNET | 653 | | | | | |
| 1917 | TN1 | 1963 | | | | | |
| 432 | TOADPT | 443 | | | | | |
| 812 | TOCNTX | 843 | 836 | 235 | | | |
| 310 | TOHAND | 363 | 319 | | | | |

TABLE III

CROSS REFERENCE TABLE

| STMT. | NAME | USING STATEMENTS | | | |
|---|---|---|---|---|---|
| 714 | TONET | 721 | | | |
| 548 | TONET1 | 561 | 558 | | |
| 2133 | TORAND | 2160 | 2156 | 2152 | 2104 |
| 320 | TOTK | 1953 | | | |
| 532 | TPLRN | 554 | | | |
| 557 | TPLRY | 531 | | | |
| 719 | TP2TON | 655 | | | |
| 138 | TRAND | 2134 | 113 | | |
| 256 | TRDLY | 124 | | | |
| 2060 | TR7LG | 2051 | | | |
| 222 | TSHUF | 220 | | | |
| 1754 | TSHUFL | 227 | | | |
| 805 | TSH1B | 821 | | | |
| 823 | TSH2C | 817 | | | |
| 2357 | TSP | 1552 | | | |
| 816 | TSPA | 804 | | | |
| 2347 | TSPLIT | 803 | 602 | 430 | |
| 434 | TSTDS3 | 449 | 446 | | |
| 910 | TST10 | 902 | | | |

TABLE III

CROSS REFERENCE TABLE 05/16/77 11:24 PAGE: 17

| STMT. | NAME | USING STATEMENTS | | | | | | | | |
|---|---|---|---|---|---|---|---|---|---|---|
| 1154 | TST5 | 1161 | | | | | | | | |
| 1259 | TTOK | 324 | | | | | | | | |
| 544 | T2DS1 | 538 | 502 | | | | | | | |
| 800 | T2DS1X | 545 | | | | | | | | |
| 455 | UP | 452 | | | | | | | | |
| 853 | VDLY | 156 | | | | | | | | |
| 854 | VDLY2 | 862 | | | | | | | | |
| 855 | VDLY3 | | | | | | | | | |
| 1452 | WTOK | 1727 | | | | | | | | |
| 1256 | WTOZ | | | | | | | | | |
| 2342 | WOISZ | 1435 | 1410 | | | | | | | |
| 637 | WINSP | | | | | | | | | |
| 2311 | ZEM1 | 1426 | 1328 | 1019 | | | | | | |
| 2314 | ZEP1 | 1358 | 1317 | 1052 | | | | | | |
| 2326 | ZLEFT | 1344 | 1053 | | | | | | | |
| 2345 | ZREGRZ | 1416 | | | | | | | | |
| 2324 | ZRIGHT | 1403 | 1015 | | | | | | | |
| 2361 | ZRO | 1962 | 1641 | 1341 | 938 | 935 | 831 | 255 | 216 | 205 |
| 2315 | ZSP1 | 1400 | 1339 | | | | | | | |

TABLE III

CROSS REFERENCE TABLE

| STMT. | NAME | USING STATEMENTS | | | | | | | | | | | |
|---|---|---|---|---|---|---|---|---|---|---|---|---|---|
| 1459 | ZTOK | 1639 | | | | | | | | | | | |
| 1257 | ZTOW | | | | | | | | | | | | |
| 2304 | 0TO | 2255 | 1761 | 1758 | 1521 | 1519 | 1517 | 1515 | 1513 | 1510 | 1507 | 1504 | 1351 |
| | | 931 | 212 | 207 | | | | | | | | | |
| 2302 | 0TOK | 2038 | 1837 | 936 | 350 | 326 | | | | | | | |
| 2303 | 0TOZ | 1443 | 1300 | 929 | | | | | | | | | |
| 2252 | 0TO1 | 2309 | | | | | | | | | | | |
| 2159 | 1R7 | 2131 | | | | | | | | | | | |
| 2155 | 2R7 | 2129 | | | | | | | | | | | |
| 555 | 2TON | 551 | | | | | | | | | | | |
| 2360 | 3B0 | 35 | 20 | | | | | | | | | | |
| 2151 | 3R7 | 2127 | | | | | | | | | | | |
| 546 | 3TON | 533 | | | | | | | | | | | |
| 2119 | 89R7 | 2113 | | | | | | | | | | | |

TABLE III

CROSS REFERENCE TABLE

| STMT. NAME | USING STATEMENTS | | | | | | | | | | | |
|---|---|---|---|---|---|---|---|---|---|---|---|---|
| DS | 2356 | 2350 | 1555 | 600 | 434 | | | | | | | |
| NEW | 2137 | 917 | 412 | | | | | | | | | |
| PAD | 2121 | 2114 | 2108 | | | | | | | | | |
| MC | 2336 | 2039 | 1448 | 1318 | 1306 | 404 | 348 | 250 | | | | |
| ND | 2335 | 1957 | 1900 | 1838 | 1833 | 1729 | 1704 | 1650 | 1630 | 1615 | 957 | 948 |
| | 937 | 924 | 358 | 340 | 213 | 133 | 111 | | | | | |
| B | 2334 | 1713 | 1640 | 1604 | 1528 | 1221 | 1006 | 932 | 360 | 129 | 114 | |
| H | 2355 | 2349 | 261 | | | | | | | | | |
| SF | 2347 | 1559 | 1551 | 810 | 722 | 704 | 656 | 633 | 539 | 308 | | |
| BJI | 2348 | 527 | | | | | | | | | | |
| LS | 2320 | 1741 | 118 | 0 | | | | | | | | |
| VD | 2008 | 1852 | 1842 | 1748 | 1717 | 1642 | 854 | 252 | | | | |
| KI | 1904 | 1815 | 1738 | 157 | 141 | 106 | | | | | | |

Subsequent to the completion of the new card routine, (new card found), the increment card count routine INCCC (see FIG. 11) is performed to keep track of the total number of cards dealt. Then the flag DS3 is tested. If it is a ONE, it indicates that prior to the deal of the present card, the first four cards of a hand have already been dealt. If it is a ZERO, it indicates that the first four cards of the hand have still not all been dealt and that this card presently being dealt is one of those four. DS1 through DS3, which are used to keep track of the number of cards dealt in the original four card hand, are then incremented to reflect the true condition regarding the number of cards dealt, (up to four). In either case, the CARDTO routine (see FIG. 9) is then performed to assign the dealt card to the appropriate hand, the dealer's or the player's depending upon whose turn it is to receive a card. If the card currently being dealt by the operation of the HAND routine exceeds the total number of cards for which storage capacity exists in the random access memory (see FIG. 4), the CARDTO routine returns the program to the reset portion of the POWER-ON routine and cancels the hand. Otherwise, the HAND routine continues to the ADD CARDS routine (see FIG. 10c) which adds the value of the newly dealt card to the player's or dealer's hand according to which hand it was dealt.

The hand routine then tests the DS3 flag again to determine whether the card currently being dealt is now the fourth card or not. If it is still not the fourth card being dealt in the original hand, DS3 is zero and the HAND routine returns to the initial step to deal an additional card. If the fourth card has been dealt, the HAND routine then continues to the TEST BLACKJACK routine (see FIGS. 10a and 10b) which determines whether or not there are any blackjack hands in the first four cards. If the TEST BLACKJACK routine has already been accomplished previously in the hand, the next step in the HAND routine is a test of the DS1 flag to determine whose card has just been dealt. If the DS1 flag is ZERO, it indicates that its the player's card and the HAND routine exits to the PLAYER CARD routine PLRCD (see FIG. 27) to determine the next operation required. On the other hand, if the DS1 flag is a ONE, indicating that the card just dealt was a dealer's card, the HAND routine exits to the COUNT X routine (see FIGS. 14a and 14b) to assess the next action required.

If the TEST BLACKJACK routine has not been accomplished previously, a test is made for an insurance condition, (dealer ACE showing). If such a condition exists the player is allowed to accept or decline insurance. Next, a test for any blackjack is performed and if a blackjack has occurred, the routine exits to the NET routine (see FIG. 10b) which evaluates the effect on the stake in accordance with whose hand had the blackjack. On the other hand, if the TEST BLACKJACK routine determines that neither the player nor the dealer has blackjack, the routine then performs the TEST-FOR-pair decision routine (see FIG. 6) to determine whether or not a split possibility exists. If there is no pair, the DS1 check, as previously described, is then performed. If there is a pair, the split flag SP is set to indicate, for other routines in the program, that a pair has been dealt the player and that a split possibility exists giving the player the option of splitting. After the split flag SP is set, the decision operation "Are they Aces?" is then performed to determine whether or not the pair of cards that may be split is a pair of Aces. if it is a pair of Aces, the SPA flag is set, if they are not Aces, the program exits to the DS1 flag test as previously described.

The various routines of which the hand routine is comprised as well as additional routines incorporated therein and key routines will now be described in conjunction with FIGS. 7 through 30.

Figure 8A:
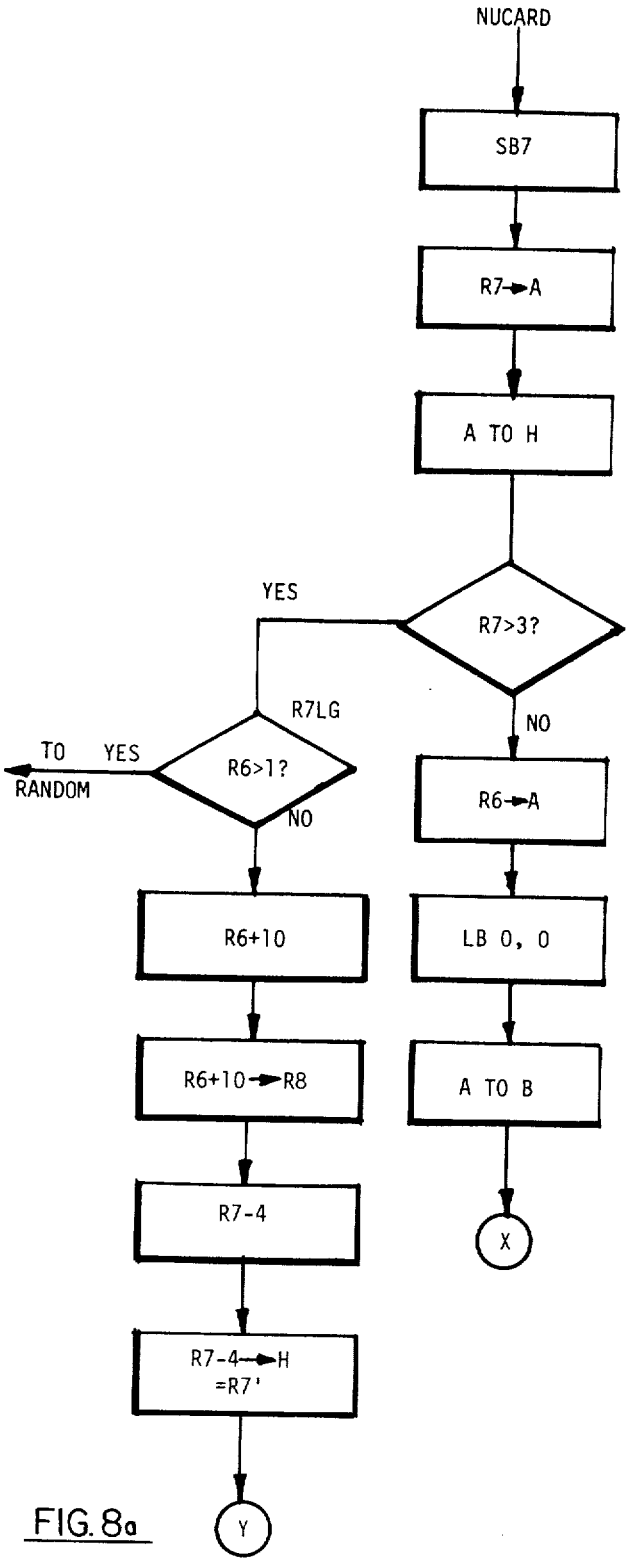
Figure 8B:
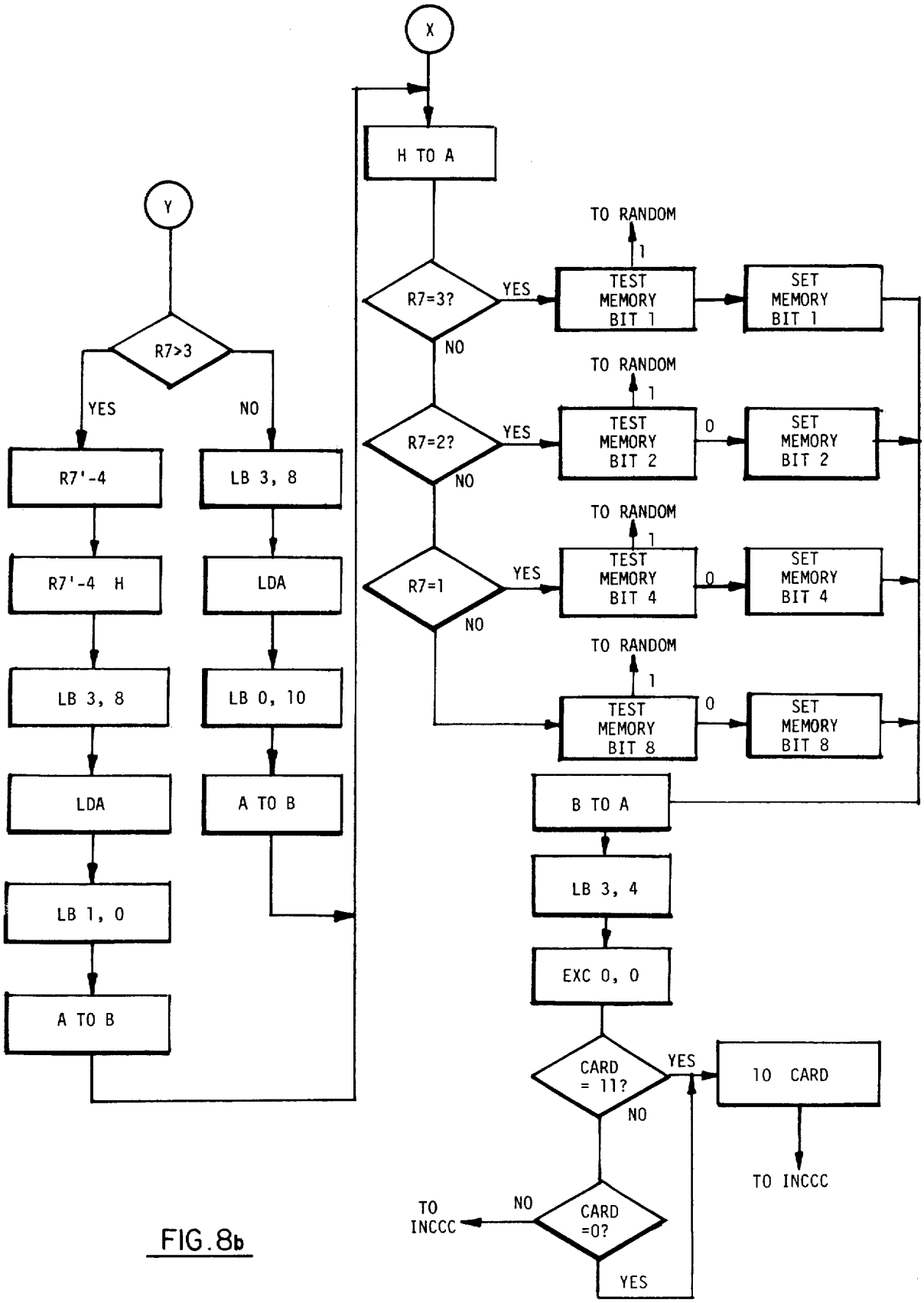

NUCARD ROUTINE (See FIGS. 8a and 8b)

The RAM indicator being at SB7, forces operations to the right side of the RAM and B is pointed to the seventh word of register R. R7, is the tens digit of the random number that will be considered as a possible card selection. R7 is loaded into the accumulator and transferred into the holding register H since the accumulator contents are destroyed in subsequent processes. The number in the accumulator is tested to ascertain whether or not it is larger than 3. If it is not larger than 3, it is known to represent a set of acceptable random numbers, (0–39).

This routine also determines whether this card has been used before in the play of the hand. The first step in doing this is to examine the units digit which is located in RAM location R6. R6 is entered into the accumulator. The B pointer of the RAM register then points to the R location having the value of R6. For example, if R6 contains the number 5, then the B register points to location 5. Since all of the card values corresponding to numbers 0–39 are located in register C of the RAM, register B should point to RAM register C. This pointing to register C is accomplished by performing an LB00 instruction to change the contents of the B register to point to register 0, (also called register C). Then the contents of the accumulator are transferred to the B register which points to the 4 bits that could contain a card corresponding to R6. For example, if R6 were equal to the number 5, the B register would point to RAM register C, location 5. Then an H to A transfer is performed retrieving the original tens digit which was previously stored in A. The tens digits is used to indicate in which of the four bits the card being searched would be considered to be located. That value will be either three, two, one, or zero, since the earlier test had shown that this value was not greater than three. A routine is then performed to correlate this number to a card storage location. The appropriate bit corresponding to that location is tested for a ONE. If that bit is a ONE, the card is considered to have been previously dealt and the NUCARD routine is exited, through the random number generation routine, to search for a new card. If that location contains a ZERO, the card has not been played and a ONE is loaded into that location to prevent its play again until the deck is reshuffled. The next step is to load the value of the new card into the location in the RAM reserved for that purpose, namely, register R, location 9. The new card is then located in that position by an exchange instruction which takes the accumulator contents and puts them into that location. Since the card value entered into this location could be either zero or eleven, this value is tested for those conditions and if either of them is met, a 10 card value is inserted instead, since a zero and an eleven are considered a ten in the number assignments representing the 52 cards. The NUCARD routine is exited and the increment card counter routine ICCC is entered.

If the R7 term is greater than three, the NUCARD routine performs the steps called R7LG, (R7 large). Numbers larger than 39 can be considered valid cards only if they are the numbers 40, 41, 50, 51, etc. A number like 56 for example, would not be a valid candidate for a new card. Only a number ending in zero or one can produce a valid card. Accordingly, a test is made to determine whether the ending digit is greater than one.

if it is, this loop is exited, and a number generation again performed. If it is less than two, in other words zero or one, then 10 is added to R6 and the result, which will be either 10 or 11, is stored in register R location 8 for future reference. Then the tens digit, that is the R7 digit, is examined and 4 is subtracted from this digit. The sum of R7 minus 4, (called R7'), is put into the H register and the new total is examined to determine whether this number is greater than 3. If it is not greater than 3, it is tested in the same manner as R7 numbers less than 3 for the actual location of the card. The only difference is that the register C address must be either 10 or 11. This is accomplished by loading R6 plus 10, which is in LB3,8, into the accumulator, then performing an LB 0 to point to register C with an A to B transfer which points to either word 10 or word 11, depending upon the value of R6. If the new R7 turned out to be larger than 3, a second subtraction of 4 is required. This second subtraciton forces the number to be in the range zero to three inclusive. However, before the R7 loop is entered, it is necessary to point to register S since the only possible card combinations corresponding to these values reside in the four cards stored in the S register.

Figure 11:
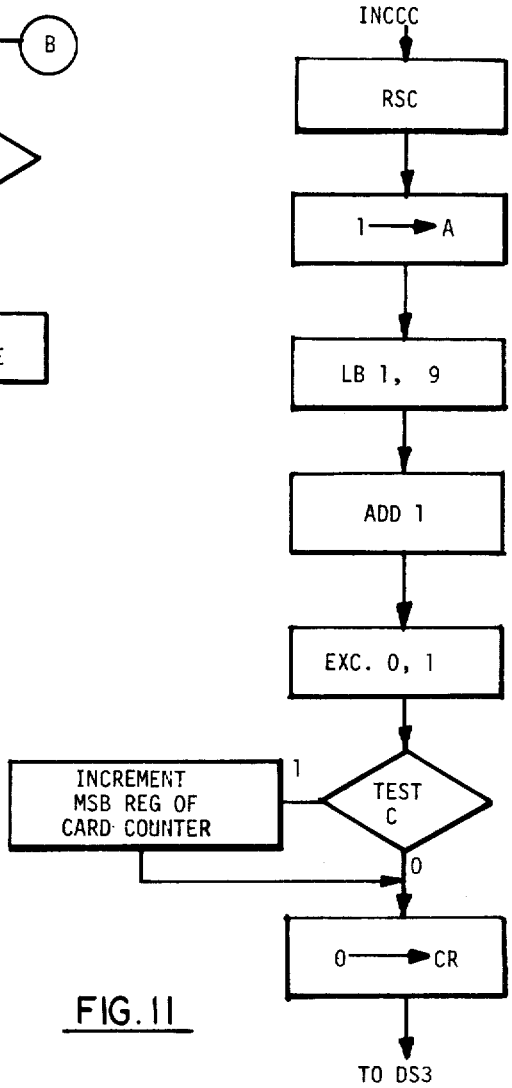

INCCC ROUTINE (See FIG. 11)

The Increment Card Counter routine INCCC begins by re-setting the carry flip-flop. Then a 1 is inserted into the accumulator and the B register is pointed with an LB1,9 to the least significant bits of the card counter. The function add 1 is performed, where the 1 stands for an add with carry, so the contents of the card counter are added to the accumulator. If there is an overflow, the carry flip-flop is set in this operation. The new results of this add operation are then placed into the card counter as an updated card total and the carry flip-flop is examined. If the carry is not set an overflow has not occurred and no further operation is required. If the carry is set, it is necessary to increment the word in location register S10. This is done with an add 1 subroutine. Once this has occurred, the card required flag is reset indicating that the cycle has been completed and the routine progresses to DS3.

Figure 7:
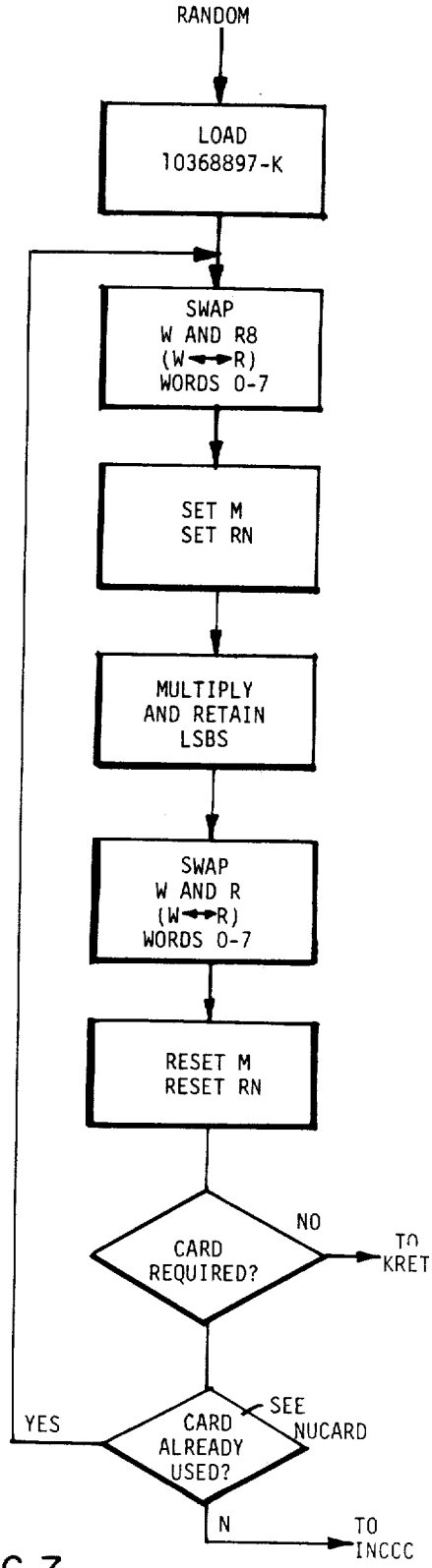

RANDOM ROUTINE (See FIG. 7)

Random begins by inserting the random generation key number which is 10368897 into the K register. Then a previously chosen seed number, which is located in the R register, is transferred to the W register. These two numbers are then multiplied together. The 8 most significant bits of the result of this multiplication are dropped, and only the least significant bits are used for the random number. This is accomplished by modifying the usual multiply routine, which is classified as MD1, with a flag which is called RN. In the random routine, a 1 is set into RN which indicates that an other than normal multiply operation is to follow. This is the means for discarding the most significant bits. After the multiply operation is accomplished, the W contents are entered again into R and the flag RN is reset. Now the potential random card selection is located in R and the two numbers used are located in R6 and R7, R7 being the most significant or the tens digit and R6 being the units digit. After this process, the card required flag CR, is examined and if no card is required, the RANDOM routine is exited back to the keyboard return routine KRET. If a card is required in the play of a hand, then CR will be set during this time and the RANDOM routine is exited to the new card routine NUCARD. The result of the random routine, other than mere random number generation where the routine exits through the key routine, is an exit to INCCC and through DS3. This implies that an unused card has been found which is now available for the play of the hand. Action continues through DS3.

THE DS3 ROUTINE (See FIG. 6)

The DS3 routine is contained in the basic hand routine and it consists of two steps. First, the third bit or DS3 of RAM location R10, is examined to determine whether it is a ONE or a ZERO. If it is a ONE, it implies that all of the cards in the initial deal of the hand, that is, the first two cards to the dealer and the first two cards to the player, have been dealt and it is no longer necessary to switch between the dealer and player hands as it is in the beginning of the hand. If DS3 is zero, it implies that the deal of the first four cards is in progress and the steering bit, which is DS1, is incremented to steer the cards either to the dealer hand or to the player hand depending on the card dealing sequence.

Figure 9:
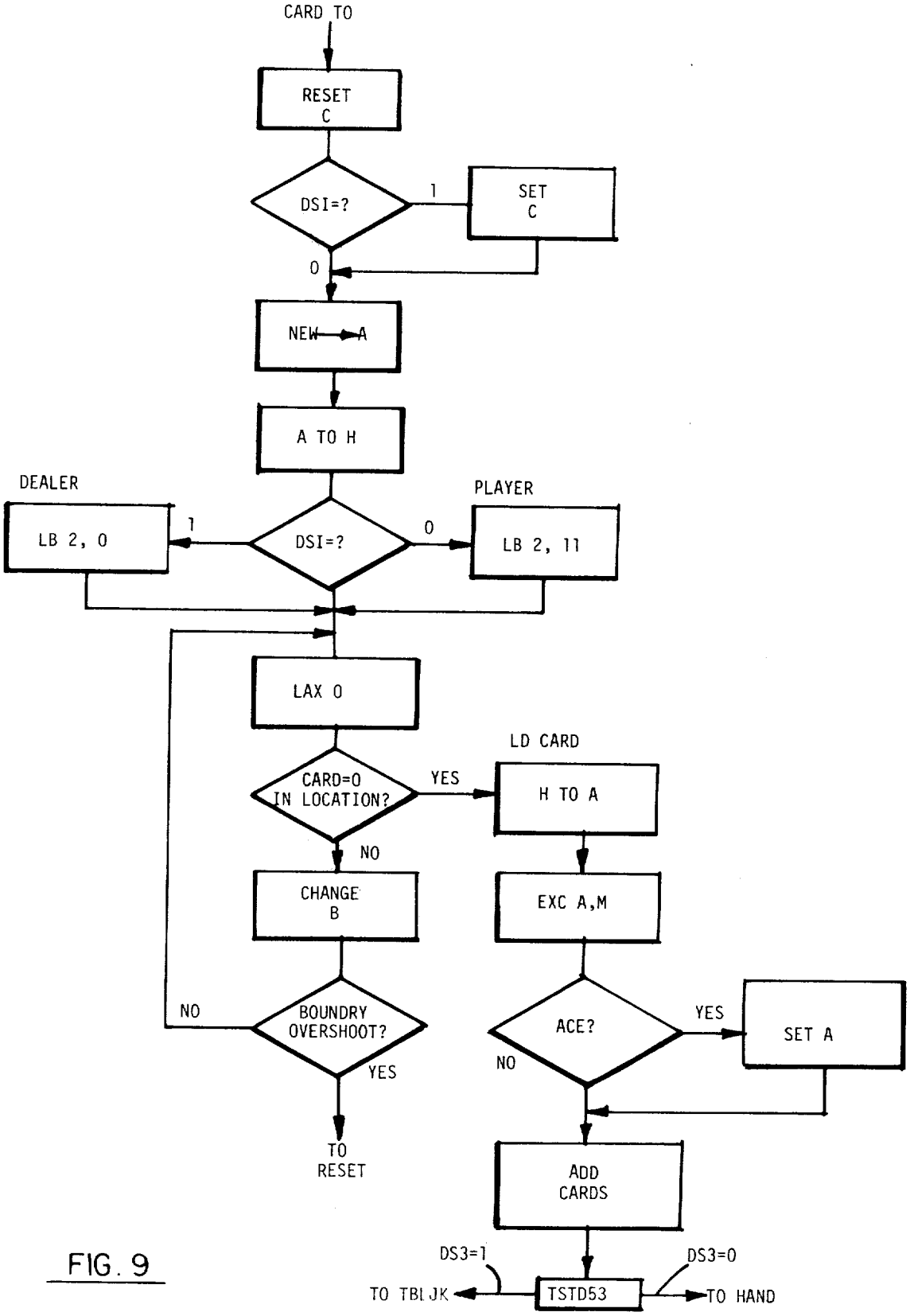

THE CARDTO ROUTINE (See FIG. 9)

The next routine, called CARDTO, involves the actual distribution of the card to the correct location.

The first step in this routine is to reset the C flip-flop. Then DS1 is tested and C is either set or reset depending upon the state of DS1. If it's a ONE, C is set. Now the new number that was previously stored in location NEW during the NUCARD routine, is loaded into the accumulator and the contents of the accumulator are stored in the H register for future reference. The routine is again called upon to check the state of DS1 and the B pointer is pointed either to B 2,11 if it is a player card to be dealt or to B 2,0 if it's a dealer card to be dealt. Then that location is tested for ZERO. A ZERO implies that no card resides in that location and the NEW card can be loaded there. Thus, if the location is ZERO, the card is retrieved from the H register and an exchange takes place between the accumulator and memory. This new card is now tested for a value of one, which implies it was an Ace. If it was an Ace, the Ace flag is set to be used later in the program for the situation where the Ace can be treated as a value of either 1 or 11 and also in the test for blackjack. Then this part of the routine exits to the add cards routine which is discussed below. Returning now to the situation where the card location examined already contains a card, it is necessary to move the B register pointer up or down to the next possible card location. If it's a player card being dealt, B is changed toward a smaller number or up in the RAM map of FIG. 4. If it's a dealer card, B is changed toward a larger number or down in the RAM map. However, if the boundaries of the RAM chart are overshot, the play discontinues and the routine exits to RESET which causes the total play of this particular hand to be ignored. The stake total is unchanged if this occurs so the effect of the play of the hand is completely negated.

Figure 10A:
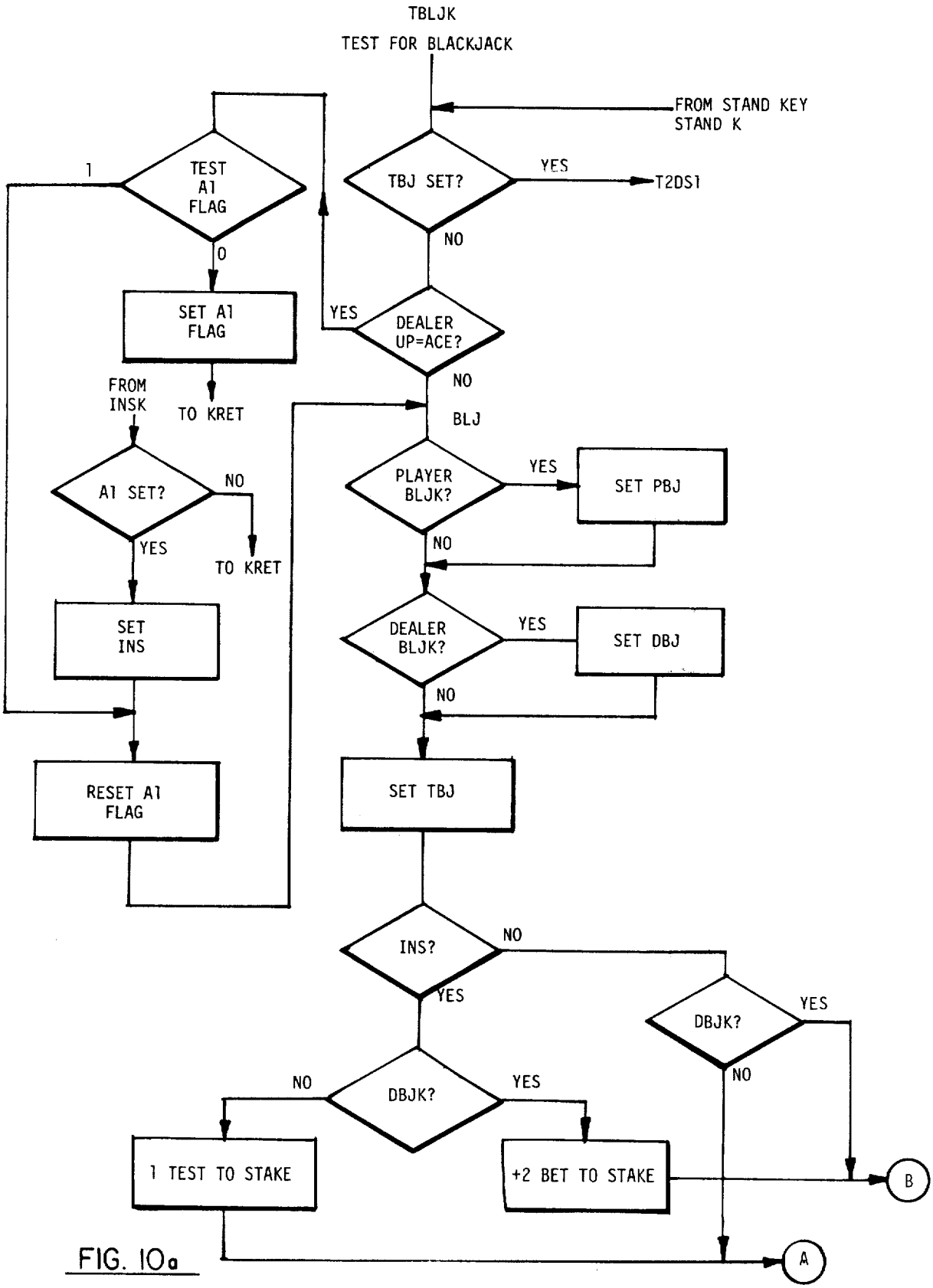
Figure 10B:
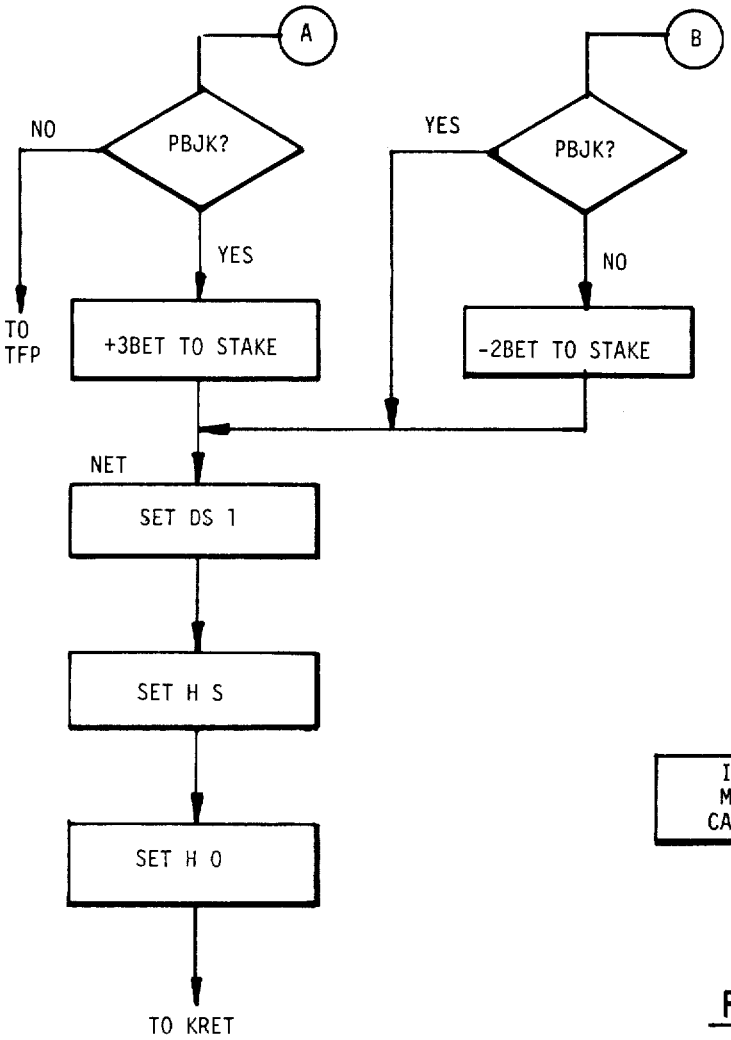
Figure 10C:
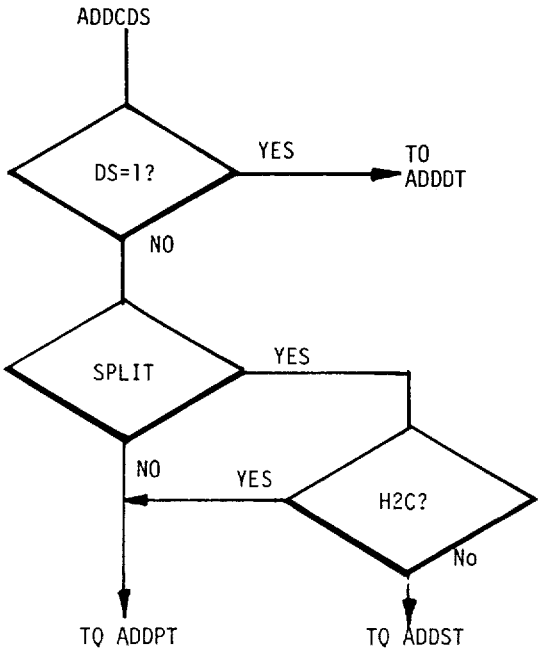

THE ADD CARDS ROUTINE (ADDCDS) (See FIG. 10*c*)

The general purpose of this routine is to determine which has just been dealt; a card for the dealer's hand, a card for the player's hand, or a card for the player's split hand, (one of two hands possible in the split condition). Having dealt a card to one of these hands, the running total kept on these hands is incremented by the alue of the card that was just dealt. The first step in oing this is to determine whether the card was dealt to he dealer or the player by examining bit DS1. If that bit s set, it was the dealer's hand and the routine exits to he subroutine add dealer's total ADDDT. If the DS1 it is reset, it's the player's hand. The test for a split and and H2C is then performed to choose to add the ard value to the player's normal hand or to his split and. All three of the routines; add dealer total ADDDT, add player total ADDPT, and add split total ADDST, are called by the ADDCDS routine. They are liscussed below as the ADDX routine.

Figure 12:
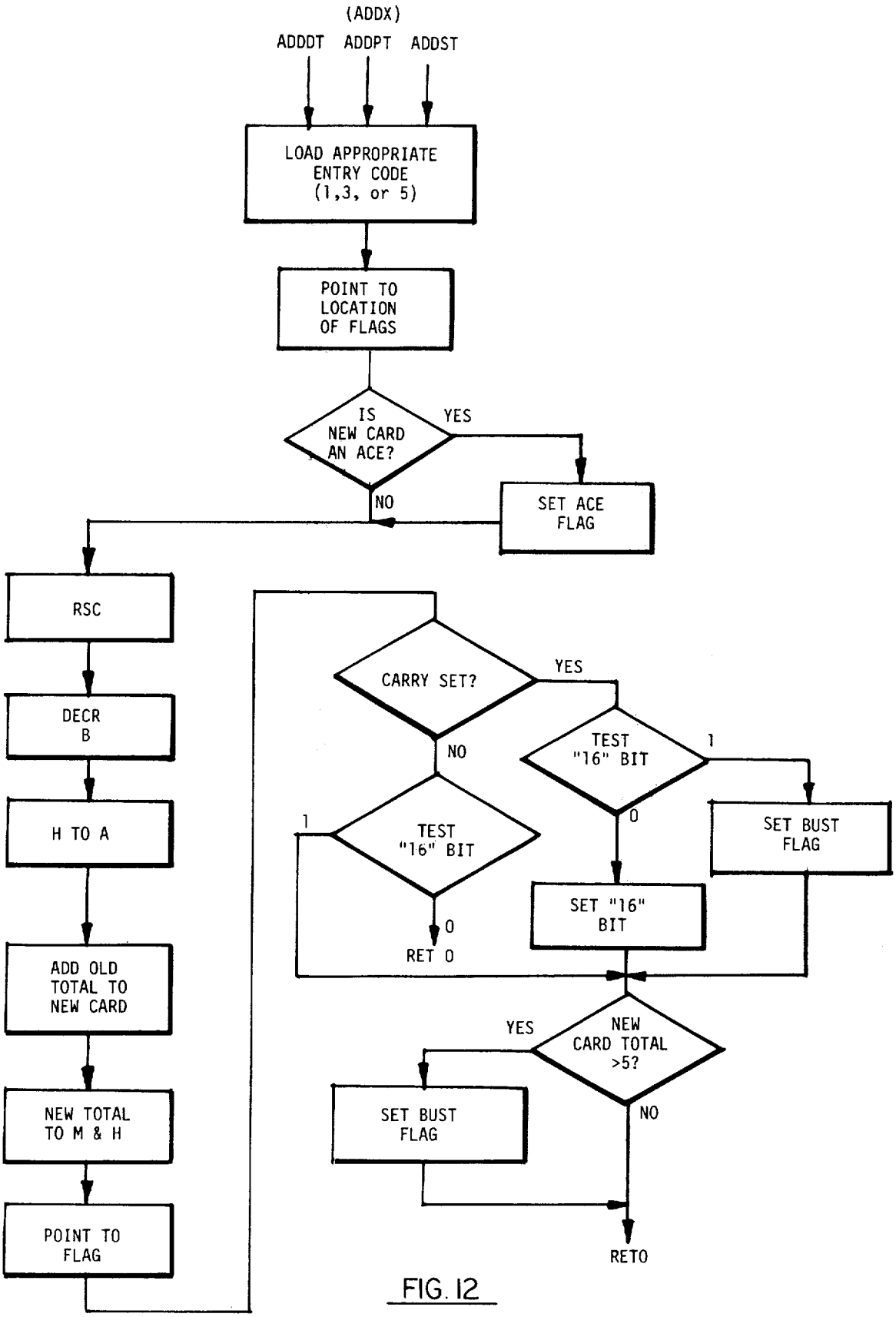

ADDX ROUTINE (See FIG. 12)

The function of this routine is to add the total of the ew cards to the total of the cards that have previously een dealt to the player, dealer or split hand. This rouine can be entered from three different calls, ADD ealer total, ADD player total and ADD split total. The routine is entered through one of these and a flag is oaded with a corresponding entry code number 1, 3, or by means of the LAX instruction. Once the LAX nstruction has been executed, additional LAX instrucions will not be executed until a different instruction is ncountered.

The next operation is to point toward the proper flag ocation for the player, dealer or split hand as required. The card is then tested to see whether it was an Ace or not. This is accomplished by testing the carry bit which was set by a previous routine if the new card is an Ace. If the card is an Ace, the Ace flag, which is bit 1 of the lag location, is set. The carry flip-flop is then reset to be used in the next routine and the B counter is decrenented to point toward the memory location that has he appropriate total from the previous hand. The new card, which has been stored in H, is next put back into he accumulator and the existing total is added to what s in the accumulator and this new total is placed into the memory location. Additionally, this new total is placed into the H storage register. The routine again points to the flag location corresponding to this hand and proceeds to test the carry bit to see whether the new total is larger than 15 and has thus overflowed after the addition of the new card.

If the new total has overflowed, it implies that there is a new total of at least 16 and the routine looks at flag bit 2 ('16' bit which indicates whether total has already reached number greater than 15) of the flag pointers. If bit 2 is set, it implies, a "bust" condition because the total is at least 16 plus another 16, or 32, and therefore, the bust flag is set. If the 16 bit has not been set, it is set at this time. The next step, is testing the new total that is in the total location which has also been stored in the H register, to determine whether it is greater than 5. If it is greater than 5 the hand is busted since the 16 bit, which is the flag bit that has previously been set, and a number greater than 5, would also result in a busted hand. Therefore, if the total is greater than 5, the bust flag is set and the routine exits to return zero. If it is not greater than 5, the routine exits through return zero without setting the bust flag. Return zero is a standard subroutine exit which puts the program back to the next instruction in the sequence from the calling routine. If there had been a return one instruction instead, the program would exit to the location one after the return zero location.

Returning to the test for the new total greater than 15, (test carry), if the new total is not greater than 15, the routine proceeds to test the flag bit 16 to determine whether it is set or not. If it is not set, it implies that the total for the hand is less than 16 and there has been no bust. The routine is then exited through a return zero. If the 16 flag is set, the routine tests for greater than 5 as discussed previously and exits in the same manner. The return of any of the three add routines is to the next step in the program which is DS3 in the HAND routine.

At the test DS3 instruction, the bit DS3 is examined. If it is a zero, it implies that the program is still in the process of dealing the first four cards. The program returns to the beginning of the hand routine and finds another card and continues to deal. Once the four cards have been dealt, DS3 will be set to one. When this happens, the program goes on to TBLJK, the test blackjack routine.

THE TBLJK ROUTINE (See FIGS. 10*a* and 10*b*)

In the test blackjack routine the first thing done is monitoring the flag TBJ which indicates whether the program has been through this routine before or not. After the first time through, that is, after the first four cards are dealt, there is no need to repeat this test for every new card. During the first cycle through this routine, TBJ will be zero and the routine proceeds. The routine next tests the dealer's showing card (up card) to determine whether or not it is an Ace in preparation for asking for insurance.

If the dealer's up card is an Ace, the routine tests to see whether the accept insurance (AI) flag is already set. If it is not set, the AI flag is set and the routine exits to the key routine to wait for the player's decision to accept or decline the insurance. If the flag is already set, it implies that the program has been through the routine before and the routine exits to reset the AI flag and continue on. Assuming that the program has not gone through this routine before, the accept insurance flag is set and the program waits for depression of either a stand key, which implies that insurance was not desired, or of an Insurance key, which implies that insurance is desired. If the Insurance key is depressed, the accept insurance flag is retested to see that it is a valid option and that the player may accept insurance. If not, the routine exits to the key routine. If the accept insurance is set, the routine sets a flag called INS, or insurance, and resets the accept insurance flag to prohibit entereing this routine again during this hand. The routine then continues with the part of the routine called BLJ.

If the program enters the TBLJK routine through the Stand key, it proceeds down through test blackjack and test up card operations and examines the accept insurance flag. If it is now set, which would normally be true in the insurance case, the routine resets the accept insurance flag denying any further insurance option.

After that decision, the routine commences BJL, where it tests for the actual condition of blackjack. It begins by testing the player's two cards to see if they correspond to blackjack which is represented by a 1 and a 10. If the player has this combination, the routine sets a flag indicating player blackjack (PBJ). If not, that flag is not set. In either case, the routine proceeds to test the dealer's hand for blackjack and if the dealer has a blackjack, the routine sets a flag called dealer blackjack (DBJ). If not, the routine merely proceeds to the next step which is setting the TBJ flag. This allows the program to bypass this routine the next time a card is dealt. Having set this flag, the routine is now prepared to examine the outcome of the hand and if there are any blackjacks it makes the appropriate payoff. The above portion of this routine can be considered to have occurred in two instances. First, if there was no insurance involved, or INS is zero, the dealer blackjack flag is tested and if the dealer has a blackjack, the player blackjack flag is tested. If he also has a blackjack that represents a tie and the routine exits through NET. This exit will set DS1 to a ONE which is used for display purposes for unveiling the dealer's down-card. If the player did not have a blackjack, then he has lost the hand and two units are deducted from the player's stake.

Returning to the test of the dealer's blackjack, if he did not have blackjack, the routine tests for a player blackjack. If the player also did not have a blackjack the routine exits to test for pair or TFP. If the player did have a blackjack, he wins one and onehalf units which represents a 3 in the accounting system and that number of units is added to the stake. The routine then exits through NET. If there was insurance involved, the same routines occur except first the routine considers the insurance payoff. If the dealer did have a blackjack, the player is credited with 2, representing his return on his insurance bet. The routine then transfers to test for player blackjack as before. If the dealer did not have a blackjack, half of the player's bet or one unit is debitted from the pool and the routine proceeds to test for player's blackjack and rewards him accordingly. The NET routine sets three flags. It sets DS1 to reveal the dealer's card, it sets the flag, hand started, (HS) which locks out some of the game keys, and it also sets the flag, hand over HO. All of these flags represent a hand terminated condition which prohibits entry of other game keys at this time. The NET routine is then exited to the keyboard routine, KRET. If the hand is not a blackjack hand, the TBLJK routine exits to the routine called TFP or test for pair which will be discussed next. It should be noted that the accounting system internal to the program is based on doubling all values entered through the keyboard and halving all totals before they are output to the display. This is done to remove the requirement for handling fractional values e.g. 1.5, 0.5 occurring in the blackjack and insurance cases. Therefore, a normal win of bet value 'B' results internally to the program in an increment of 2B units.

TEST FOR PAIR ROUTINE TFP (See HAND ROUTINE FIG. 6)

Following the TBLJK routine, (not blackjack condition) a test is made for a pair of player's dealt cards. If the cards are the same, a flag SP is set indicating that it is a pair. A further test is then conducted to determine whether the cards are Aces or not. If they are Aces, a flag called SPA is set. If they are not Aces, the routine continues to T2DS1. It will be recalled that the pertinent card has already been added to the hand total whether it is the dealer's of the player's hand, and determination has been made regarding whether this additional card has caused the hand to bust or not. In the test T2DS1, if the DS1 bit is ZERO, the program proceeds with the routine player card PLRCD.

Figure 30:
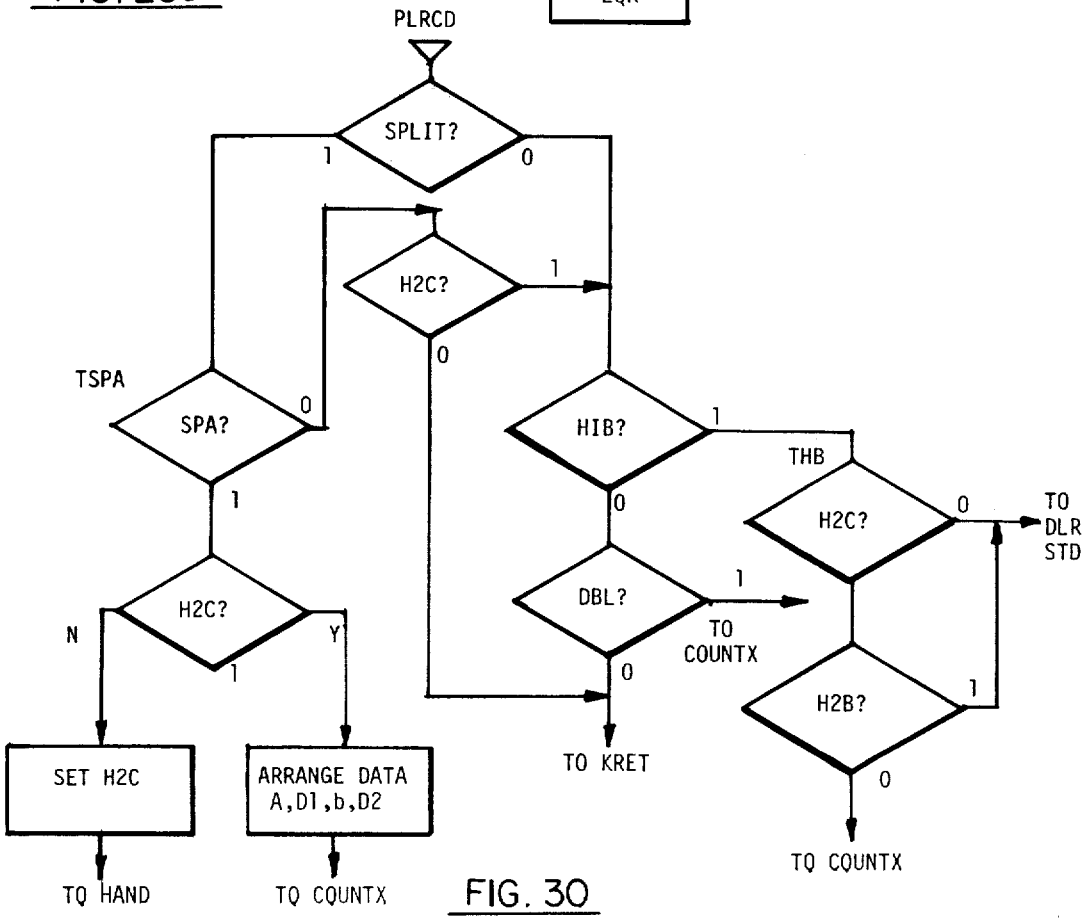

PLAYER CARD ROUTINE (See FIG. 30)

PLRCD involves first testing for the split flag and if it is ZERO the routine proceeds to test for a bust hand. If the hand is bust, the routine exits through THB. If the hand is not bust, a test is performed for a double condition. If a double condition exists, no further cards will be dealt and the loop is exited to the COUNT X routine. If it is not a double condition, the loop is exited back to the keyboard routine KRET to await further player options. Returning to PLRCD, if the split situation does exist, then the next test performed is test for a split of Aces at the check point TSPA, or test for split Aces. If the pair of cards that was split were Aces, then a check is made to determine whether the second hand is complete, H2C. If the second hand is complete, it implies that both hands have been dealt one card and the loop is exited through COUNT X. If the second hand is not complete, a card is dealt into the second hand, and the set-hand-complete flag is set, indicating that this hand has now received its second card. Then the loop is exited back through the subroutine HAND where a card will be delivered to the other split hand. When the routine is exited from hand 2 complete H2C, the operation arrange data is performed so that the display will show the two hands separated by a blank rather than showing four continuous cards in a row. Returning to the point TSPA, if the split cards are not Aces, a test is made on H2C or hand 2 complete. If hand 2 is not complete, the routine is exited to the key routine to wait to receive further instructions from the player. If hand 2 complete is TRUE, hand 1 is tested for bust condition. If hand 1 is busted, the routine is exited through THB. In the routine THB, or test hand bust, a test is made to determine whether the second hand is complete. If the second hand is complete, a test is made to determine whether the second hand has busted. If it is not complete, it implies there is no valid hand to be processed ant the routine is exited to DLR STD. If hand 2 is busted, it implies that both hand 1 and hand 2 are busted and the dealer does not require a draw. The routine is therefore exited to dealer stand DLR STD. If hand 2 is complete and not bust, exit is made through count X.

Figure 14A:
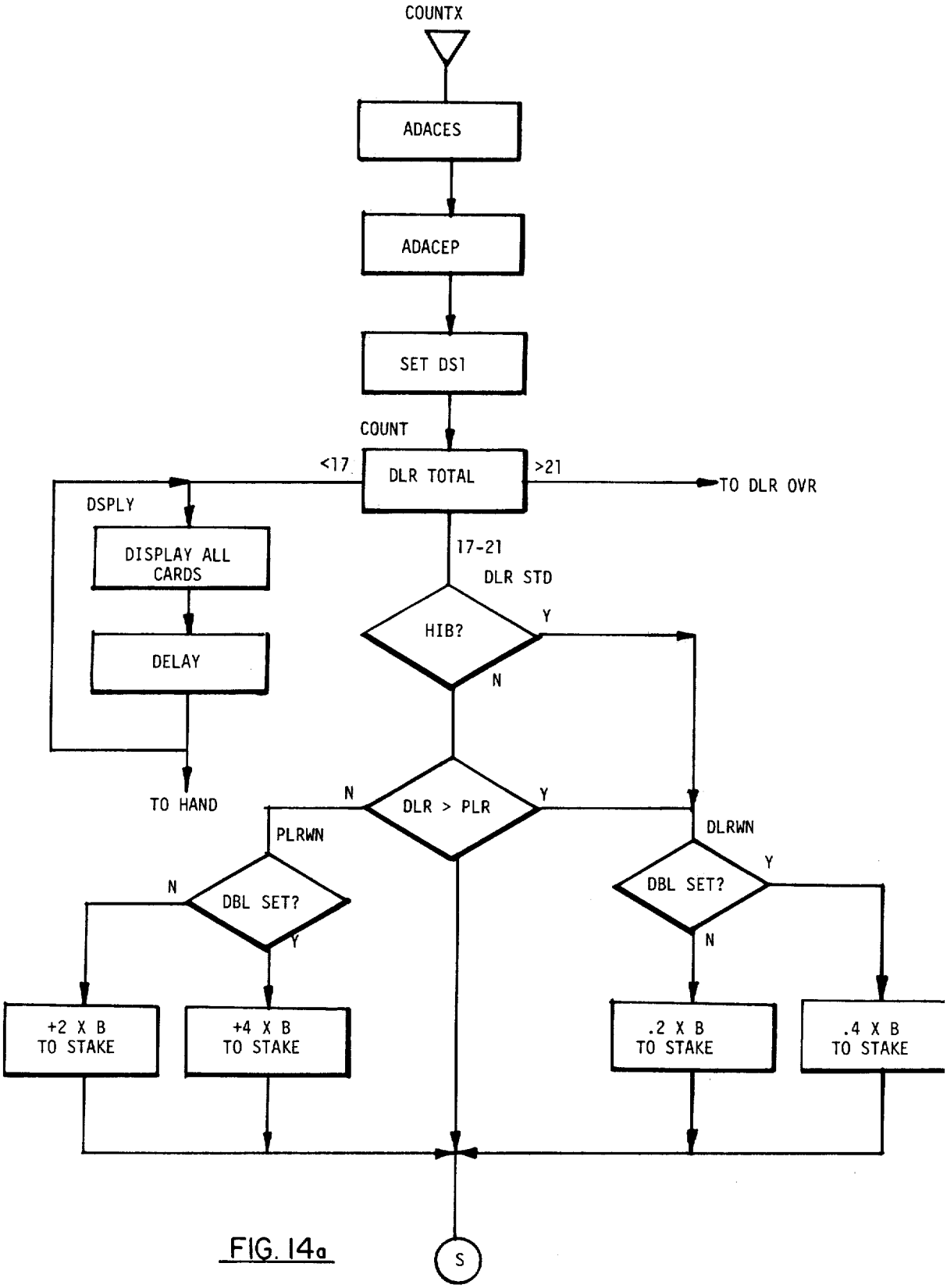
Figures 14B, 15:
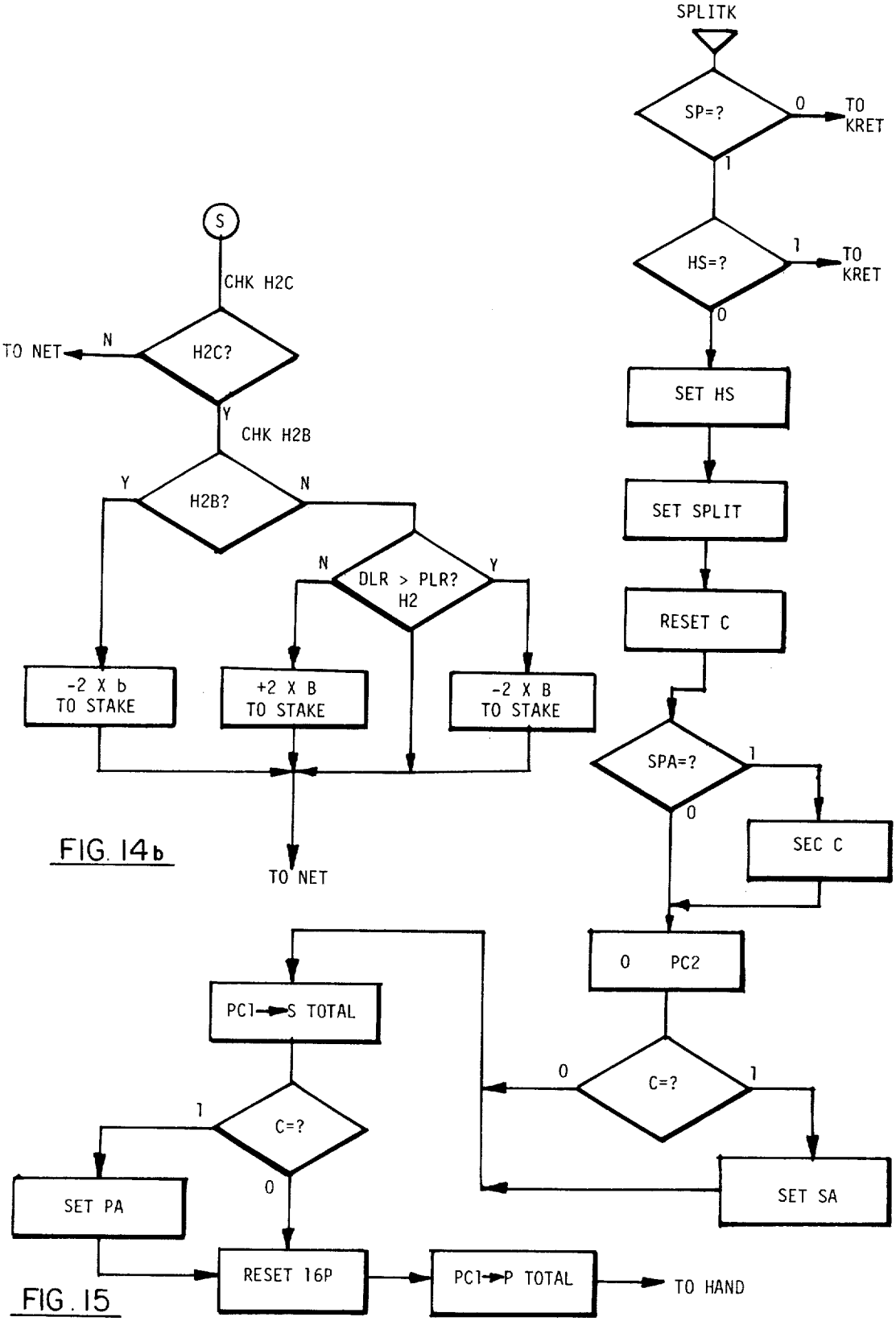

COUNT X ROUTINE (See FIGS. 14*a* and 14*b*)

Entry into this routine implies that the player has terminated his portion of the hand and it is now up to the computer to calculate the player's total outcome in one of three fashions. It can determine that he has busted his hand, that he has a soft hand which implies for example, an 8 and a 1 which is converted to a hard hand which totals 19, or it could be just a normal total such as a 9 and an 8 giving him a total of 17.

The basic function of the count X routine is to establish the player's actual valid total. The first entry point for count X involves turning the potential soft hand or the hand containing an Ace into a hard fixed total. This is done with a routine called add Ace. The routine can be either add Ace S which would be add Ace to the split hand, add Ace P (player hand) or add Ace D for adding Ace to the dealer's hand. The add Ace routine is shown in FIG. 13 to which the description will now divert.

Figure 13:
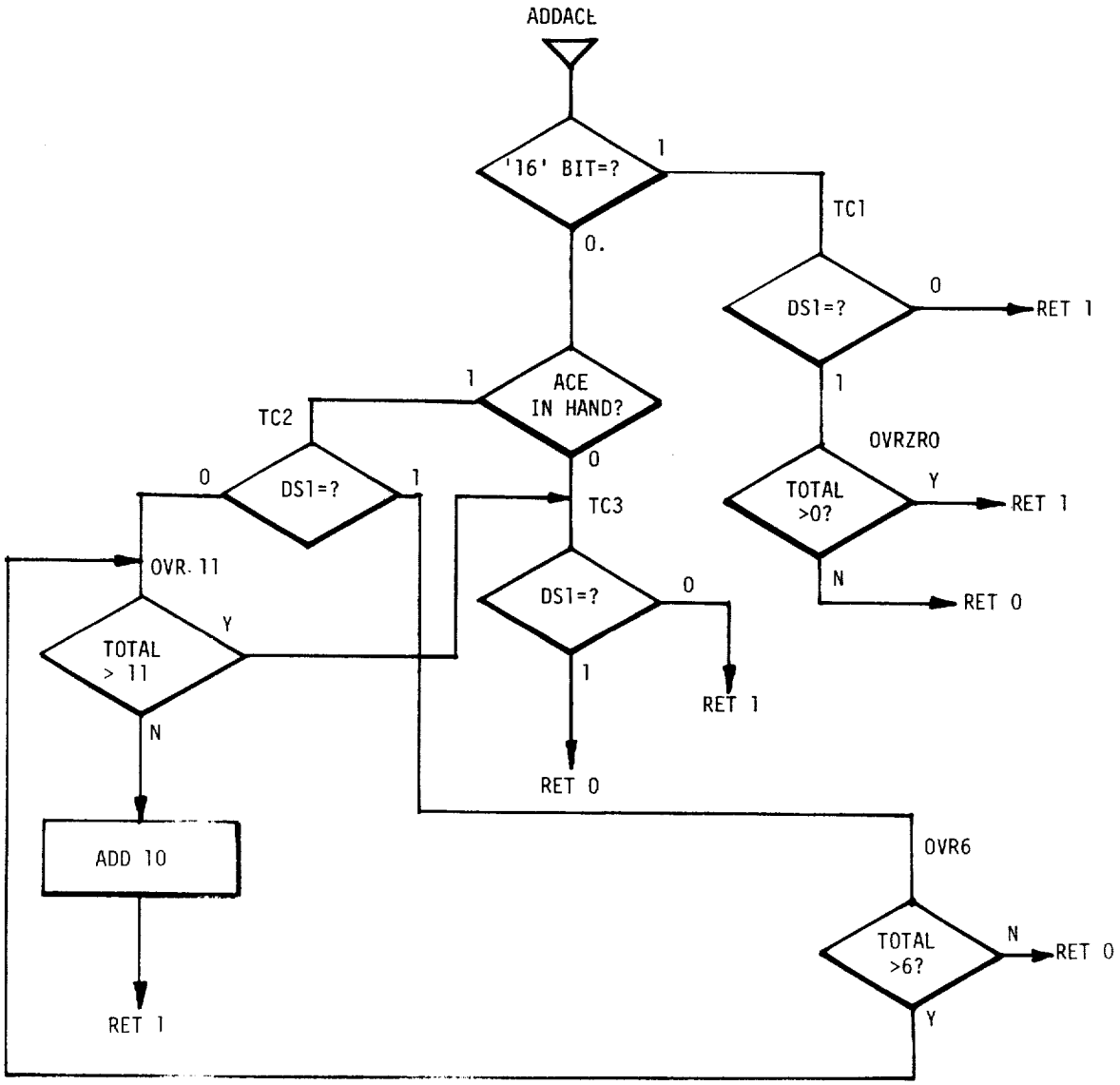

ADD ACE ROUTINE (See FIG. 13)

The first test that is made is whether or not the hand contains a total of at least 16 by testing the flag '16'. If a total of at least 16 is shown, then a determination is made as to whether the hand being considered is the player's hand or the dealer's hand. This is done by testing DS1. If DS1 is ZERO it implies it was a player's hand and the routine is exited through the Return 1 implying that nothing need be done to the player's hand. If it is a dealer's hand or DS1 is ONE, a further test is conducted to determine whether the contents of the total register are greater than zero. If the register contents are greater than zero, it implies that the dealer has at least 17 and no further cards are required. Therfore, Return 1 is again used to exit the routine implying that the hand need not receive further cards. If the total in the dealer's register is zero, it implies he has only 16 and requires a hit. This is achieved by exiting the loop through return zero which ultimately will return the routine to the HAND routine for the distribution of another card to the dealer.

If the 16 bit is not set, implying that the hand being considered does not have a total value of at least 16, the next step is to determine whether there is an Ace contained in the hand. If the answer is no, there is nothing more that can be done to the total and a test is made of DS1 to determine where the routine should exit. For the dealer's hand that would imply dealing another card, and for the player's hand that would imply that the hand is terminated.

Returning to the test for Ace, if there is an Ace in the hand, then a determination must be made as to whether it is a dealer's hand or a player's hand. If it is a player's hand, a test is made on the total to determine whether it is more than 11. If it is more than 11, adding 10 to this hand would bust the player and this addition would not be made. The routine is then exited through return 1. If the total is less than 11, a 10 is added to the hand making it a so-called hard hand and the routine is again exited through Return 1. If the hand being considered is the dealer's hand, a test is first made to determine whether the dealer's total is greater than 6. If it is greater than 6, adding 10 to this total will give him at least 17 which is his stand hand. The loop is directed back to the add 10 cycle and finally exited through Return 1. If the dealer's total is less than 6, even the addition of 10 would not give the dealer a pat hand and the routine is exited through a Return 0 which will ultimately result in another card being dealt to the dealer's hand.

COUNT X ROUTINE (Continued)

Returning now to the beginning of count X routine, the first two entries were Add Ace to the split hand and then Add Ace to the player's hand, which were discussed above. Following this activity, DS1 is set to ONE, implying that it is now time to process the dealer's hand. The next routine is the COUNT routine. In this routine, the dealer's total value of cards is examined. There are three possible outcomes of this examination. The dealer can have less than 17, which requires that an additional card be dealt to his hand, or he can have 17 through 21, which is a pat hand, or he can have over 21 which implies that he has busted. If the dealer has less than 17, the COUNT enters the display subroutine in which all of the cards, including the hidden card, are displayed with an approximate ⅛ second time delay to add realism to the dealing of the dealer's next card. Then the HAND routine is re-entered to deal another card to the dealer's hand. This results in a normal flow through the HAND routine again. However, this time, because DS1 is set, the player card process is bypassed and the program returns directly to count as is shown in the HAND flow chart of FIG. 6.

The second option to examine is the case where the dealer has acquired a card value of more than 21. The dealer's hand is bust and the routine is exited to dealer over DLROVR which will be discussed next.

Figure 16:
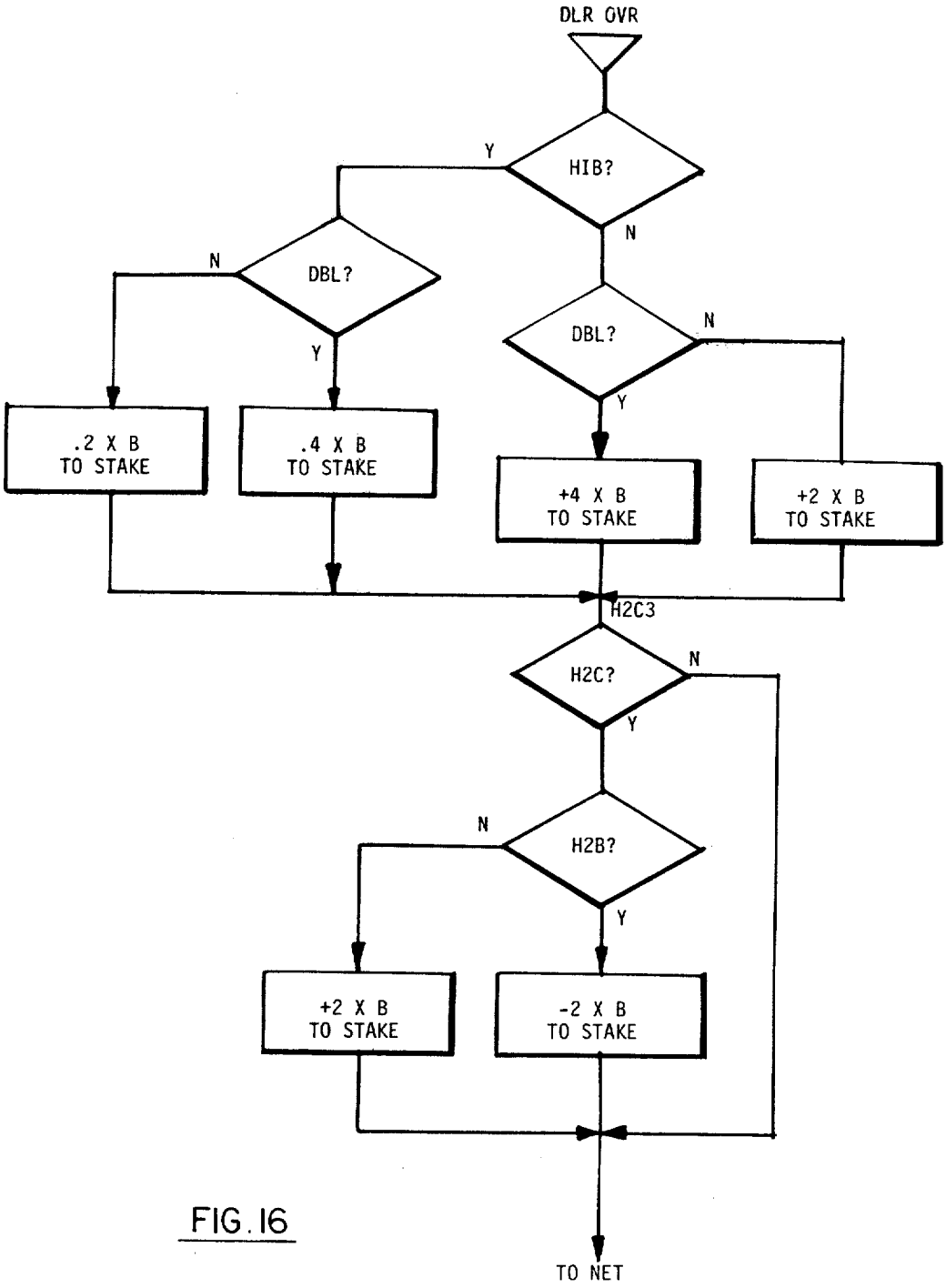

DEAL OVER ROUTINE (See FIG. 16)

If the dealer is over, a determination is made first whether the first player hand is bust. If the player hand is bust, the player will be debited for the hand. The routine next tests to determine whether the hand was a double situation. If it was a double situation, four betting units are subtracted from the stake since the player lost a double bet. If it was not a doubled hand, two betting units are subtracted from the stake.

If the player's hand is not bust, the player is given credit for winning his first hand and the double test is again made.

If no double was recorded, two betting units are added to the stake. Next, a test is performed to determine whether a second hand was dealt, in other words, whether there had been a split situation. If there was no split situation, the routine is exited to NET. If there was a split situation, the second hand is tested for bust. If the second hand was busted, two units are subtracted from the betting stake. If it was not busted, two units are credited to the betting stake. In either case, the routine is again exited to NET.

COUNT X (Continued) (See FIGS. 14*a* and 14*b*)

Returning now to the basic routine of count X, the third option for the dealer total is that the dealer total is in the range of 17 to 21 inclusive. This condition is called dealer stand.

Dealer stand begins with a test of hand one bust H1B. If hand 1 is busted, the routine proceeds to dealer win DLRWN. The double is tested to see whether the player's stake is debited four units or two units.

Next the check hand 2 routine, CHKH2C, is entered and hand 2 complete H2C is tested. If hand 2 complete is ZERO, it implies that there was no second hand or no split situation. The routine exits to NET if hand 2 complete is 0. Hand 2 bust H2B is tested to determine whether a comparison of the dealer's and player's hands is required. If hand two bust is TRUE, two units are subtracted from the player's stake. If the hand did not bust, a comparison is made between the dealer's total and the player's total for hand 2. If the dealer's total is greater, two units are subtracted from the player's stake. Of course, if the player's total is greater, two units are added to his stake. If it is a push, or the totals are the same, nothing is done and the routine exits to NET.

Returning to the decision point of the dealer stand routine, if hand one was not busted then a direct comparison is made between the total of hand one and the dealer's total. If the dealer's total is greater, the routine proceeds to dealer win DLRWN and proceeds as previously discussed. If the player's total is greater, player win PLRWN is performed next and once again the double is tested to determine whether four units or two units should be added to the player's stake. If the hands are tied, nothing is done. In all cases the routine proceeds to check hand two complete as described above.

In summary, if the dealer's total is less than 17, the HAND routine is entered to deal other cards until the dealer's total is something greater than 16. Once this is completed, the basic play of this hand is concluded and the remaining steps related to evaluating the outcome of the hand and making the correct pay-off are accomplished. This completes the basic program for the play of one hand.

A discussion of the keys involved in the player interaction of the game now follows.

Figure 21:
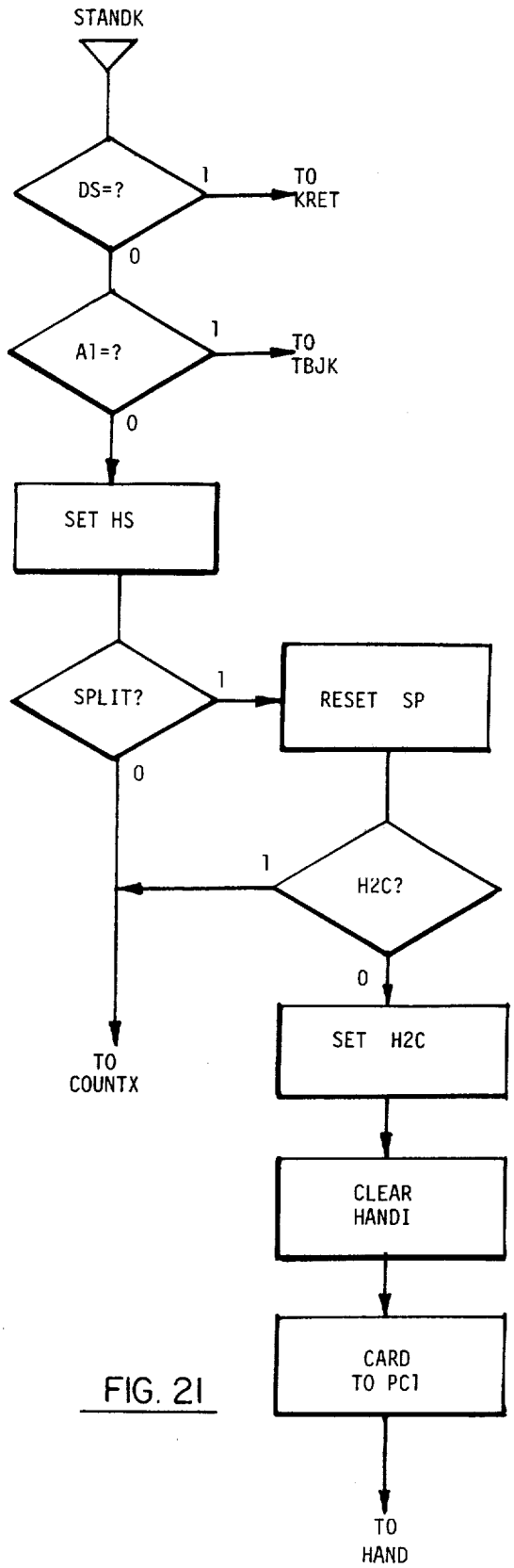

The first key to be discussed is the Stand key STANDK (see FIG. 21). This key is interlocked by DS1 so that if DS1 is ONE the routine will not accept this entry. This interlock prevents the player from affecting the game once he has previously decided to stand. Assuming that DS1 is ZERO and the player is still in the play of the hand, the first test made is to determine whether accept insurance is set. This would occur with an Ace showing in the Dealer's hand and would represent the first time the cards had been dealt. If Accept Insurance (AI) is set, the routine transfers to the test blackjack routine which was described above, which interprets this key as Decline Insurance. If Accept Insurance is not set, the Hand Started flag HS is set. This flag is used in rejecting various keys that would be possibly depressed out of sequence for the normal of the game.

Once flag HS is set, the Split Flag is examined. If no split was indicated, this concludes the play of the player's hand and the routine is exited to Count X. If a split is indicated, the flag SP is reset to allow termination of this hand, then hand two is tested for completion. If hand 2 is complete, it implies that both of the split hands have been played and that the stand is the final stand for this hand and the routine exits through Count X. If hand 2 is not complete, it implies that the stand was meant for the first hand only and now it is required to deal the second hand.

The first step in the dealing of the second hand is to set hand 2 complete which prevents entry into this routine again during this hand. Then the cards of hand 1 are cleared away and the first card of the new hand or hand 2 is loaded into position. The routine then exits to the HAND routine for the dealing of the second card for the split hand.

Figure 19:
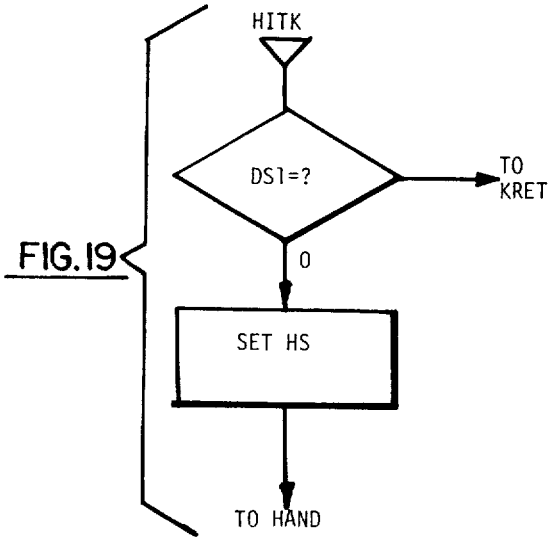

The next key to be discussed is HIT (see FIG. 19). Once again a test is made first on DS1 and if DS1 is ONE, implying that the player's hand has been terminated, the key is rejected. If DS1 is ZERO, the flag HS is set and the routine enters the HAND routine to deal the requested card to the player's hand.

The next key to be discussed is the SPLIT key (see FIG. 15). First, flag SP is tested to ensure that a pair does exist in the player's hand. If it does exist, HS is next tested to ensure that the option of splitting is still available. If so, flags HS and Split are set and the carry bit 'C' is reset. SPA is next tested and if TRUE, C is set for use as a temporary flag. The player's second card is then set to ZERO and the Split 16 flag and the player hand totals are loaded with new totals corresponding to the value of one of the pair dealt, and the SA and PA flags are set if the card is an Ace. Flag 16 P is reset and the routine exits to Hand to obtain another card.

Figure 17:
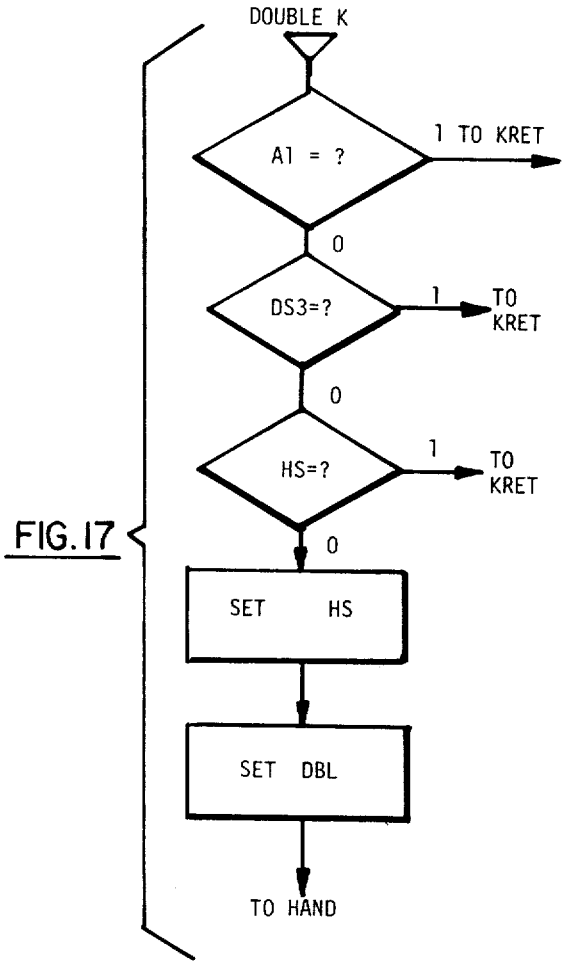

The next key to be discussed is the double key DBLK (see FIG. 17). First a test is made on Accept Insurance. If it is the insurance mode, this key is rejected by existing through Key Return KRET. Next DS3 is tested and an exit is made if DS3=1. In addition, if the HS flag is TRUE, which means the hand has been started, a "double" entry is not valid and the routine is exited through Key Return KRET. If the hand has not previously been started, the flag HS is now set to ONE to prevent further entry through this routine and the double flag is set. The routine then exits to HAND for dealing to the double condition.

Figure 18:
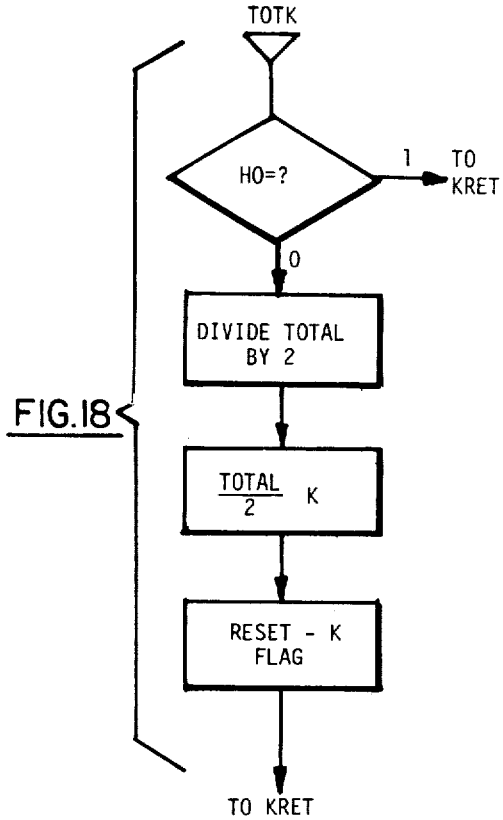

The following discussion deals with the operation of the Total Key TOTK (see FIG. 18). Depression of the Total Key results in a test of the Hand Over flag HO. If the hand is not over, or HO equals ZERO, the key is ignored and the routine exits through KRET. If the hand is over and HO is a ONE, the internal machine total is divided by two, because internally for ease of programming, the machine keeps track of a total that is twice the actual value of the stake. This total, divided by two, is inserted into the K register for display. To allow the contents of the K register to be displayed, the flag called K is reset. The K flag is a reset condition permit the K register contents to be displayed. This allows the new total divided by two or the player's actual total, to be displayed on the machine display.

Figure 20:
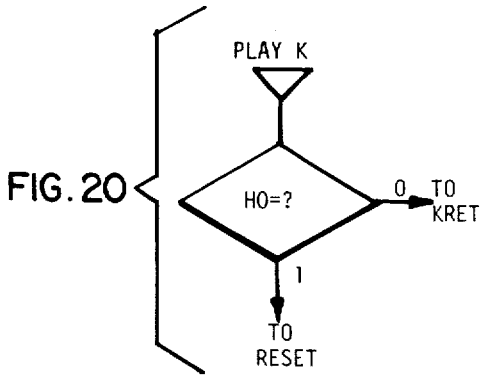

The next key to be discussed is the play PLAYK (see FIG. 20). The only test made is a determination of whether the hand is over. If HO equals ZERO, implying the hand is not over, the routine exits through Key Return KRET. If HO equals ONE, implying the hand is over, the program proceeds to the RESET portion of the POWER ON routine.

Figure 23:
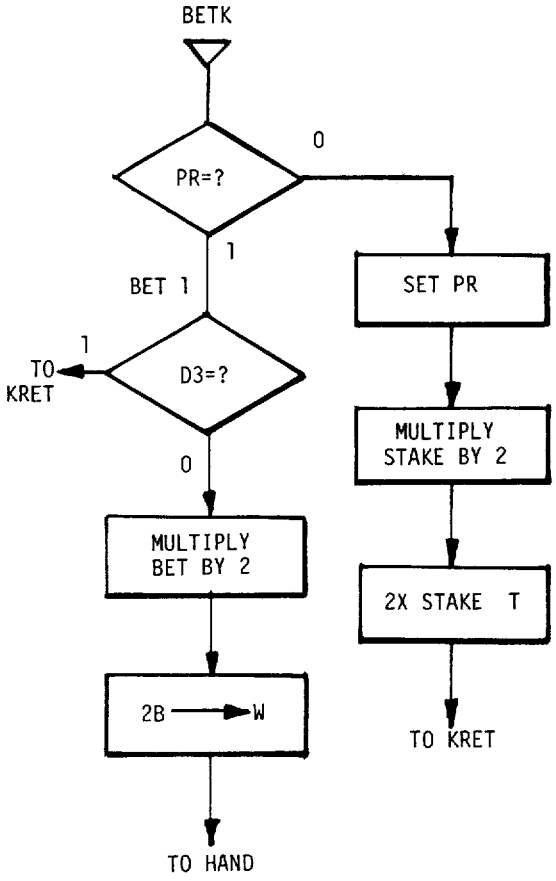

The next key to be discussed is the Bet Key BETK (see FIG. 23). The first test performed during the Bet Key routine is testing the Pool Ready flag PR. If the flag is ZERO, it implies the stake has still not been loaded. A ONE is then set in this flag to prevent it from being loaded during any further play of the game. Then two times the keyboard entered value, or two times the stake value, is loaded into the T register. Following this, the routine is exited through K return. If flag PR is equal to ONE, it implies that the stake has previously been entered and that this use of the bet key can be considered to be a betting function and not the entry of the original stake. Next, flag D3 is tested and if equal to ONE, it implies that the game is in the play of a hand and the routine exits through Key Return KRET since betting at this time is not permitted. If flag D3 equals ZERO, the routine continues by multiplying the amount bet by 2 and storing this new value, 2B, in the W register. The routine then exits to the HAND routine in which the player's and dealer's cards are dealt.

Figure 24:
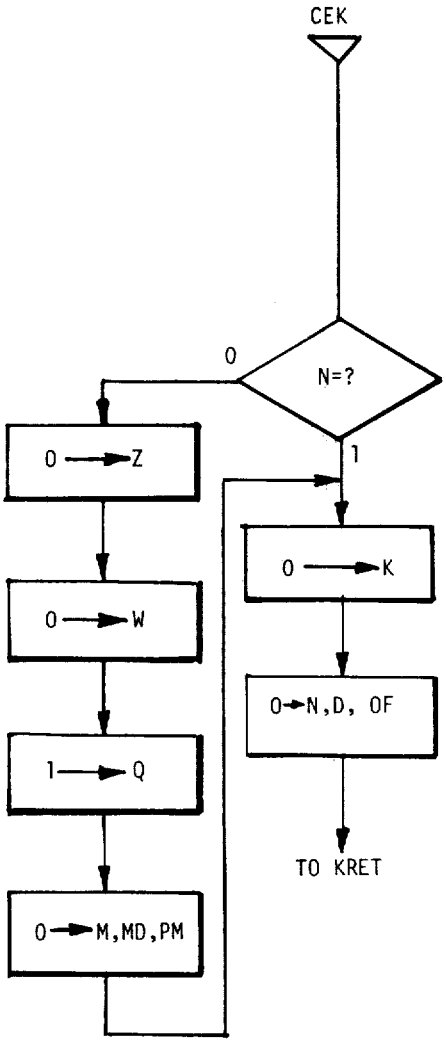

The next key is the Clear Entry Key CEK (see FIG. 24). The first test is made on a flag called N to determine whether a number entry was previously made before this key depression. If it was not a number entry, the function is considered to be a clear function and register Z, register W and several flags are preset to initial conditions. Then the K register is cleared and several other flags are cleared including the overflow flag OF and the routine is exited through K return. If the N flag is ONE, the key is considered to be a Clear Entry request and it is only used to clear either the number entry previously made or an overflow condition. Therefore, the K register number entry, the overflow flag and flags N and D are cleared and the routine is exited through K return.

Figure 25A:
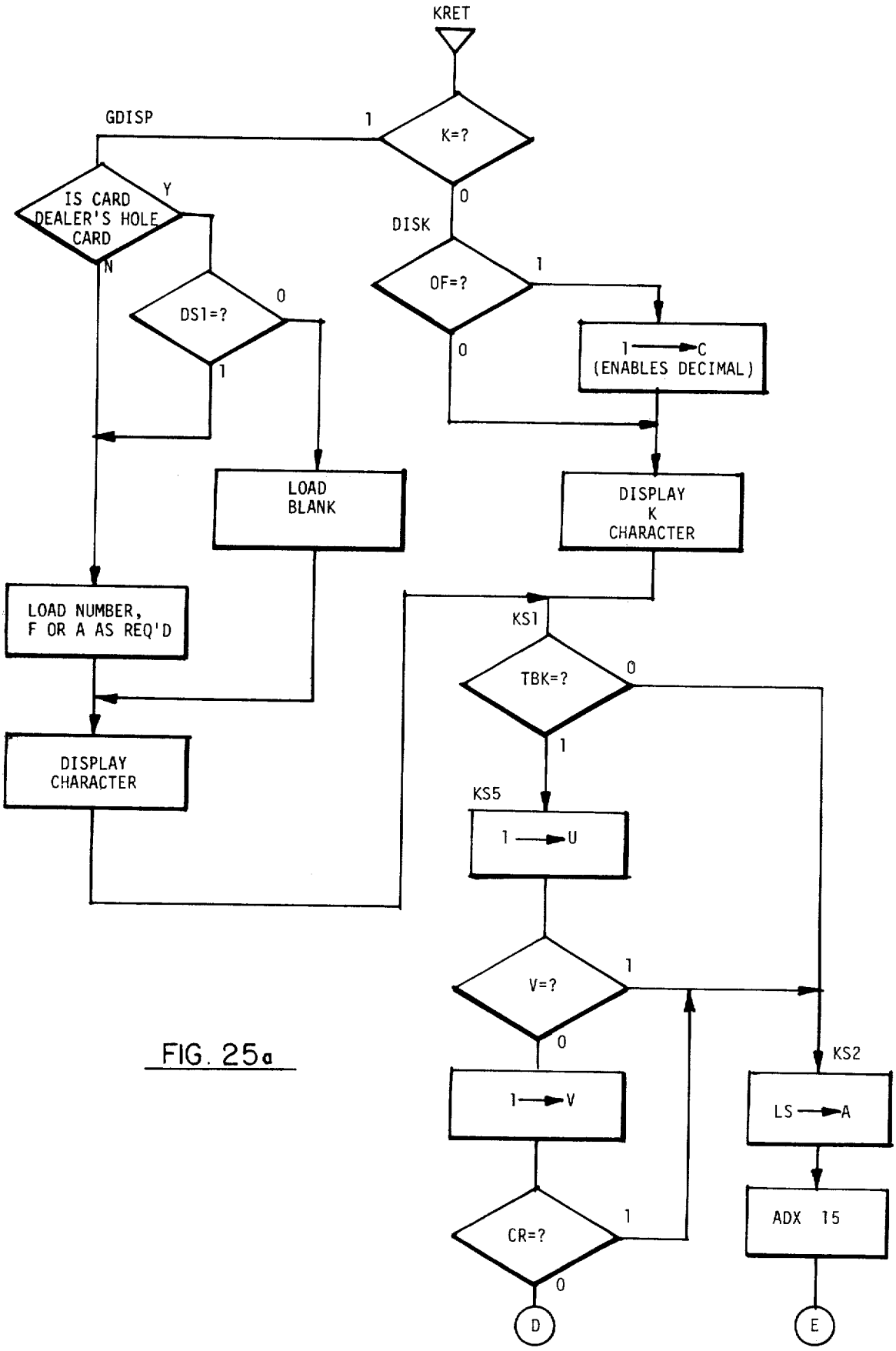
Figure 25B:
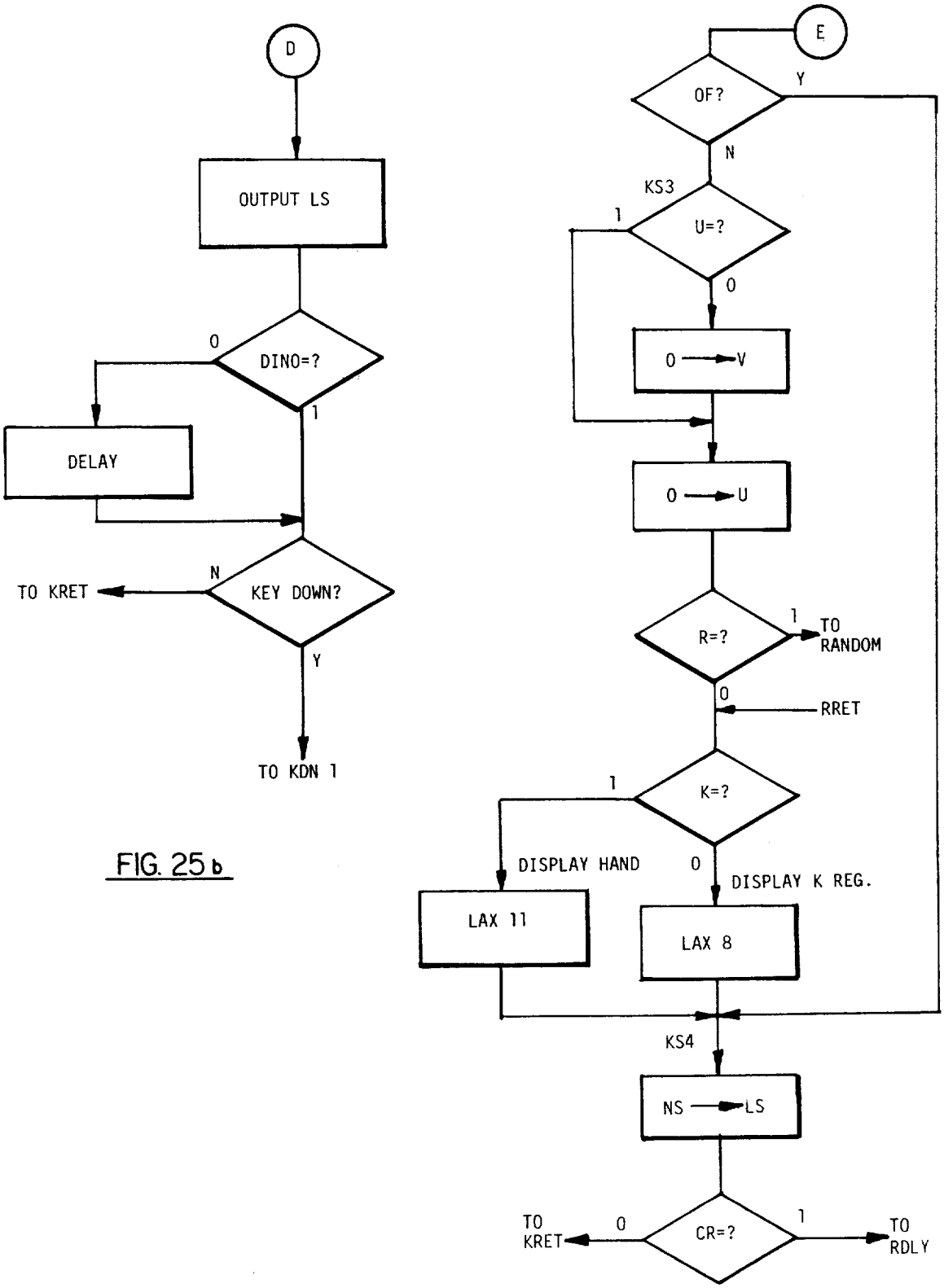

KRET ROUTINE (See FIGS. 25*a* and 25*b*)

The next routine discussed is the K return routine KRET. The first test made upon entering this routine is a test of the flag labled K. If flag K is ZERO, the action desired is a display of the contents of the K register. If the K flag is ONE, it implies that the operation is in the game mode and the various cards must be displayed. Examining the situation where K equals ZERO, the routine is called display K or DISK. A test is next made of the overflow flag. If the flag is a ONE, a ONE is set in the carry flip-flop which, in the display routine, turns on the decimal points. This allows an overflow condition to be indicated by all the decimals on the display. If the overflow flag is ZERO, the normal K character is displayed and the routine progresses to the next step called KS1.

Returning to the check of the K flag, if the K flag is ONE, the game display situation exists. A test is first made to determine whether the card to be displayed is the dealer's down card. If it is the dealer's down card, it is necessary to determine whether the entire dealer's hand should be displayed or not. This is done by a test of DS1. If DS1 equals zero, the game is still in progress and a blank is loaded into this character which effectively conceals the dealer's down card. The routine exits through KS1. If DS1 is set, it implies that the aler is now playing his hand and the player's hand is mplete. It is therefore, permissable to display the aler's down card and the routine progresses to load-g either the appropriate number corresponding to a rd for example, 2 through 9, or the code F if one of e displayed cards is a 10, or an A code if the card to displayed is an Ace. After these codes are loaded, the ored character is displayed and the routine exits rough KS1.

At KS1, the first test, called TKB, determines hether a key is presently depressed. If no key is de-essed, the program proceeds to KS2. The strobe unt that is presently being used, called LS for last robe, is loaded into the accumulator and decremented y adding 15 to it. Normally, this will result in an over-ow except for the case where the last strobe was zero. Then an overflow results, the routine bypasses KS3 nd continues to KS4 where this decrimented new robe count is loaded into the last strobe and the flag R, for card required, is tested. If no card is required, e routine exits through K return to repeat the KRET utine. If a card is required, the exit is to RDLY, for ndom delay. This routine has been discussed earlier. It sults in the expansion of the time required to deal a ard to allow for a more realistic simulation of an actual ame.

Returning to KS2, if the last strobe was ZERO, the ddition of 15 will not cause an overflow and the rou-ne enters routine KS3. At this point, the flag U is sted and if it is ZERO it implies that a key was not lown during one total strobe sequence. The flags U and V are then reset and operation continues. If U is set, it mplies that there was a key down during the process of equencing through the set of strobe signals. In this ase, the flag V is not reset, but the U flag is reset. This llows detection of the situation where a key is con-tantly held down as distinguished from the first time a ey is recognized as being down. This will be discussed urther below in conjunction with the KS5 routine.

Having set V and U appropriately, flag R, for ran-dom, is tested. If it is set, the routine exits to the RAN-DOM routine and generates a random number, for con-inued randomness of the card game. Following the eneration of the random number, the random routine eturns control to the next step in the routine through andom return RRET. If R flag is ZERO, this operation s bypassed. Flag K is then examined to determine whether all 12 digits of the display are required. If K equals ZERO, only 8 digits of the display are required and this results in a display of the contents of the K register. If K equals ONE, this requires a display of the card hand and all 12 positions are displayed. This is accomplished by loading either 11 or 8 into the starting point for the strobes, enabling the strobing of either strobe 8 through strobe 0 or strobe 11 through strobe 0 to provide the appropriate number of strobes. The rou-tine then exits to KS4 where the new strobe is loaded into last strobe location and the sequence begins again with a check of the flag CR.

Returning now to the part of the program labeled KS1, if test keyboard TKB is TRUE, then a ONE is loaded into the flag U. This ONE implies that a key has been been detected down during this operation. Next, flag V is tested. If flag V is found to be ONE, it implies that this condition has continued to exist during a full cycle of strobes and does not represent a new key de-pression but simply a situation where a key is being held down. Therefore, no new processing is performed and the routine exits to KS2 and continues to strobe in the normal manner. If flag V is ZERO, the condition im-plied is that it is the first time this key-down condition has existed. Following this discovery, a ONE is set into the V flag and a test of the card required bit, or CR bit, is conducted. If CR is ONE, the game is under way and a card is being dealt. This is not a valid key depression condition and the routine exits to KS2. If CR equals ZERO, no play of a card is under way and a valid key depression is considered to have occurred. The next step is to output the last strobe LS in preparation for determining the identity of the key that is depressed. Following the turning on of strobe LS, a discrete input is monitored to determine the requirement for a delay used in keyboard de-bounce. This function is used in the normal operation of the machine. It is bypassed only during the testing of the chip in manufacture where it may be desirable to reduce the test time required. Fol-lowing the delay period, a second test is made for a key down. If the key is no longer down it is considered to be an invalid or a bounce situation and return is made through K return. If a key is still down after this delay, the routine exits to determine the key identity and whether it was a valid depression, by performing the routine called KDN1.

Figure 22:
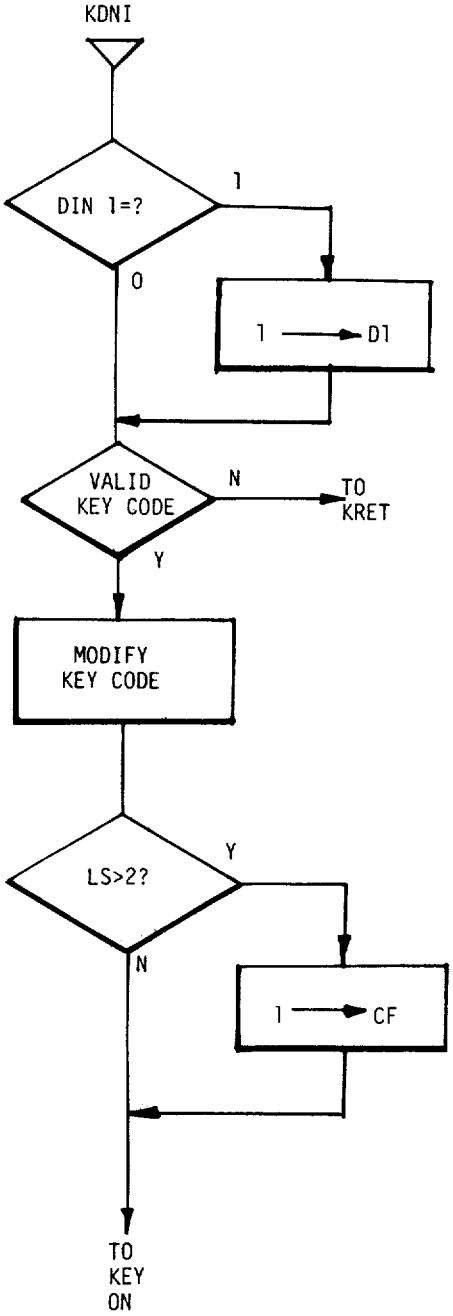

KDN1 ROUTINE (See FIG. 22)

This routine is a part of the key down routine and it is entered after a determination that a key has been down during the delay time for de-bounce and that the key is not being held down continuously. On entering KDN1, a test is first made of the discrete input line DIN1 and if it is set or on, a 1 is set in a flag bit called DI. Next the routine determines the validity of the key code that has been detected. This will eliminate false readings due to double-key depressions or key bounces that have involved several keys that have escaped de-tection through the key de-bounce routine. Invalid codes are rejected by an exit to K return. If the key is determined to be a valid code, this code is further modi-fied to generate a usable code in the process of decoding the particular key depressed. One of the uses for this modified key code is to convert this pattern into the actual numbers 1 through 9 so that when a key 4 as an example, is depressed, the resulting key code does in-deed produce a 4. In addition, some further modifica-tion is accomplished to recognize function keys as op-posed to number-entry keys.

The next test is a test of the last strobe, that is, the strobe which was on during the time the key was de-tected. If this strobe is numbered greater than 2, the CF flag is set. This flag is used in decoding the keys because it has special meaning in the way the keyboard is inter-connected. The routine then continues to the routine KEY ON.

Figure 26A:
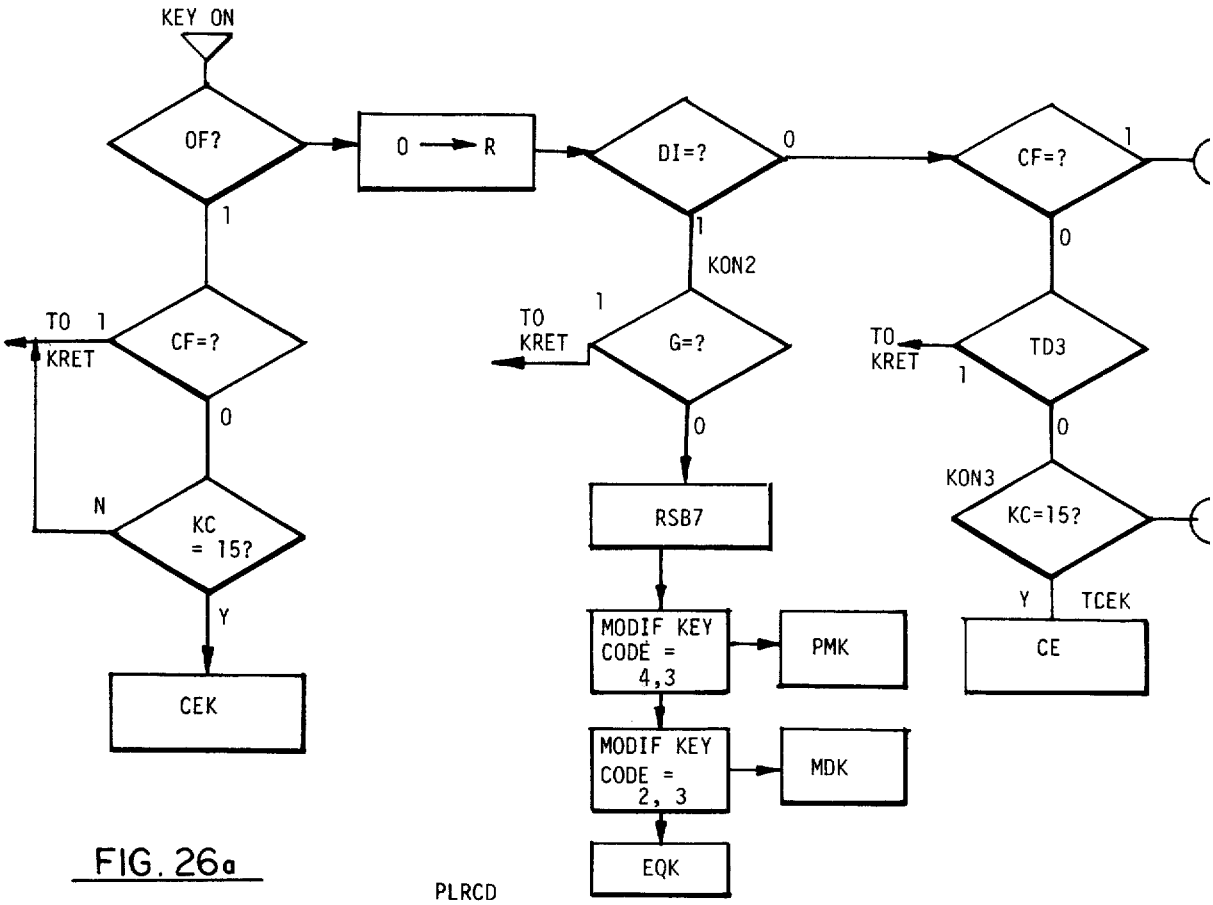
Figure 26B:
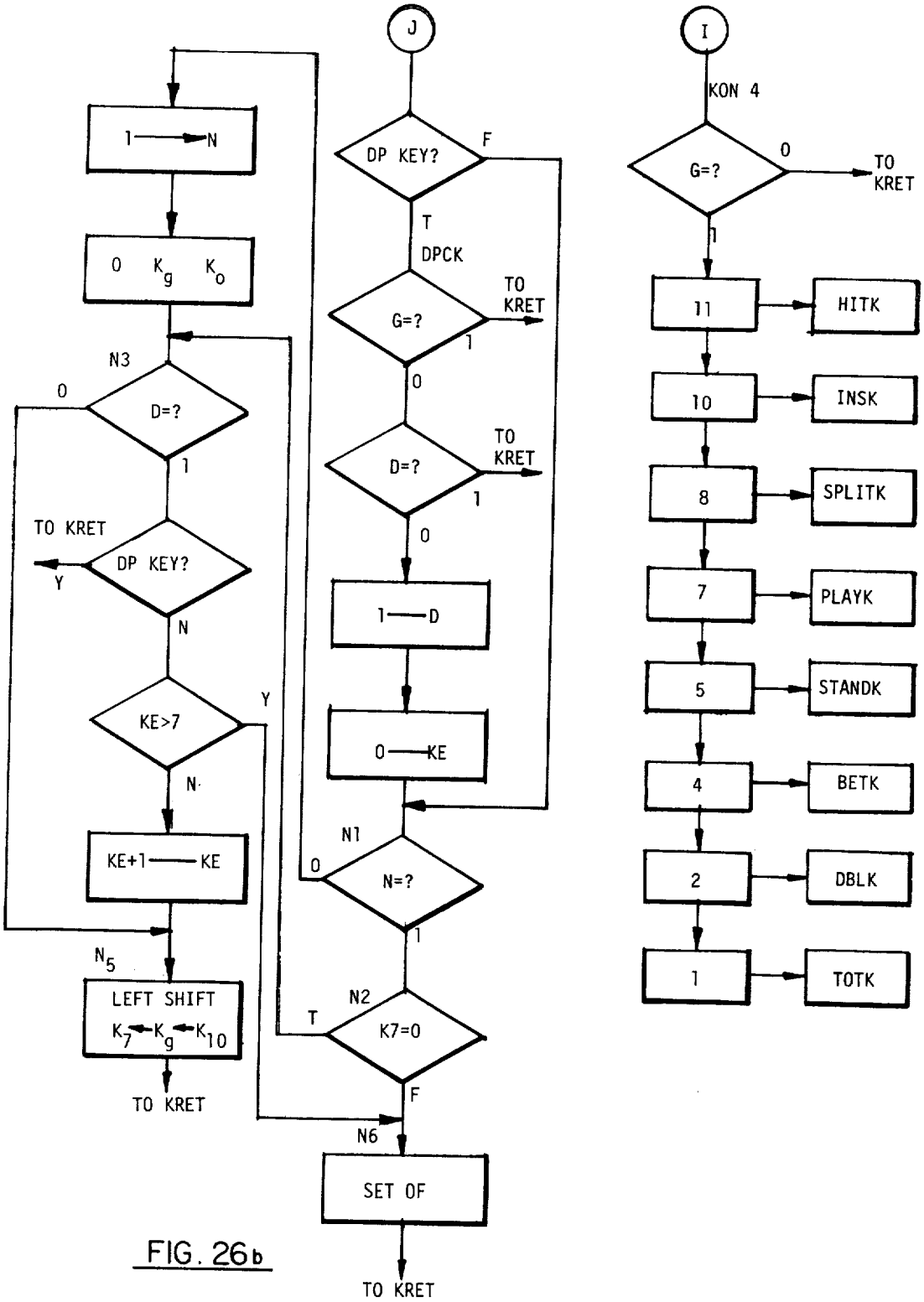

KEY ON ROUTINE (See FIGS. 26*a* and 26*b*)

The purpose of the KEY ON routine is to determine the actual key that has been depressed and to direct the routine to the appropriate subroutine for this key. The first test made is of the overflow flag OF, since if the overflow flag is on, the only valid key to be considered is the clear key. If the overflow flag is 1, a test is made to determine whether flag CF=1. If it is, this situation cannot represent a clear key. Next, the key code is tested for a value of 15. If the key code is 15, that repre-sents the code for clear or clear entry key and the rou-tine exits to the processing of the key CEK. If it is not 15, an exit is made through key return rejecting the key depression. If the overflow flag is ZERO, first a ZERO is set into flag R, which cancels the further periodic generation of random numbers until the next play key depression. Then a test is made on the DI flag, and if it is a ONE, it is assumed that a certain set of keys was depressed. Next a test is made on the flag G, standing for game, since these conditions will not be valid if operation is in game mode. A ONE, implying the game is on, causes an exit to KRET. If game G=0, the key code is tested and decoded as being one of the routines involving the four-function calculator operation and the routine is exited to service one of the appropriate keys depending upon the actual number in the modified key code.

Returning to the test of discrete input, if discrete input DI equals ZERO, the next test conducted is a test of the flag CF. If that is ZERO, it implies a potential number entry or decimal point entry. First, a test is made of D3 to determine the status of the game mode. If D3 equals ONE it implies that the game is in the process of playing a hand or a hand has been completed, but still not reset by a play key and the key depression is rejected and the routine is exited to KRET. If D3 equals ZERO, the routine continues. A test is next made on key code for a value of 15. If the value is 15, this represents a clear entry key and that routine is entered next. If key code is not equal to 15, a test is next performed on the key code to determine whether it is a decimal point key. If it is a decimal point key, the game flag G is checked and if the game flag is TRUE, this is considered an invalid entry and the routine exits through K return. If it is a decimal point key, and game G=0, a test is made to determine whether decimal has been entered previously or flag D is set. If flag D is set, the routine will not accept an additional decimal point. Then the routine is exited to K return. If D is ZERO, it is set and the exponent, which is located in the K register in location KE, is set to ZERO implying the clearing of the decimal point counter.

Returning to the test on the decimal point key, if it was not a decimal key that was depressed, this loop is bypassed ending up at routine called N1. At N1, the flag N is examined. If N equals 1, it implies that a number entry is in progress or that the last key depressed was a number entry. The routine proceeds to N2 at that point and a test is made on register K address 7. It it does not contain a ZERO, it implies that there is no room for an additional number entry and the routine proceeds to N6 setting the overflow flag and exits through K return. At the decision point, N2, if the K7 register is ZERO, the routine is then prepared to process the number entry through routine N3.

Returning now to the beginning of N1, if the number flag is ZERO, implying the last entry was not a number, then a ONE is inserted into the N flag and the K register is zeroed in preparation for entry of the first number. At N3, the D flag is tested and if the D flag is set, it implies that a decimal has been entered previously into the number system. A test is then made on the key code to determine whether it is a decimal key depression. If it is, no entry will be allowed and the routine exits through K return. If it is not a decimal key, it is a number key and the exponent of the number located in position KE is examined. If it is greater than 7, this implies an overflow condition and the routine exits through N6 setting the overflow flag. If KE is not greater than 7, a one is added to that value and routine N5 is entered and shifts the loaded key code, representing a number, into the K register.

Returning to the top of FIG. 26*a*, the test on flag CF is made and if it is a ONE, routine proceeds to routine KON4. (see FIG. 26*b*) A further test is conducted on the game flag and if it is ZERO, the routine exits through K return. If the flag is ONE, one of the game keys is involved and these are decoded depending upon the actual value of the existing key code. The appropriate subroutine for servicing the various keys are called upon depending upon the key code value.

Figure 27:
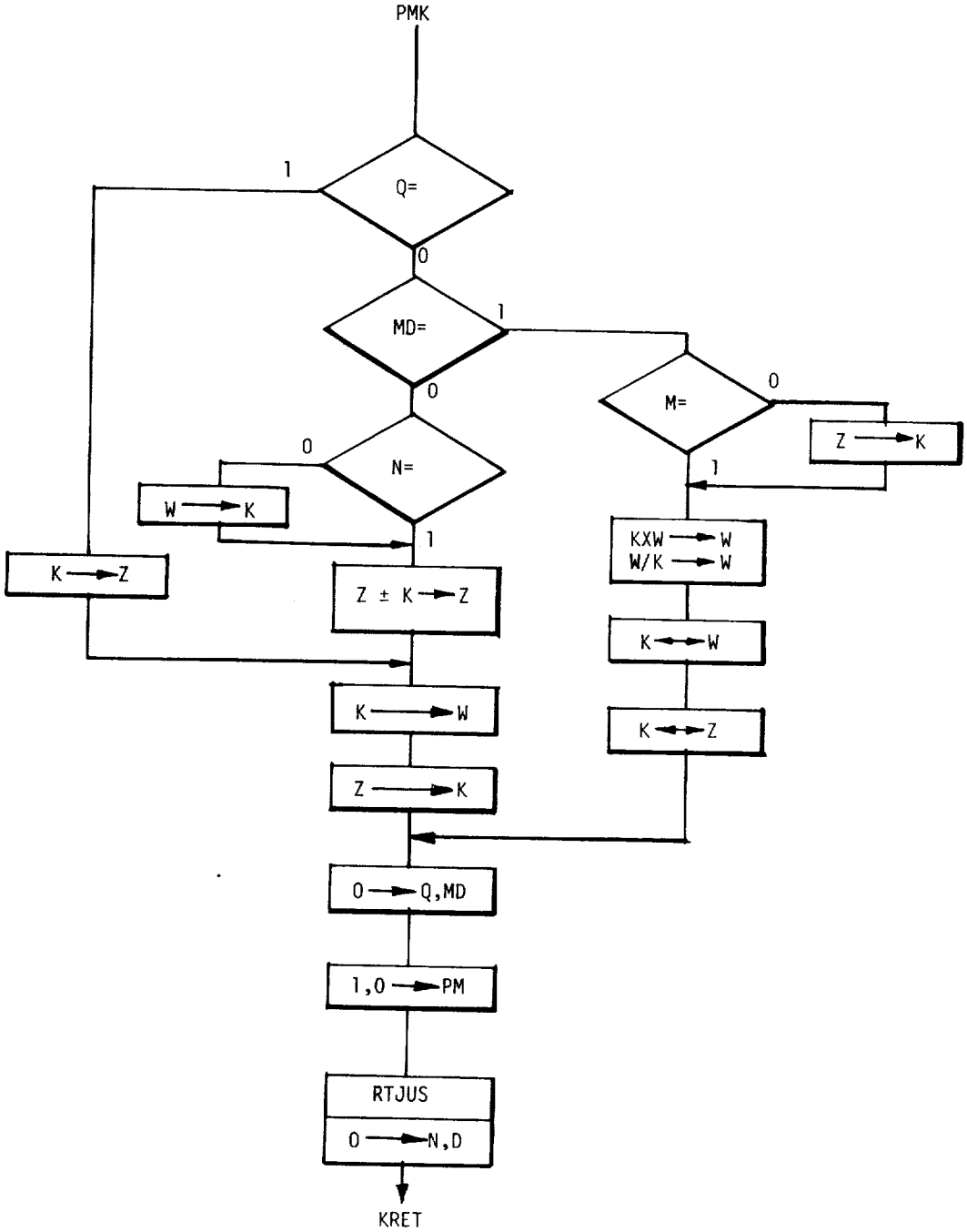
Figure 28:
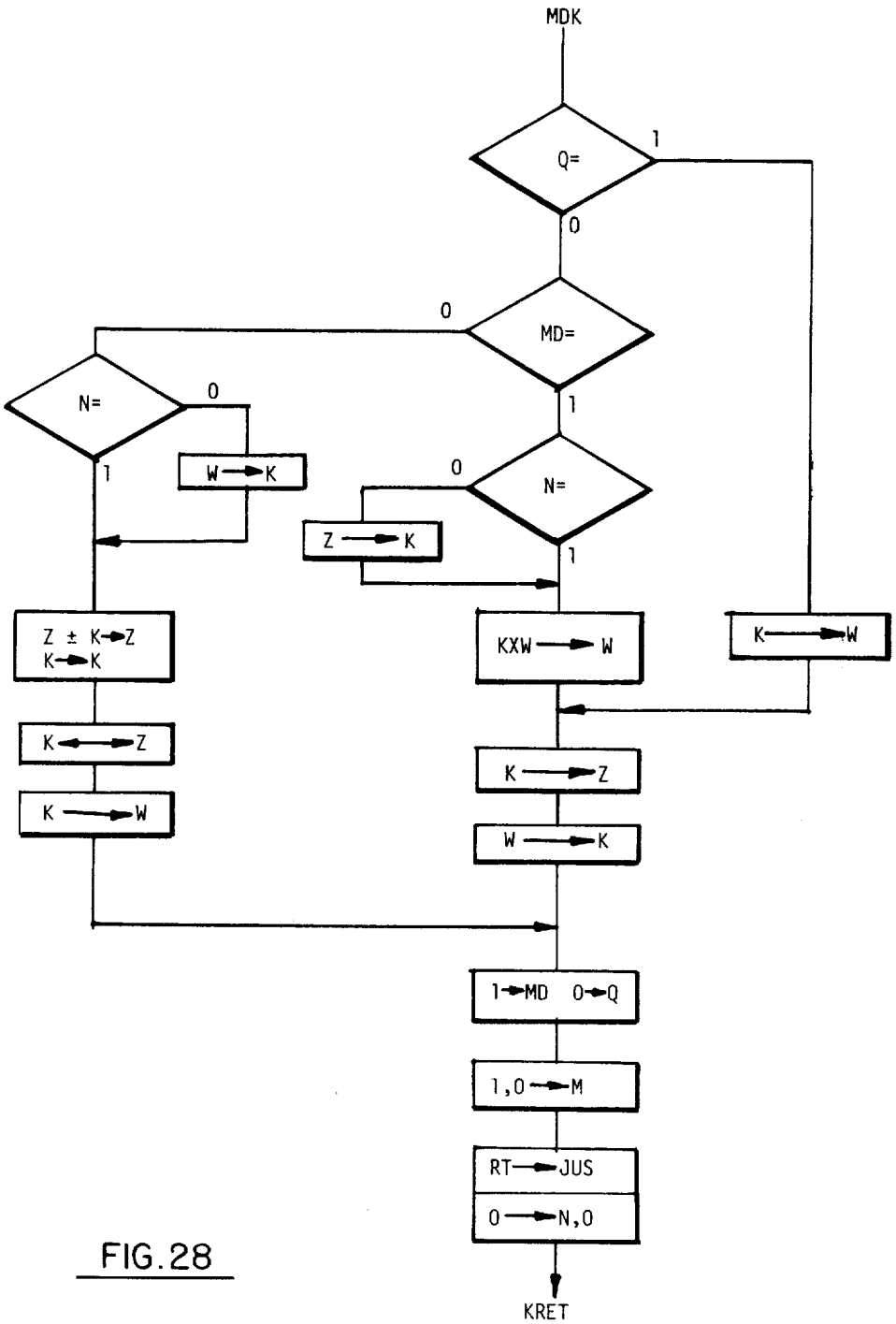
Figure 29:
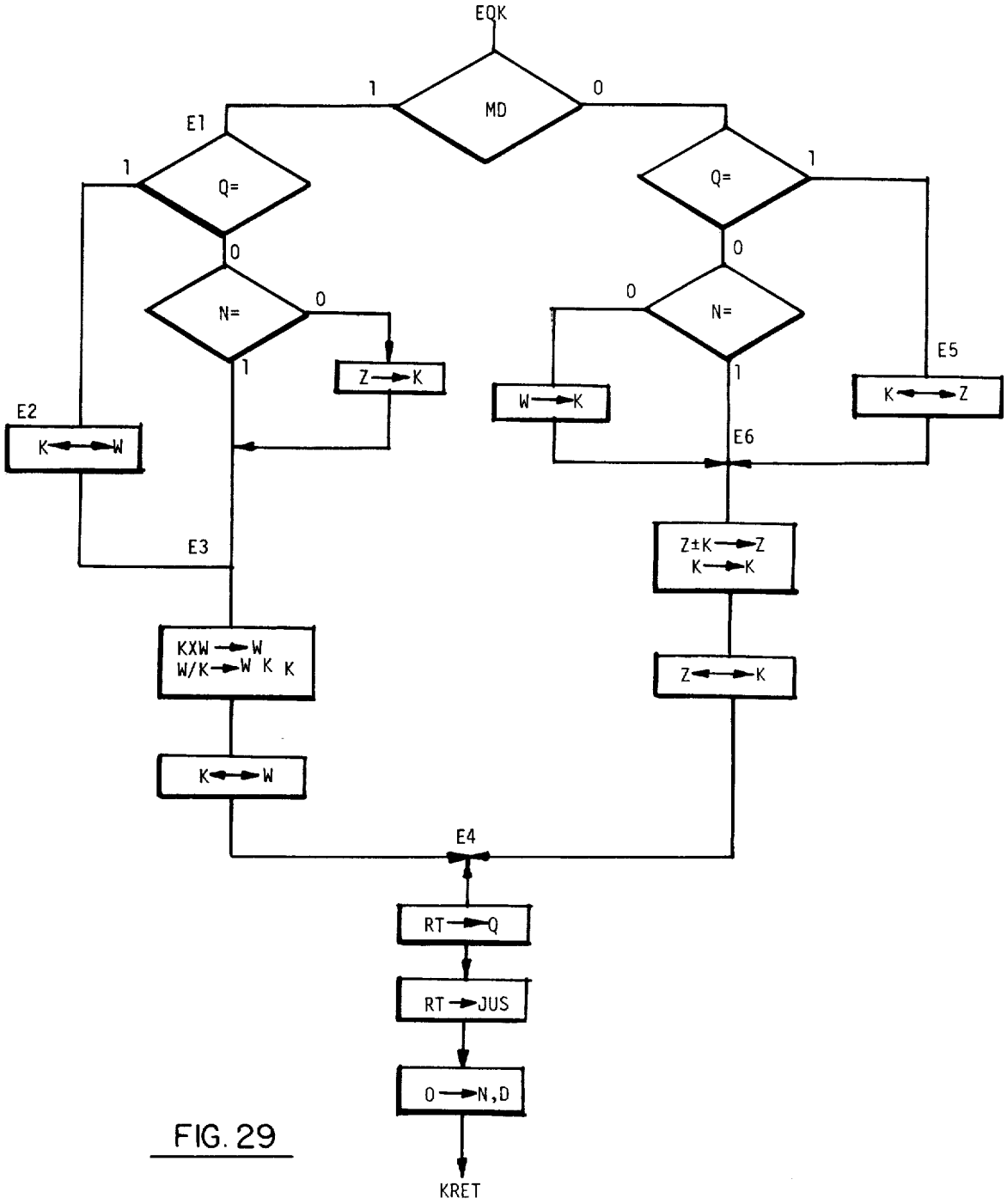

CALCULATOR ROUTINES (See FIGS. 27, 28 and 29)

Since four-function calculator routines are generally well known, this will be a general discussion of four-function calculator functions included in the programming.

PMK stands for plus-or-minus key. Generally, this routine services the two keys mentioned, the plus and minus keys, and is capable of handling constants as required in normal four-function operation. The PMK routine contains the proper right justify and sign controls to generate the required four-function operations. Another calculator routine is the MDK routine, which handles multiply and divide functions. MDK includes the appropriate constant handling routines, the multiply and divide subroutines, and appropriate right justify routines, to permit operation in the normal four-function calculator mode. The third routine involving the four-function operation is the EQUAL routine, which is equipped to deal with constant operation in all modes. As in the plus-or-minus and multiply-divide routines, EQUAL contains the required justify routines and the constant handling routines to permit normal four-function operation. FIGS. 27–29 are flow chart illustrations of the above mentioned calculator routines.

SUMMARY

It should now be understood that the invention described herein is an electronic card game simulation apparatus primarily for portable hand-held use by a player. A preferred embodiment has been described in which a Las Vegas style blackjack game is combined with a four-function calculator, although other card games and other functional combinations including card games, are intended to be within the scope of the appended claims.

Many details of a type which would be obvious to one skilled in the art have been omitted. For example, detailed aspects regarding timing have been omitted to prevent obfuscation of the more pertinent aspects of the invention. However, such timing aspects, as well as other more commonly occurring considerations, are well known in the art.

Having thus described a preferred embodiment of the invention, what is claimed is:

1. A hand-held portable electronics card game simulation apparatus comprising:

a hand-held housing constructed and arranged to include;

a keyboard having keys for entering player selection options, such as, whether to accept a card, whether to place a bet, and what exact amount to bet;

a display responsive to said keyboard for indicating the cards dealt in accordance with the rules of a card game, for indicating the options selected with said keys, and for indicating the betting status in accordance with the amount bet and the outcome of the games played;

said display comprising:

means for displaying at least two distinguishable sets of a alphanumeric symbols, one such set indicating only the card values held by a dealer and another such set indicating only the card values held by a player;

means operably connected to said keyboard and to said display for simulating the dealing of cards, for ascertaining the outcome of each hand, for calculating the betting status of the player, and for control of a card game in accordance with the rules of play.

2. An electronic card game simulation apparatus as defined in claim 1, said operably connected means further comprising:

means for delaying the display of each card added to the respective hands of the player and dealer whereby a more realistic rate of card dealing is provided.

3. An electronic card game simulation apparatus as defined in claim 2, said operably connected means further comprising:

means for storing a manifestation of a card being dealt, means to avoid re-dealing a previously dealt card, from a standard deck of 52 cards, and means to automatically re-shuffle the cards prior to the deal of a new hand when a prescribed number of cards approaching 52 likely to leave an insufficient number of cards to play a further hand have been dealt since the immediately previous shuffle.

4. An electronic card game simulation apparatus as defined in claim 3 further comprising:

means for signaling the player that a bet is to be entered and for displaying the amount of said bet.

5. The electronic card game apparatus recited in claim 1 wherein said means operably connected to said keyboard and to said display comprises:

a single chip monolithic semiconductor chip means having memory means including an array of memory cells, means for sequentially addressing the memory cells, arithmetic means for receiving data from the memory means and executing arithmetic functions on the data and returning it to the memory means, and means for generating timed signals for sequentially scanning the keys of said keyboard and the digits of said keyboard and the digits of said display to check the keys depressed and to display in accordance therewith.

6. An electronic true blackjack card game for hand-held operation by a player comprising:

a hand-held housing constructed and arranged to include;

keyboard means having keys for selection of player decision operations including the play of the game and the placement of bets in accordance with the complete rules of blackjack;

display means for simultaneous display of card hands held by a player and a dealer, display of player betting and the current stake; and microprocessor means for controlling the game in accordance with the rules of blackjack and for calculating the betting status of the player in accordance with the outcome of the game and displaying player bet and current stake.

7. An electronic blackjack card game as defined in claim 6, said microprocessor means further comprising:

means for generating and storing random numbers, each such random number representing a unique card in a single full playing card deck;

means for storing a manifestation of a card being dealt;

means to avoid re-dealing a previously dealt hand;

means to automatically re-shuffle said cards prior to the deal of a new hand when less than a prescribed number of cards have been dealt since the initial shuffle of the deck;

means for signaling the player that a bet is to be entered; and for displaying the bet;

means for storing manifestations of the cards dealt to the player and to the dealer;

means for adding the card values of the respective hands to determine the total hand value;

means for adding the card value of each additional card, to the hand value; and means for comparing each said hand value against the other and against a bust value for terminating the hand and determining the outcome of the hand in accordance with the rules of blackjack.

8. An electronic card game simulation apparatus comprising:

means for entering player selections in accordance with rules of the game;

means for storing a player's stake and for adding to and subtracting from said stake in accordance with the outcome of each hand;

means for shuffling and dealing cards in a random sequence and advising a player of the occurrence of shuffling;

means for dealing an additional card in accordance with said player selections;

means for manifesting the status of each hand as the game progresses; and means for ascertaining the outcome of each hand; and a multi-function calculator apparatus having an alpha-numeric display and means for selectively activating and deactivating said card game simulation apparatus and said calculator apparatus as alternative operating modes.

9. An electronic card game simulation apparatus as defined in claim 8 further comprising:

means for generating and storing random numbers, each such random number representing a unique card in a standard playing card deck of 52 cards.

* * * * *